US010952578B2

(12) United States Patent
Gill et al.

(10) Patent No.: US 10,952,578 B2
(45) Date of Patent: Mar. 23, 2021

(54) ROBOTIC CLEANER DEBRIS REMOVAL DOCKING STATION

(71) Applicant: SharkNinja Operating, LLC, Needham, MA (US)

(72) Inventors: Aaron Gill, Needham, MA (US); David Harting, Mansfield, MA (US); Hamish Thompson, Needham, MA (US); Christopher Meyer-Rassow, London (GB); Catriona C. A. Sutter, Brookline, MA (US); Isaku D. Kamada, Brighton, MA (US); Daniel Harris, Needham, MA (US); Trevor Hoffman, Needham, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 16/517,229

(22) Filed: Jul. 19, 2019

(65) Prior Publication Data

US 2020/0022544 A1 Jan. 23, 2020

Related U.S. Application Data

(60) Provisional application No. 62/700,973, filed on Jul. 20, 2018, provisional application No. 62/727,747, (Continued)

(51) Int. Cl.
*A47L 9/00* (2006.01)
*A47L 9/10* (2006.01)
(Continued)

(52) U.S. Cl.
CPC ..... *A47L 9/0054* (2013.01); *A47L 9/0063* (2013.01); *A47L 9/102* (2013.01); *A47L 9/1409* (2013.01);
(Continued)

(58) Field of Classification Search
CPC ..... A47L 2201/02; A47L 2201/024
See application file for complete search history.

(56) References Cited

U.S. PATENT DOCUMENTS 3,425,192 A 2/1969 Davis
3,543,325 A 12/1970 Hamrick
(Continued)

FOREIGN PATENT DOCUMENTS

CA 978485 A 11/1975
CN 1679439 B 10/2005
(Continued)

OTHER PUBLICATIONS

US 8,271,129 B2, 09/2012, Halloran et al. (withdrawn)
(Continued)

*Primary Examiner* — Andrew A Horton
(74) *Attorney, Agent, or Firm* — Grossman Tucker Perreault & Pfleger, PLLC

(57) ABSTRACT

A docking station for a robotic cleaner may include a base having a support and a suction housing, a docking station suction inlet defined in the suction housing, wherein the docking station suction inlet is configured to fluidly couple to the robotic cleaner, and an alignment protrusion defined in the support. The alignment protrusion may be configured to urge the robotic cleaner towards an orientation in which the robotic cleaner fluidly couples to the docking station suction inlet.

20 Claims, 39 Drawing Sheets

Related U.S. Application Data filed on Sep. 6, 2018, provisional application No. 62/732,274, filed on Sep. 17, 2018, provisional application No. 62/748,797, filed on Oct. 22, 2018, provisional application No. 62/782,545, filed on Dec. 20, 2018.

(51) Int. Cl.

| | |
|---|---|
| ***A47L 9/16*** | (2006.01) |
| ***A47L 9/28*** | (2006.01) |
| ***A47L 9/14*** | (2006.01) |
| ***A47L 11/40*** | (2006.01) |

(52) U.S. Cl.

CPC ..... *A47L 9/1436* (2013.01); *A47L 9/1463* (2013.01); *A47L 9/1683* (2013.01); *A47L 9/2805* (2013.01); *A47L 11/4025* (2013.01); *A47L 2201/024* (2013.01); *A47L 2201/04* (2013.01)

(56) References Cited

U.S. PATENT DOCUMENTS

| | | | |
|---|---|---|---|
| 4,679,152 | A | 7/1987 | Perdue |
| 4,846,297 | A | 7/1989 | Field et al. |
| 5,032,775 | A | 7/1991 | Mizuno et al. |
| 5,083,704 | A | 1/1992 | Rounthwaite |
| 5,135,552 | A | 8/1992 | Weistra |
| 5,769,572 | A | 6/1998 | Pfeiffer |
| 5,787,545 | A | 8/1998 | Colens |
| 6,076,226 | A | 6/2000 | Schaap |
| 6,122,796 | A | 9/2000 | Downham et al. |
| 6,327,741 | B1 | 12/2001 | Schaap |
| 6,525,509 | B1 | 2/2003 | Petersson et al. |
| 6,553,612 | B1 | 4/2003 | Dyson et al. |
| 6,582,489 | B2 | 6/2003 | Conrad |
| 6,600,899 | B1 | 7/2003 | Radomsky et al. |
| 6,607,572 | B2 | 8/2003 | Gammack et al. |
| 6,625,845 | B2 | 9/2003 | Matsumoto et al. |
| 6,629,028 | B2 | 9/2003 | Paromtchik et al. |
| 6,811,584 | B2 | 11/2004 | Oh |
| 6,818,036 | B1 | 11/2004 | Seaman |
| 6,824,580 | B2 | 11/2004 | Oh |
| 6,835,222 | B2 | 12/2004 | Gammack |
| 6,928,692 | B2 | 8/2005 | Oh et al. |
| 6,957,712 | B2 | 10/2005 | Song et al. |
| 6,968,592 | B2 | 11/2005 | Takeuchi et al. |
| 7,024,278 | B2 | 4/2006 | Chiappetta et al. |
| 7,055,210 | B2 | 6/2006 | Keppler |
| 7,070,636 | B2 | 7/2006 | McCormick et al. |
| 7,124,680 | B2 | 10/2006 | Poss |
| 7,133,746 | B2 | 11/2006 | Abramson et al. |
| 7,152,276 | B2 | 12/2006 | Jin et al. |
| 7,152,277 | B2 | 12/2006 | Jung et al. |
| 7,188,000 | B2 | 3/2007 | Chiappetta et al. |
| 7,196,487 | B2 | 3/2007 | Jones et al. |
| 7,218,994 | B2 | 5/2007 | Kanda et al. |
| 7,227,327 | B2 | 6/2007 | Im |
| 7,247,181 | B2 | 7/2007 | Hansen et al. |
| 7,291,190 | B2 | 11/2007 | Dummelow et al. |
| 7,294,159 | B2 | 11/2007 | Oh et al. |
| 7,318,249 | B2 | 1/2008 | Lin |
| 7,318,848 | B2 | 1/2008 | Lee |
| 7,332,890 | B2 | 2/2008 | Cohen et al. |
| 7,335,241 | B2 | 2/2008 | Oh et al. |
| 7,351,269 | B2 | 4/2008 | Yau |
| 7,412,748 | B2 | 8/2008 | Lee et al. |
| 7,412,749 | B2 | 8/2008 | Thomas et al. |
| 7,418,762 | B2 | 9/2008 | Arai et al. |
| 7,419,520 | B2 | 9/2008 | Lee et al. |
| 7,457,399 | B2 | 11/2008 | Onken |
| 7,473,289 | B2 | 1/2009 | Oh et al. |
| 7,481,160 | B1 | 1/2009 | Simon |
| 7,494,520 | B2 | 2/2009 | Nam et al. |
| 7,494,523 | B2 | 2/2009 | Oh et al. |
| 7,501,780 | B2 | 3/2009 | Yamamoto |
| 7,526,362 | B2 | 4/2009 | Kim et al. |
| 7,547,336 | B2 | 6/2009 | Fester et al. |
| 7,547,337 | B2 | 6/2009 | Oh et al. |
| 7,547,338 | B2 | 6/2009 | Kim et al. |
| 7,611,553 | B2 | 11/2009 | Hato |
| 7,704,290 | B2 | 4/2010 | Oh |
| 7,706,917 | B1 | 4/2010 | Chiappetta et al. |
| 7,720,554 | B2 | 5/2010 | DiBernardo et al. |
| 7,729,801 | B2 | 6/2010 | Abramson |
| 7,776,116 | B2 | 8/2010 | Oh et al. |
| 7,779,504 | B2 | 8/2010 | Lee et al. |
| 7,827,653 | B1 | 11/2010 | Liu et al. |
| 7,849,555 | B2 | 12/2010 | Hahm et al. |
| 7,861,366 | B2 | 1/2011 | Hahm et al. |
| 7,887,613 | B2 | 2/2011 | Ruben |
| 7,891,045 | B2 | 2/2011 | Kim et al. |
| 7,933,687 | B2 | 4/2011 | Baek et al. |
| 7,996,097 | B2 | 8/2011 | DiBernardo et al. |
| 7,996,126 | B2 | 8/2011 | Hong |
| 8,019,223 | B2 | 9/2011 | Hudson et al. |
| 8,029,590 | B2 | 10/2011 | Cheng |
| 8,065,778 | B2 | 11/2011 | Kim et al. |
| 8,087,117 | B2 | 1/2012 | Kapoor et al. |
| 8,106,626 | B2 | 1/2012 | Li et al. |
| 8,229,593 | B2 | 7/2012 | Rodriguez et al. |
| 8,239,992 | B2 | 8/2012 | Schnittman et al. |
| 8,310,684 | B2 | 11/2012 | Lee et al. |
| 8,316,499 | B2 | 11/2012 | Dooley et al. |
| 8,341,802 | B2 | 1/2013 | Kim et al. |
| 8,368,339 | B2 | 2/2013 | Jones |
| 8,374,721 | B2 | 2/2013 | Halloran et al. |
| 8,380,350 | B2 | 2/2013 | Ozick |
| 8,390,251 | B2 | 3/2013 | Cohen |
| 8,418,303 | B2 | 4/2013 | Kapoor |
| 8,438,694 | B2 | 5/2013 | Kim |
| 8,438,698 | B2 | 5/2013 | Kim |
| 8,452,450 | B2 | 5/2013 | Dooley |
| 8,461,803 | B2 | 6/2013 | Cohen |
| 8,476,867 | B2 | 7/2013 | Li et al. |
| 8,528,157 | B2 | 9/2013 | Schnittman |
| 8,549,704 | B2 | 10/2013 | Milligan |
| 8,572,799 | B2 | 11/2013 | Won |
| 8,584,305 | B2 | 11/2013 | Won |
| 8,590,101 | B2 | 11/2013 | Liu |
| 8,591,615 | B2 | 11/2013 | Kim |
| 8,606,404 | B1 | 12/2013 | Huffman |
| 8,627,542 | B2 | 1/2014 | Kim |
| 8,634,956 | B1 | 1/2014 | Chiappetta |
| 8,634,958 | B1 | 1/2014 | Chiappetta |
| 8,635,739 | B2 | 1/2014 | Lee |
| 8,650,703 | B2 | 2/2014 | Kim et al. |
| 8,657,904 | B2 | 2/2014 | Smith |
| 8,688,270 | B2 | 4/2014 | Roy et al. |
| 8,695,159 | B2 | 4/2014 | Van Der Kooi |
| 8,707,512 | B2 | 4/2014 | Horne |
| 8,732,901 | B2 | 5/2014 | Shim |
| 8,741,013 | B2 | 6/2014 | Swett |
| 8,742,926 | B2 | 6/2014 | Schnittman |
| 8,749,196 | B2 | 6/2014 | Cohen |
| 8,756,751 | B2 | 6/2014 | Jung |
| 8,763,201 | B2 | 7/2014 | Kim |
| 8,782,850 | B2 | 7/2014 | Yoo |
| 8,806,708 | B2 | 8/2014 | Sutton |
| 8,826,492 | B2 | 9/2014 | Dyson |
| 8,854,001 | B2 | 10/2014 | Cohen |
| 8,857,012 | B2 | 10/2014 | Kim et al. |
| 8,863,353 | B2 | 10/2014 | Smith |
| 8,869,338 | B1 | 10/2014 | Dooley et al. |
| 8,870,988 | B2 | 10/2014 | Oh |
| 8,918,209 | B2 | 12/2014 | Rosenstein |
| 8,926,723 | B2 | 1/2015 | Kim |
| 8,930,023 | B2 | 1/2015 | Gutmann |
| 8,945,258 | B2 | 2/2015 | Smith |
| 8,951,319 | B2 | 2/2015 | Kim |
| 8,954,192 | B2 | 2/2015 | Ozick |
| 8,972,052 | B2 | 3/2015 | Chiappetta |
| 8,979,960 | B2 | 3/2015 | Smith |

(56) References Cited

U.S. PATENT DOCUMENTS

| | | | |
|---|---|---|---|
| 8,984,708 | B2 | 3/2015 | Kuhe |
| 8,984,712 | B2 | 3/2015 | Peng |
| 9,005,324 | B2 | 4/2015 | Smith |
| 9,005,325 | B2 | 4/2015 | Smith |
| 9,008,835 | B2 | 4/2015 | Dubrovsky |
| 9,027,199 | B2 | 5/2015 | Jung |
| 9,044,125 | B2 | 6/2015 | Follows |
| 9,044,126 | B2 | 6/2015 | Dyson |
| 9,060,666 | B2 | 6/2015 | Jang |
| 9,131,818 | B2 | 9/2015 | Peace et al. |
| 9,144,360 | B2 | 9/2015 | Ozick |
| 9,146,560 | B2 | 9/2015 | Burnett |
| 9,149,170 | B2 | 10/2015 | Ozick |
| 9,178,370 | B2 | 11/2015 | Henricksen et al. |
| 9,192,272 | B2 | 11/2015 | Ota |
| 9,204,771 | B2 | 12/2015 | Gammack |
| 9,215,957 | B2 | 12/2015 | Cohen et al. |
| 9,229,454 | B1 | 1/2016 | Chiappetta et al. |
| 9,233,471 | B2 | 1/2016 | Schnittman et al. |
| 9,282,863 | B2 | 3/2016 | Follows |
| 9,354,634 | B2 | 5/2016 | Ko |
| 9,360,300 | B2 | 6/2016 | DiBernado et al. |
| 9,375,842 | B2 | 6/2016 | Shamlian et al. |
| 9,380,922 | B2 | 7/2016 | Duffley et al. |
| 9,402,524 | B2 | 8/2016 | Yoon |
| 9,420,741 | B2 | 8/2016 | Balutis et al. |
| 9,423,798 | B2 | 8/2016 | Liu et al. |
| 9,439,547 | B2 | 9/2016 | Makarov |
| 9,462,920 | B1 | 10/2016 | Morin et al. |
| 9,468,349 | B2 | 10/2016 | Fong et al. |
| 9,476,771 | B2 | 10/2016 | Teng et al. |
| 9,486,924 | B2 | 11/2016 | Dubrovsky et al. |
| 9,492,048 | B2 | 11/2016 | Won et al. |
| 9,504,365 | B2 | 11/2016 | Kim et al. |
| 9,510,717 | B2 | 12/2016 | Ko |
| 9,521,937 | B2 | 12/2016 | Follows |
| 9,526,391 | B2 | 12/2016 | Lee |
| 9,529,363 | B2 | 12/2016 | Chiappetta |
| 9,538,702 | B2 | 1/2017 | Balutis et al. |
| 9,538,892 | B2 | 1/2017 | Fong et al. |
| 9,550,294 | B2 | 1/2017 | Cohen et al. |
| 9,572,467 | B2 | 2/2017 | Dyson et al. |
| 9,591,957 | B2 | 3/2017 | Dyson et al. |
| 9,599,990 | B2 | 3/2017 | Halloran et al. |
| 9,613,308 | B2 | 4/2017 | Izhikevich et al. |
| 9,630,317 | B2 | 4/2017 | Izhikevich et al. |
| 9,675,229 | B2 | 6/2017 | Kwak et al. |
| 9,704,043 | B2 | 7/2017 | Schnittman |
| 9,757,004 | B2 | 9/2017 | Neumann et al. |
| 9,788,698 | B2 | 10/2017 | Morin et al. |
| 9,826,678 | B2 | 11/2017 | Balutis et al. |
| 9,826,871 | B2 | 11/2017 | Jang et al. |
| 9,826,872 | B2 | 11/2017 | Schnittman et al. |
| 9,826,873 | B2 | 11/2017 | Abe et al. |
| 9,840,003 | B2 | 12/2017 | Szatmary et al. |
| 9,866,035 | B2 | 1/2018 | Doughty et al. |
| 9,884,423 | B2 | 2/2018 | Cohen et al. |
| 9,888,818 | B2 | 2/2018 | Kuhe et al. |
| 9,901,236 | B2 | 2/2018 | Halloran et al. |
| 9,904,284 | B2 | 2/2018 | Kwak et al. |
| 9,907,447 | B2 | 3/2018 | Tanaka et al. |
| 9,924,846 | B2 | 3/2018 | Morin et al. |
| 9,931,007 | B2 | 4/2018 | Morin et al. |
| 9,931,012 | B2 | 4/2018 | Ichikawa |
| 9,955,841 | B2 | 5/2018 | Won |
| 9,968,232 | B2 | 5/2018 | Watanabe |
| 10,022,029 | B2 | 7/2018 | Machida et al. |
| 10,048,694 | B2 | 8/2018 | Abe |
| 10,048,695 | B2 | 8/2018 | Hoshino |
| 10,244,915 | B2 | 4/2019 | Schnittman et al. |
| 10,268,189 | B2 | 4/2019 | Yan |
| 10,398,272 | B2 | 9/2019 | Hyun |
| 10,661,672 | B2 | 5/2020 | Wendeborn |
| 2002/0078524 | A1 | 6/2002 | Schroter |
| 2003/0159235 | A1 | 8/2003 | Oh |
| 2004/0163206 | A1 | 8/2004 | Oh |
| 2004/0255425 | A1 | 12/2004 | Arai et al. |
| 2005/0011037 | A1 | 1/2005 | Zhao et al. |
| 2005/0015920 | A1 | 1/2005 | Kim |
| 2005/0150519 | A1 | 7/2005 | Keppler |
| 2007/0157415 | A1* | 7/2007 | Lee ..... A47L 5/225 15/319 |
| 2007/0157420 | A1 | 7/2007 | Lee |
| 2007/0226947 | A1 | 10/2007 | Kang |
| 2007/0226948 | A1 | 10/2007 | Due |
| 2007/0226949 | A1* | 10/2007 | Hahm ..... A47L 9/009 15/340.1 |
| 2007/0245511 | A1 | 10/2007 | Hahm |
| 2009/0044370 | A1 | 2/2009 | Won |
| 2009/0049640 | A1 | 2/2009 | Lee |
| 2009/0151306 | A1 | 6/2009 | Lin |
| 2009/0183633 | A1 | 7/2009 | Schiller |
| 2009/0223183 | A1 | 9/2009 | Lin |
| 2009/0229230 | A1 | 9/2009 | Cheng |
| 2010/0022029 | A1 | 1/2010 | Yoshimura |
| 2010/0048694 | A1 | 2/2010 | Radzik et al. |
| 2010/0048695 | A1 | 2/2010 | Ono et al. |
| 2010/0107355 | A1 | 5/2010 | Wen |
| 2010/0244915 | A1 | 9/2010 | Kwon et al. |
| 2012/0084937 | A1 | 4/2012 | Won |
| 2013/0205520 | A1 | 8/2013 | Kapoor |
| 2013/0298350 | A1 | 11/2013 | Schnittman |
| 2013/0335900 | A1 | 12/2013 | Jang |
| 2014/0053351 | A1 | 2/2014 | Kapoor |
| 2014/0059983 | A1 | 3/2014 | Ho |
| 2014/0130272 | A1 | 5/2014 | Won |
| 2014/0184144 | A1 | 7/2014 | Henricksen |
| 2014/0229008 | A1 | 8/2014 | Schnittman |
| 2015/0057800 | A1 | 2/2015 | Cohen |
| 2016/0075021 | A1 | 3/2016 | Cohen |
| 2016/0113469 | A1 | 4/2016 | Schnittman |
| 2016/0143500 | A1 | 5/2016 | Fong |
| 2016/0183752 | A1 | 6/2016 | Morin |
| 2016/0374528 | A1 | 12/2016 | Morin |
| 2017/0055796 | A1 | 3/2017 | Won |
| 2017/0072564 | A1 | 3/2017 | Cohen |
| 2017/0105592 | A1 | 4/2017 | Fong |
| 2017/0150861 | A1 | 6/2017 | Tanaka et al. |
| 2017/0209011 | A1 | 7/2017 | Robinson |
| 2017/0217019 | A1 | 8/2017 | Cohen |
| 2017/0273532 | A1 | 9/2017 | MacHida |
| 2017/0319033 | A1 | 11/2017 | Hyun |
| 2018/0008111 | A1 | 1/2018 | Morin |
| 2018/0014709 | A1* | 1/2018 | O'Brien ..... A47L 9/2826 |
| 2018/0064303 | A1 | 3/2018 | Meggle |
| 2018/0125312 | A1 | 5/2018 | Kuhe |
| 2018/0177358 | A1 | 6/2018 | Conrad |
| 2018/0177367 | A1 | 6/2018 | Amaral |
| 2018/0199776 | A1 | 7/2018 | Sato |

FOREIGN PATENT DOCUMENTS

| | | | |
|---|---|---|---|
| CN | 201719179 | U | 1/2011 |
| CN | 101984910 | A | 3/2011 |
| CN | 201840420 | U | 5/2011 |
| CN | 102125407 | A | 7/2011 |
| CN | 103316528 | B | 9/2013 |
| CN | 203852305 | U | 10/2014 |
| CN | 105078367 | A | 11/2015 |
| CN | 1212095 | C | 12/2017 |
| CN | 107468159 | A | 12/2017 |
| DE | 19704468 | A1 | 8/1998 |
| DE | 20311505 | U1 | 9/2003 |
| DE | 102007059591 | A1 | 6/2009 |
| DE | 102013108564 | A1 | 3/2015 |
| EP | 2023788 | A2 | 2/2009 |
| EP | 1535564 | B1 | 8/2009 |
| EP | 1743562 | B1 | 9/2011 |
| EP | 1707094 | B1 | 4/2012 |
| EP | 1959809 | B1 | 5/2014 |
| EP | 2459043 | B1 | 9/2015 |
| EP | 2225993 | B1 | 2/2016 |
| EP | 2548489 | B1 | 3/2016 |
| EP | 2394553 | B1 | 4/2016 |

(56) References Cited

FOREIGN PATENT DOCUMENTS

| | | | | |
|---|---|---|---|---|
| EP | 2548492 | B1 | 4/2016 | |
| EP | 3031377 | B1 | 8/2018 | |
| GB | 539973 | A | 10/1941 | |
| GB | 2449484 | B | 11/2008 | |
| GB | 2459300 | B | 10/2009 | |
| GB | 2487387 | B | 7/2012 | |
| GB | 2522658 | B | 8/2015 | |
| JP | 06072502 | B2 | 10/1941 | |
| JP | 06088784 | B2 | 10/1941 | |
| JP | 2003038398 | A | 2/2003 | |
| JP | 2003180587 | A | 2/2003 | |
| JP | 2003339593 | A | 12/2003 | |
| JP | 2003339594 | A | 12/2003 | |
| JP | 2003339595 | A | 12/2003 | |
| JP | 2003339596 | A | 12/2003 | |
| JP | 2005218512 | A | 8/2005 | |
| JP | 2006340935 | A | 12/2006 | |
| JP | 2007089755 | A | 4/2007 | |
| JP | 2008154801 | A | 7/2008 | |
| JP | 2008194177 | A | 8/2008 | |
| JP | 2008246154 | A | 10/2008 | |
| JP | 2014079455 | A | 5/2014 | |
| KR | 100437362 | B1 | 6/2004 | |
| KR | 1020010047287 | | 6/2004 | |
| KR | 1020030000599 | | 6/2005 | |
| KR | 100572866 | B1 | 4/2006 | |
| KR | 100572877 | B1 | 4/2006 | |
| KR | 100634805 | B1 | 10/2006 | |
| KR | 20070012109 | A | 1/2007 | |
| KR | 1020010020747 | | 5/2007 | |
| KR | 100880492 | B1 | 1/2009 | |
| KR | 20090088587 | A | 8/2009 | |
| KR | 101134243 | B1 | 4/2012 | |
| KR | 101306738 | B1 | 9/2013 | |
| KR | 100070755 | B1 | 5/2014 | |
| WO | WO2011025071 | A1 | 3/2011 | |
| WO | WO2012094617 | A2 | 7/2012 | |
| WO | WO2012086950 | A2 | 10/2012 | |
| WO | WO-2015082019 | A1 * | 6/2015 | ..... A47L 11/4041 |
| WO | WO2016206759 | A1 | 12/2016 | |
| WO | WO2017123136 | A1 | 7/2017 | |
| WO | WO2018118072 | A1 | 6/2018 | |

OTHER PUBLICATIONS

International Search Report and Written Opinion dated Jul. 5, 2019, received in PCT Application No. PCT/US19/30214, 9 pgs.

United States Provisional Patent Application 60-807442 titled Bin Full Detector filed Jul. 14, 2006.

International Search Report and Written Opinion relating to corresponding application PCT/US2019/042704, dated Sep. 30, 2019.

IRobot Master, iRobot Master—iRobot Roomba Robot Not Charging Docking Station Solution. YouTube, Dec. 26, 2015 (retrieved from Intenet Jan. 9, 2019): https://www.youtube.com/watch?v=MwQg6yklePo.

* cited by examiner

ROBOTIC CLEANER DEBRIS REMOVAL DOCKING STATION

CROSS-REFERENCE TO RELATED APPLICATIONS

The present application claims the benefit of U.S. Provisional Application Ser. No. 62/700,973 filed on Jul. 20, 2018, entitled Robotic Vacuum Cleaner Debris Removal Docking Station, U.S. Provisional Application Ser. No. 62/727,747 filed on Sep. 6, 2018, entitled Robotic Vacuum Cleaner Debris Removal Docking Station, U.S. Provisional Application Ser. No. 62/732,274 filed on Sep. 17, 2018, entitled Robotic Vacuum Cleaner Debris Removal Docking Station, U.S. Provisional Application Ser. No. 62/748,797 filed on Oct. 22, 2018, entitled Robotic Vacuum Cleaner Debris Removal Docking Station, and U.S. Provisional Application Ser. No. 62/782,545 filed on Dec. 20, 2018, entitled Robotic Vacuum Cleaner Debris Removal Docking Station, each of which are fully incorporated herein by reference.

TECHNICAL FIELD

The present disclosure is generally directed to automated cleaning apparatuses and more specifically to robotic cleaners and docking stations for robotic cleaners.

BACKGROUND INFORMATION

Autonomous surface treatment apparatuses are configured to traverse a surface (e.g., a floor) while removing debris from the surface with little to no human involvement. For example, a robotic vacuum may include a controller, a plurality of driven wheels, a suction motor, a brush roll, and a dust cup for storing debris. The controller causes the robotic vacuum cleaner to travel according to one or more patterns (e.g., a random bounce pattern, a spot pattern, a wall/obstacle following pattern, and/or the like). While traveling pursuant to one or more patterns, the robotic vacuum cleaner collects debris in the dust cup. As the dust cup gathers debris, the performance of the robotic vacuum cleaner may be degraded. As such, the dust cup may need to be emptied at regular intervals to maintain consistent cleaning performance.

BRIEF DESCRIPTION OF THE DRAWINGS

These and other features and advantages will be better understood by reading the following detailed description, taken together with the drawings, wherein.

DETAILED DESCRIPTION

The present disclosure is generally directed to a docking station configured to remove debris from a dust cup of a robotic cleaner. The docking station includes a base having a suction motor, a docking station dust cup, and a fluid inlet. When the suction motor is activated, fluid is caused to flow along a flow path extending from the fluid inlet through the docking station dust cup into the suction motor such that it can be exhausted from the docking station.

In some instances, the docking station dust cup can be configured to pivot relative to the base such that the docking station dust cup can transition between an in-use position and a removal position in response to the pivotal movement. When in the in-use position, the docking station dust cup is in fluid communication with the suction motor and the fluid inlet and, when in the removal position, the docking station dust cup is configured to be removed (e.g., in response to further pivotal movement) from the base such that the docking station dust cup can be emptied.

Additionally, or alternatively, the docking station dust cup can be configured to include a filter (e.g., a filter medium and/or a cyclonic separator) extending within an internal volume of the dust cup such that a first debris collection chamber and a second debris collection chamber are defined therein. The first debris collection chamber can be configured to collect debris having a relatively large particle size when compared to debris collected in the second debris collection chamber. As such, the first debris collection chamber may generally be described as being configured to receive large debris and the second debris collection chamber may be generally described as being configured to receive small debris.

Additionally, or alternatively, the docking station can be configured to urge the robotic cleaner towards an aligned orientation such that the robotic cleaner can fluidly couple to the docking station. For example, the docking station can include an alignment protrusion configured to engage at least a portion of the robotic cleaner. The alignment protrusion urges the robotic cleaner towards the aligned orientation as a result of the inter-engagement between the alignment protrusion and the robotic cleaner.

As generally referred to herein, the term resiliently deformable may refer to an ability of a mechanical component to repeatably transition between an un-deformed and a deformed state (e.g., transition between the un-deformed and deformed state at least 100 times, 1,000 times, 100,000 times, 1,000,000 times, 10,000,000, or any other suitable number of times) without the component experiencing a mechanical failure (e.g., the component is no longer able to function as intended).

Figure 1:
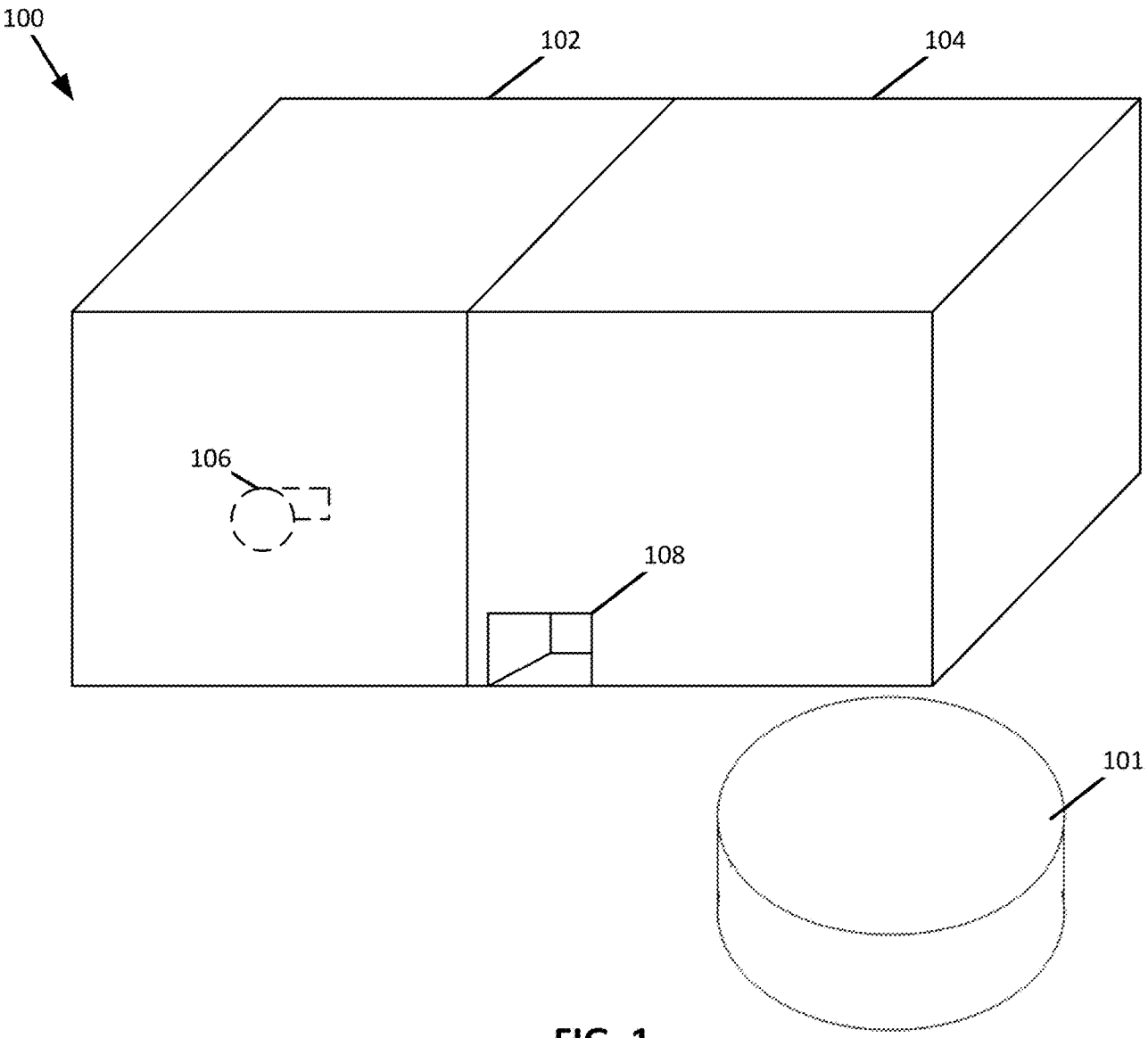
FIG. 1 shows a schematic perspective view of a docking station configured to engage a robotic vacuum cleaner, consistent with embodiments of the present disclosure.

FIG. 1 shows a schematic view of a docking station 100. The docking station 100 includes a base 102 and a docking station dust cup 104 configured to pivot relative to the base 102. The base 102 includes a suction motor 106 (shown in hidden lines) fluidly coupled to an inlet 108 and the docking station dust cup 104. When the suction motor 106 is activated, fluid is caused to flow into the inlet 108, through the docking station dust cup 104, and exit the base 102 after passing through the suction motor 106.

The inlet 108 is configured to fluidly couple to a robotic cleaner 101 (e.g., a robotic vacuum cleaner, a robotic mop, and/or other robotic cleaner). For example, the inlet 108 can be configured to fluidly couple to a port provided in a dust cup of the robotic cleaner 101 such that debris stored in the dust cup of the robotic cleaner 101 can be transferred into the docking station dust cup 104. When the suction motor 106 is activated, the suction motor 106 causes debris stored in the dust cup of the robotic cleaner 101 to be urged into the docking station dust cup 104. The debris may then collect in the docking station dust cup 104 for later disposal. The docking station dust cup 104 may be configured such that the docking station dust cup 104 can receive debris from the dust cup of the robotic cleaner 101 multiple times (e.g., at least two times) before the docking station dust cup 104 becomes full (e.g., the performance of the docking station 100 is substantially degraded). In other words, the docking station dust cup 104 may be configured such that the dust cup of the robotic cleaner 101 can be emptied several times before the docking station dust cup 104 becomes full.

In some instances, the suction motor 106 is activated prior to the robotic cleaner 101 engaging the docking station 100. In these instances, the suction generated by the suction motor 106 at the inlet 108 may urge the robotic cleaner 101 into engagement with the docking station 100. As such, the suction motor 106 may help facilitate the alignment of the robotic cleaner 101 with the inlet 108.

The docking station dust cup 104 is configured to be pivoted between an in-use position and a removal position. When the docking station dust cup 104 is in the in-use position, the suction motor 106 is fluidly coupled to the docking station dust cup 104 and the inlet 108. When the docking station dust cup 104 is in the removal position, the docking station dust cup 104 is configured to be removed from the base 102. For example, when the docking station dust cup 104 is in the removal position, the suction motor 106 may be fluidly decoupled from the docking station dust cup 104.

In some instances, the robotic cleaner 101 can be configured to perform one or more wet cleaning operations (e.g., using a mop pad and/or a fluid dispensing pump). Additionally, or alternatively the robotic cleaner 101 can be configured to perform one or more vacuum cleaning operations.

Figure 2:
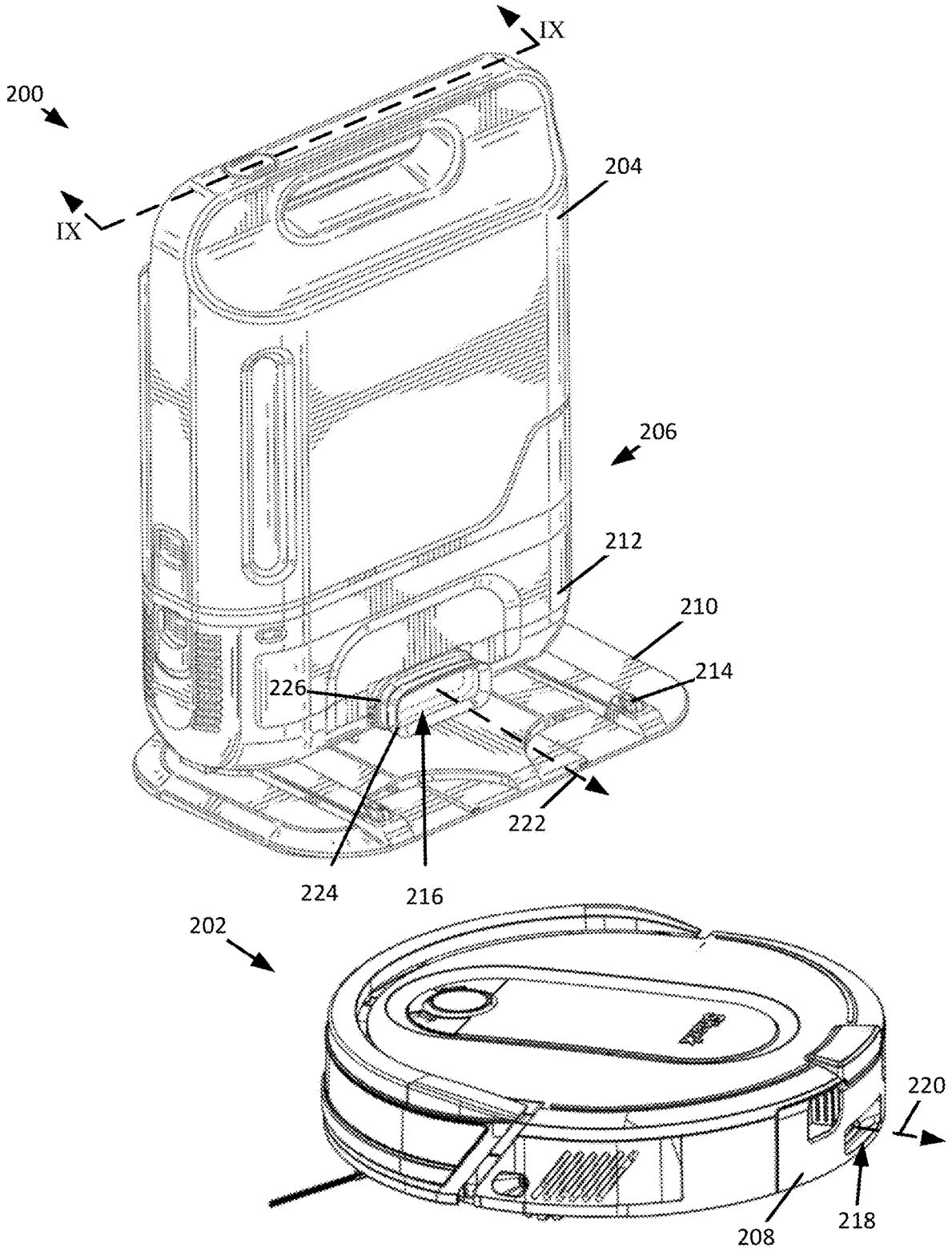
FIG. 2 shows a perspective view of a docking station and a robotic vacuum cleaner configured to dock with the docking station, consistent with embodiments of the present disclosure.

FIG. 2 shows an example of a docking station 200 and a robotic vacuum cleaner 202, which may be example of the docking station 100 and the robotic cleaner 101 of FIG. 1, respectively. As shown, the docking station 200 includes a docking station dust cup 204 and a base 206, the docking station dust cup 204 being removably coupled to the base 206. The docking station 200 can be configured to fluidly couple to a robotic vacuum cleaner dust cup 208 such that at least a portion of any debris stored within the robotic vacuum cleaner dust cup 208 can be urged into the docking station dust cup 204.

The base 206 can define a support 210 and a suction housing 212 that extends from the support 210. The support 210 is configured to improve the stability of the docking station 100 on a surface to be cleaned (e.g., a floor). The support 210 may also include charging contacts 214 configured to electrically couple to the robotic vacuum cleaner 202 such that one or more batteries powering the robotic vacuum cleaner 202 can be recharged. The suction housing 212 can define a docking station suction inlet 216. The docking station suction inlet 216 is configured to fluidly couple to at least a portion of the robotic vacuum cleaner 202 such that at least a portion of any debris stored within the robotic vacuum cleaner dust cup 208 can be urged through the docking station suction inlet 216 and into the docking station dust cup 204. For example, and as shown, the robotic vacuum cleaner dust cup 208 can include an outlet port 218 configured to fluidly couple to the docking station suction inlet 216.

When the robotic vacuum cleaner 202 seeks to recharge one or more batteries and/or empty the robotic vacuum cleaner dust cup 208, the robotic vacuum cleaner 202 can enter a docking mode. When in the docking mode, the robotic vacuum cleaner 202 approaches the docking station 200 in a manner that allows the robotic vacuum cleaner 202 to electrically couple to the charging contacts 214 and fluidly couple the outlet port 218 to the docking station suction inlet 216. In other words, when in docking mode, the robotic vacuum cleaner 202 can generally be described as moving to align itself relative to the docking station 200 such that the robotic vacuum cleaner 202 can become docked with the docking station 200. For example, when in docking mode, the robotic vacuum cleaner 202 may approach the docking station 200 in a forward direction of travel until reaching a predetermined distance from the docking station 200, stop at the predetermined distance and rotate approximately 180°, and proceed in a rearward direction of travel until the robotic vacuum cleaner 202 docks with the docking station 200.

When approaching the docking station 200, the robotic vacuum cleaner 202 may be configured to detect a proximity to the docking station 200 using one or more proximity sensors. For example, the docking station 200 may be configured to generate a magnetic field (e.g., using one or more magnets 211, shown in hidden lines schematically, embedded in the support 210) and the robotic vacuum cleaner 202 may include, for example, a hall effect sensor 213 (shown in hidden lines schematically) to detect the magnetic field. Upon detecting the magnetic field, the robotic vacuum cleaner 202 may rotate to reverse into the docking station 200 (or reverse a predetermined distance from the docking station 200 before rotating such that robotic vacuum cleaner 202 can reverse into the docking station 200). Additionally, or alternatively, for example, the docking station 200 may include a radio frequency identification (RFID) tag and the robotic vacuum cleaner 202 may include an RFID tag reader to determine proximity to the docking station 200. Additionally, or alternatively, the robotic vacuum cleaner 202 may be configured to be wirelessly charged by the docking station 200 and proximity to the docking station 200 may be determined based on detection of wireless charging.

The robotic vacuum cleaner 202 may generally be described as being aligned with the docking station 200 when, for example, an outlet port central axis 220 of the outlet port 218 is collinear with a suction inlet central axis 222 of the docking station suction inlet 216. In some instances, the docking station 200 can be configured such that the robotic vacuum cleaner 202 can dock with the docking station 200 while being misaligned. Misalignment may be measured as an angle extending between the outlet port central axis 220 and the suction inlet central axis 222 when the outlet port central axis 220 and the suction inlet central axis 222 are not colinear. An acceptable misalignment may measure, for example, in a range of 0° to 10°. By way of further example, the acceptable misalignment may measure in a range of 1° to 3°.

As shown, the docking station 200 can include a boot 224 that extends around the docking station suction inlet 216. The boot 224 can be configured to engage the robotic vacuum cleaner dust cup 208 such that the boot 224 extends around the outlet port 218. The boot 224 can be resiliently deformable such that the boot 224 generally conforms to a shape of the robotic vacuum cleaner dust cup 208. As such, the boot 224 can be configured to sealingly engage the robotic vacuum cleaner dust cup 208. For example, the boot 224 may be made of a natural or synthetic rubber, a foam, and/or any other resiliently deformable material.

In some instances, the resiliently deformable boot 224 may allow the robotic vacuum cleaner 202 to fluidly couple to the docking station suction inlet 216 while the robotic vacuum cleaner 202 is misaligned with the docking station 200 within an acceptable misalignment range. In other words, the boot 224 is configured to move in response to the robotic vacuum cleaner 202 engaging the docking station 200 (e.g., the base 206) in a misaligned orientation.

As also shown, the boot 224 can define one or more ribs 226. The ribs 226 are configured to expand and/or compress in response to the robotic vacuum cleaner 202 engaging the boot 224. For example, when the robotic vacuum cleaner 202 engages the boot 224 in a misaligned orientation, a portion of the ribs 226 may expand and another portion of the ribs 226 may compress. The expansion and compression of the ribs 226 may allow the boot 224 to sealingly engage the robotic vacuum cleaner dust cup 208 when the robotic vacuum cleaner 202 docks with the docking station 200 in a misaligned orientation.

Figure 2A:
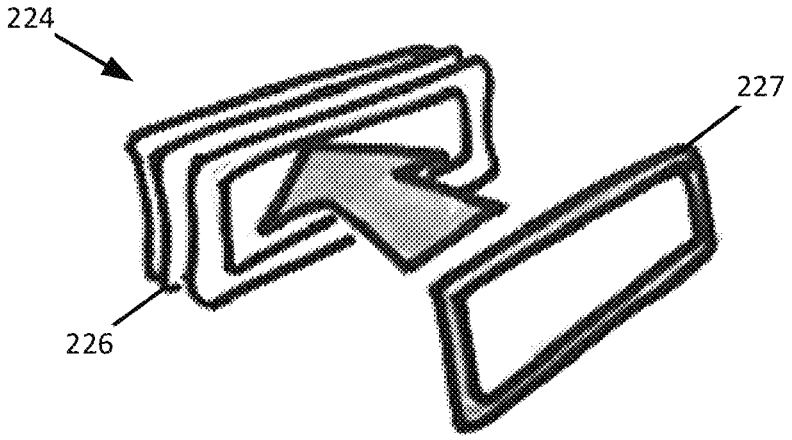
FIG. 2A shows a schematic perspective view of a boot configured to receive a stiffener, consistent with embodiments of the present disclosure.

FIG. 2A shows a schematic example of a stiffener 227 configured to be received within the boot 224 (shown schematically for purposes of clarity). As shown, the stiffener 227 is a continuous body having a shape that generally corresponds to that of a cross-section of the boot 224. For example, the stiffener 227 can be configured extend along an interior surface of the boot 224 that corresponds to a respective one of the ribs 226. By extending along one of the ribs 226 the stiffener 227 may increase a rigidity of the boot 224 along the corresponding rib 226. For example, the stiffener 227 may extend along a distal most rib 226 from the suction housing 212. This may improve the fluid coupling between the robotic vacuum cleaner dust cup 208 and the boot 224. The stiffener 227 can be one or more of a metal, a plastic, a ceramic, and/or any other material. The stiffener 227 may be coupled to the boot 224 using, for example, a press-fit, an adhesive, overmolding, and/or any other form of coupling. In some instances, the rigidity of the boot 224 may be increased by a stiffener that extends along an exterior and/or interior surface of the boot 224 in a direction transverse to the one or more ribs 226. In these instances, at least a portion of the stiffener can be configured to collapse such that the boot 224 can deform in response to engaging the robotic vacuum cleaner 202.

In some instances, when the robotic vacuum cleaner 202 is engaging the docking station 200 in a misaligned orientation, the robotic vacuum cleaner 202 can be configured to pivot in place according to an oscillatory pattern. By pivoting in place, the robotic vacuum cleaner 202 may cause the outlet port 218 to align with the boot 224 such that the outlet port 218 is fluidly coupled to the docking station suction inlet 216.

Figure 2B:
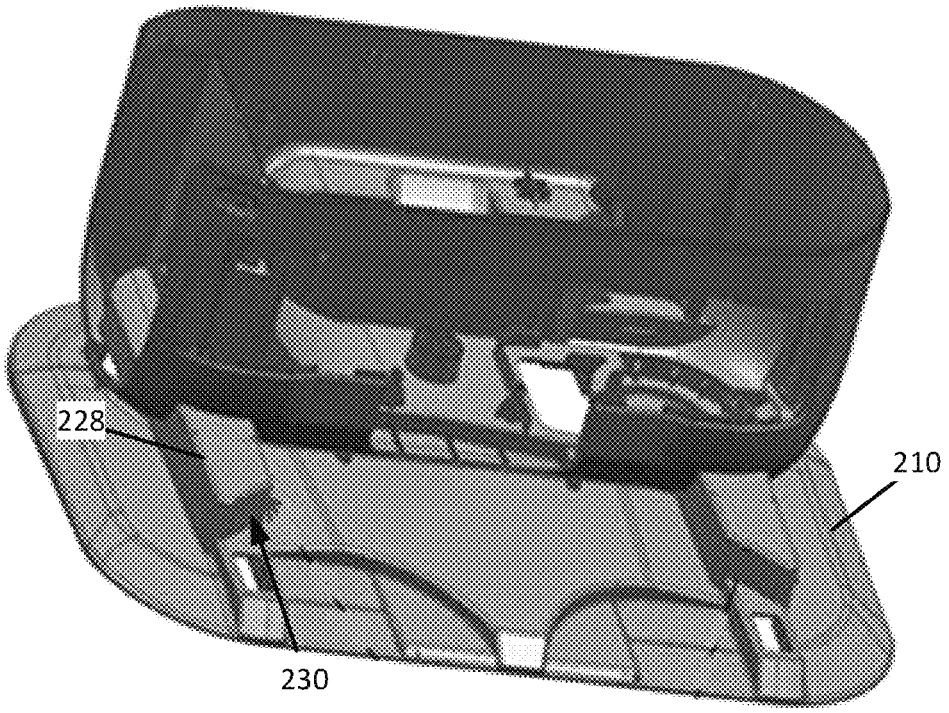
FIG. 2B shows perspective view of a portion of an example of a docking station, consistent with embodiments of the present disclosure.

In some instances, and as shown, for example in FIG. 2B, the support 210 may define one or more stops 228. The one or more stops 228 may be configured to engage a portion of the robotic vacuum cleaner 202 when the robotic vacuum cleaner 202 is docking with the docking station 200. As such the one or more stops 228 may generally be described as being configured to prevent further movement of the robotic vacuum cleaner 202 towards the docking station 200 when the robotic vacuum cleaner 202 is docking with the docking station 200. In some instances, the one or more stops 228 may define a guide surface 230 having a taper. For example, a plurality of stops 228 may be provided, each having a tapered guide surface 230 such that engagement of the robotic vacuum cleaner 202 with the guide surfaces 230 urges the robotic vacuum cleaner 202 towards an aligned orientation. In these instances, the stops 228 may generally be referred to as guides.

Figure 3:
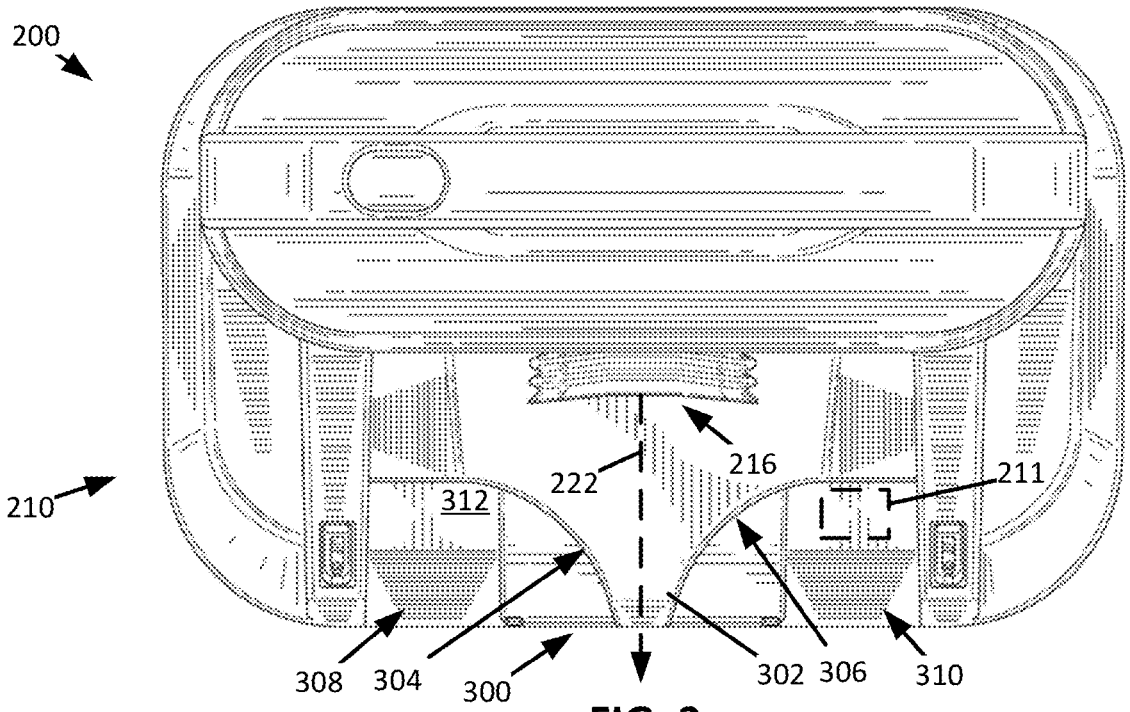
FIG. 3 shows a top view of the docking station of FIG. 2, consistent with embodiments of the present disclosure.
Figure 4:
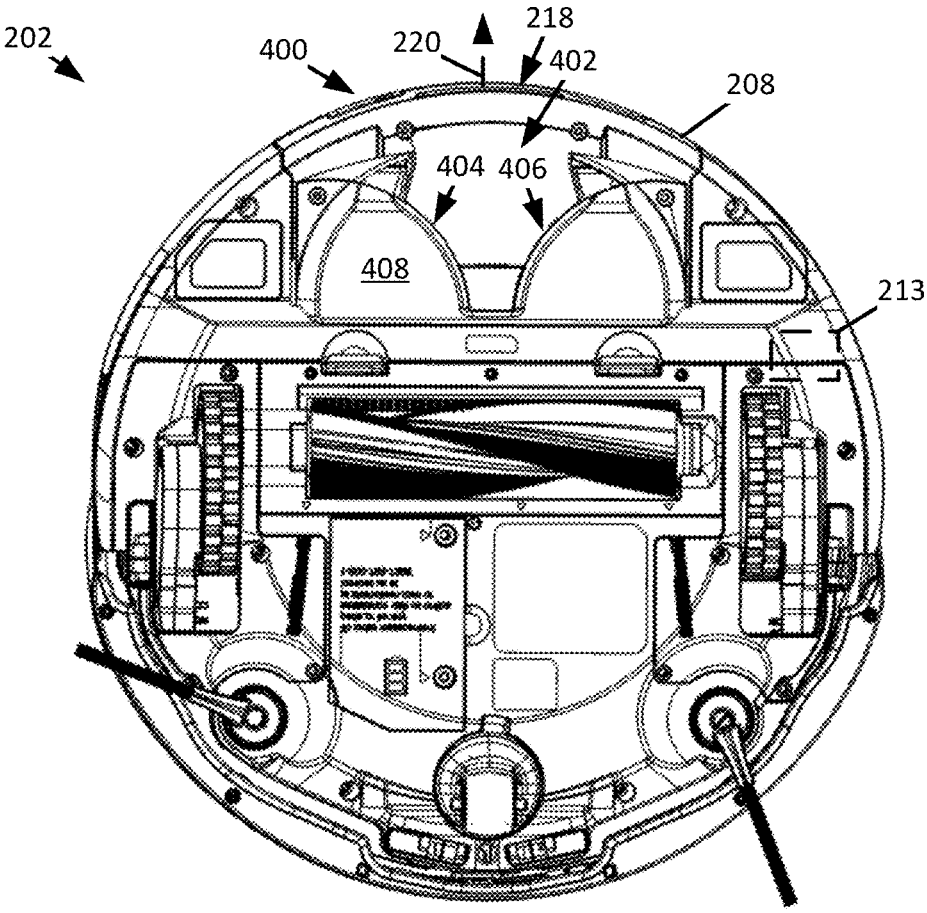
FIG. 4 shows a bottom view of the robotic cleaner of FIG. 2, consistent with embodiments of the present disclosure.

FIG. 3 shows a top view of the docking station 200 and FIG. 4 shows a bottom view of the robotic vacuum cleaner 202. As shown, the support 210 can define a docking station alignment feature 300 configured to engage a corresponding robotic vacuum cleaner alignment feature 400. The docking station alignment feature 300 can include an alignment protrusion 302 and the robotic vacuum cleaner alignment feature 400 defines an alignment receptacle 402 configured to receive the alignment protrusion 302. For example, and as shown, the alignment receptacle 402, is defined in the robotic vacuum cleaner dust cup 208.

The alignment protrusion 302 can include first and second protrusion sidewalls 304 and 306. The first and second protrusion sidewalls 304 and 306 can be configured to converge, with increasing distance from the docking station suction inlet 216, towards the suction inlet central axis 222. In other words, the alignment protrusion 302 can generally be described as having a tapered profile that tapers in a direction away from the docking station suction inlet 216. For example, and as shown, the first and second protrusion sidewalls 304 and 306 can include arcuate portions having opposing concavities that approach the suction inlet central axis 222.

The alignment receptacle 402 can include first and second receptacle sidewalls 404 and 406. The first and second receptacle sidewalls 404 and 406 can be configured to diverge in a direction away from the outlet port central axis 220 with increasing distance from a central portion of the robotic vacuum cleaner 202. In other words, the first and second receptacle sidewalls 404 and 406 can generally be described as diverging from the outlet port central axis 220 as the first and second sidewalls 404 and 406 approach the outlet port 218. As such, the alignment receptacle 402 can generally be described as having a tapered profile that tapers in a direction away from the outlet port 218 and towards a central portion of the robotic vacuum cleaner 202. For example, and as shown, the first and second receptacle sidewalls 404 and 406 can include arcuate portions that extend away from the outlet port central axis 220.

In operation, when the alignment receptacle 402 receives at least a portion of the alignment protrusion 302, the first and second receptacle sidewalls 404 and 406 may engage the first and second protrusion sidewalls 304 and 306. For example, if the robotic vacuum cleaner 202 is misaligned with the docking station 200, the engagement between the first and second receptacle sidewalls 404 and 406 and the first and second protrusion sidewalls 304 and 306 may urge the robotic vacuum cleaner 202 towards alignment (e.g., towards an orientation having a misalignment within an acceptable misalignment range). In other words, the alignment protrusion 302 is configured to urge the robotic vacuum cleaner 202 towards an orientation in which the robotic vacuum cleaner 202 fluidly couples with the docking station suction inlet 216. As such, the inter-engagement between the alignment receptacle 402 and the alignment protrusion 302 urges the robotic vacuum cleaner 202 towards an orientation in which the robotic vacuum cleaner 202 fluidly couples to the docking station 200.

As shown, the first and second protrusion sidewalls 304 and 306 can define first and second recessed regions 308 and 310 within a portion of the support 210. The first and second recessed regions 308 and 310 can be configured to receive at least a portion of the robotic vacuum cleaner dust cup 208. When received within the first and second recessed regions 308 and 310, a dust cup bottom surface 408 of the robotic vacuum cleaner dust cup 208 can be vertically spaced apart from a support top surface 312 of the support 210. As such, the dust cup bottom surface 408 does not slideably engage the support top surface 312. Such a configuration, may allow for improved maneuverability of the robotic vacuum cleaner 202 when docking with the docking station 200.

Figure 4A:
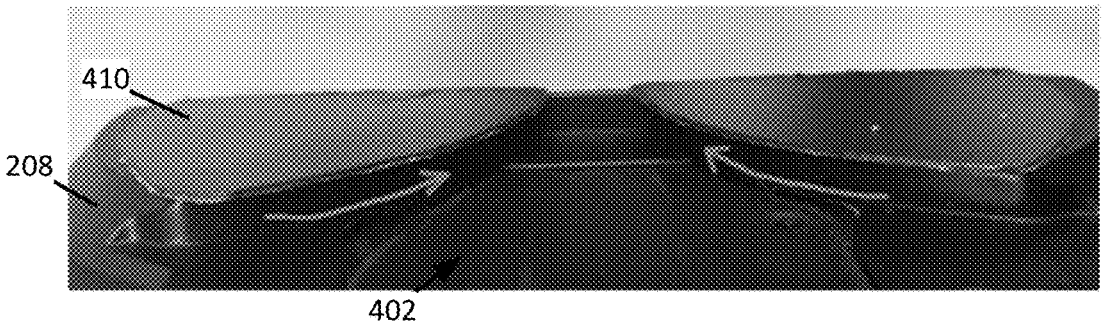
FIG. 4A shows a perspective bottom view of a portion of an example of a robotic cleaner dust cup, consistent with embodiments of the present disclosure.
Figure 4B:
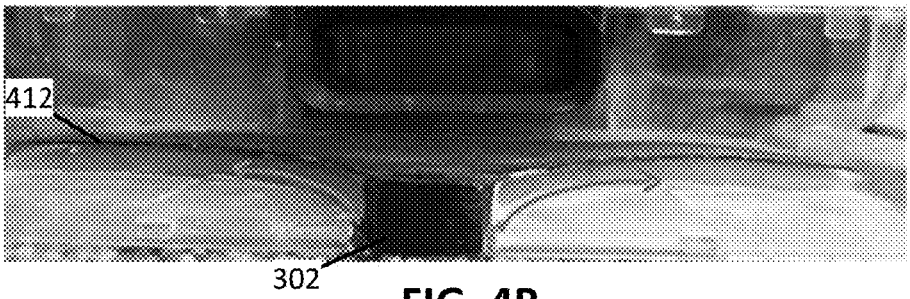
FIG. 4B shows a perspective view of a portion of a docking station, consistent with embodiments of the present disclosure.

In some instances, and as shown, for example, in FIG. 4A, the robotic vacuum cleaner dust cup 208 may include one or more receptacle fins 410 extending over at least a portion of and/or at least partially within the alignment receptacle 402. The one or more receptacle fins 410 can be configured to engage a portion of the alignment protrusion 302 such that further movement of the robotic vacuum cleaner 202 when docking is prevented. As such, the inter-engagement between the one or more receptacle fins 410 and the alignment protrusion 302 may generally be described as positioning the robotic vacuum cleaner 202 at a predetermined docking distance from the docking station 200. Additionally, or alternatively, in some instances, and as shown, for example, in FIG. 4B, the alignment protrusion 302 can include a protrusion fin 412 extending therefrom that is configured to engage at least a portion of the alignment receptacle 402. The inter-engagement between the protrusion fin 412 and the alignment receptacle 402 may generally be described as positioning the robotic vacuum cleaner 202 at a predetermined docking distance from the docking station 200.

Figure 5:
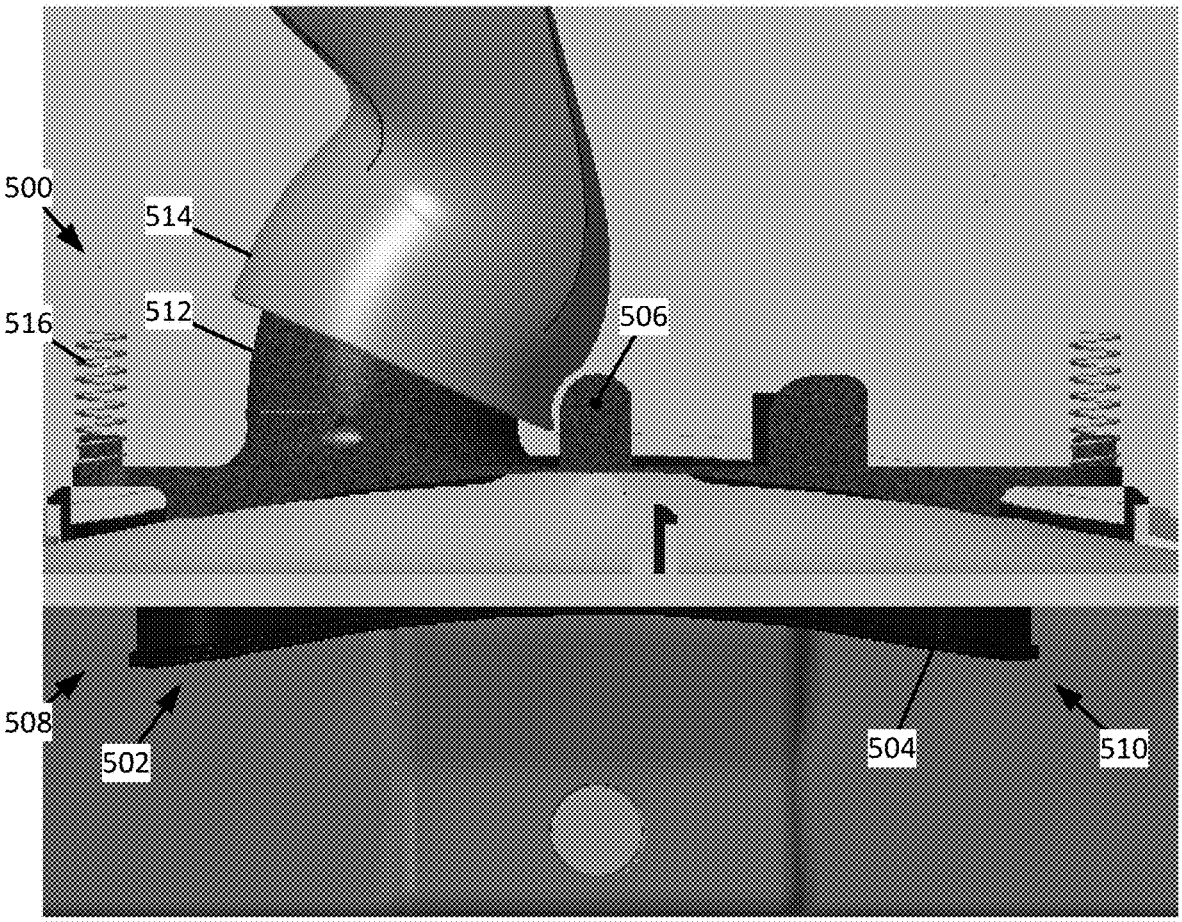
FIG. 5 shows a top view of an example of an adjustable boot capable of being used with the docking station of FIG. 2, consistent with embodiments of the present disclosure.

FIG. 5 shows a top view of a boot 500. The boot 500 may be used in the docking station 200 (e.g., in addition to or in the alternative to the boot 224). As shown, the boot 500 may include a contoured surface 502 having a shape that generally corresponds to, for example, a shape of the portion of the robotic vacuum cleaner 202 that the boot 500 is configured to engage (e.g., contact). For example, and as shown, the contoured surface 502 may have an arcuate shape. A seal 504 can be configured to extend along the contoured surface 502 such that the seal 504 is configured to engage (e.g., contact) at least a portion of the robotic vacuum cleaner 202.

As shown, the boot 500 can be configured to pivot about a pivot point 506. The pivot point 506 can be centered between distal ends 508 and 510 of the boot 500. As such, when the robotic vacuum cleaner 202 engages the adjustable boot 500 in a misaligned orientation, the boot 500 is caused to pivot about the pivot point 506 in a direction that causes the boot 500 to engage the robotic vacuum cleaner 202.

As also shown, the boot 500 may include an exhaust duct 512 that extends from the boot 500 and within the docking station 200. An evacuation duct 514 that extends within the docking station 200 fluidly couples the exhaust duct 512 to the docking station dust cup 204. The evacuation duct 514 defines the docking station suction inlet 216. The exhaust duct 512 can be configured to slideably engage the evacuation duct 514. As such, as the boot 500 pivots, the exhaust duct 512 slides relative to (e.g., slides within) the evacuation duct 514.

The boot 500 can be biased towards a neutral position by one or more biasing mechanisms 516 (e.g., compression springs, torsion springs, elastomeric materials, and/or any other biasing mechanism). The neutral position may correspond to a position of the boot 500, wherein a pivot angle of the boot 500 measures substantially the same when measured from each distal end 508 and 510. The biasing mechanisms 516 may also be configured limit pivotal rotation of the boot 500. For example, the biasing mechanisms 516 may limit the pivotal movement of the boot 500 to about 10° in at least one direction of rotation.

Figure 6:
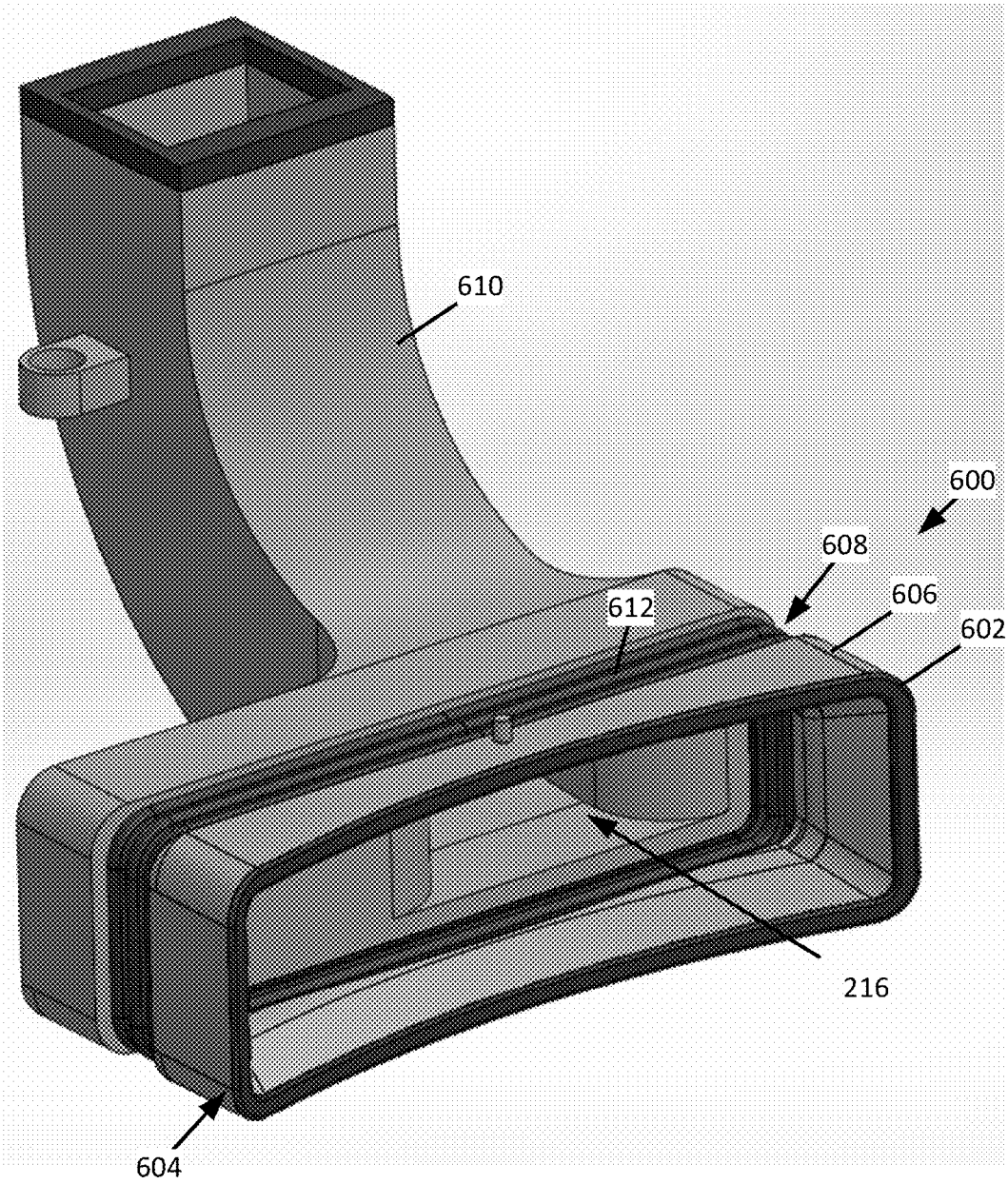
FIG. 6 shows a perspective view of another example of an adjustable boot capable of being used with the docking station of FIG. 2, consistent with embodiments of the present disclosure.

FIG. 6 shows a perspective view of a boot 600. The boot 600 may be used in the docking station 200 (e.g., in addition to or in the alternative to the boot 224). As shown, the boot 600 includes a seal 602 extending around a peripheral edge 604 of a shroud 606 and a resiliently deformable sleeve 608 extending from the shroud 606. The seal 602 is configured to engage (e.g., contact) the robotic vacuum cleaner 202. The resiliently deformable sleeve 608 is configured to fluidly couple the shroud 606 to an evacuation duct 610 of the docking station 200, the evacuation duct 610 defining the docking station suction inlet 216.

As shown, the resiliently deformable sleeve 608 defines a plurality of ribs 612. The ribs 612 are configured to compress and/or expand in response to a robotic cleaner engaging the seal 602. As such, the shroud 606 can be configured to move such that the robotic vacuum cleaner 202 can fluidly couple to the docking station suction inlet 216. For example, when the robotic vacuum cleaner 202 engages the boot 600 in a misaligned orientation, a portion of the ribs 612 may compress and a portion of the ribs 612 may expand such that the shroud 606 moves allowing the seal 602 to engage at least a portion the robotic vacuum cleaner 202.

Figure 8:
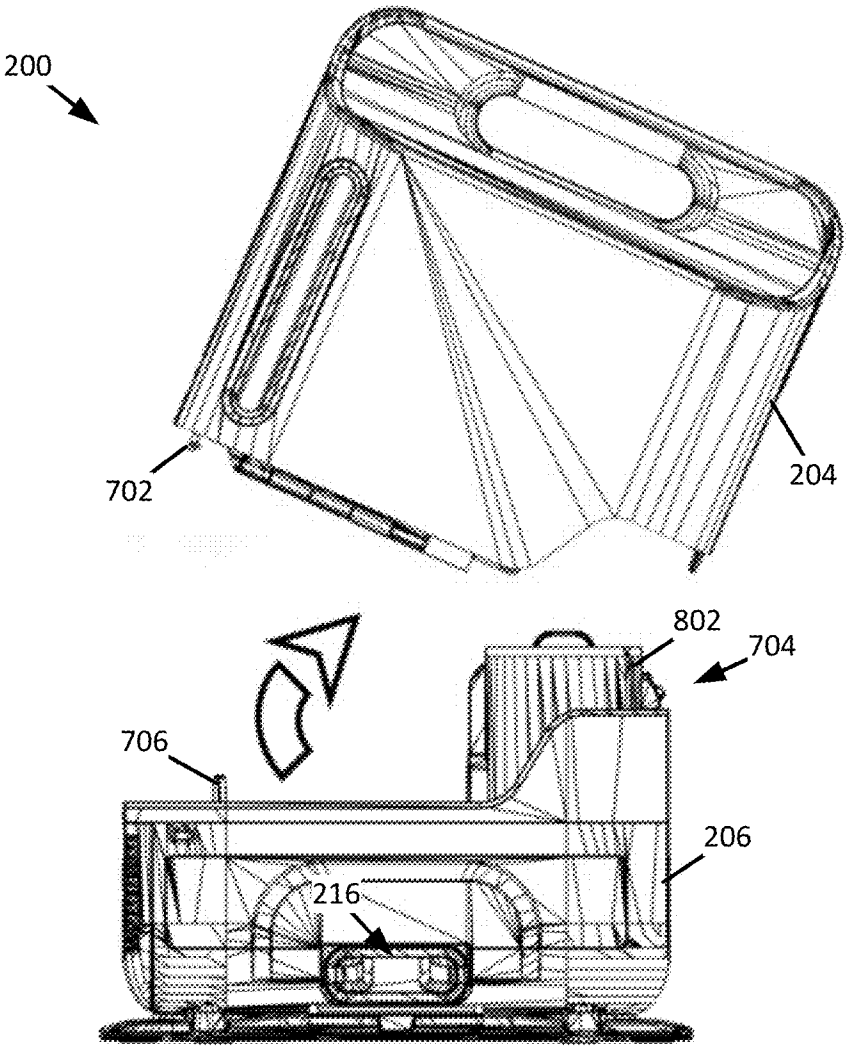
FIG. 8 shows a front view of the docking station of FIG. 2 having a docking station dust cup being removed in response to a pivotal motion, consistent with embodiments of the present disclosure.
Figure 7:
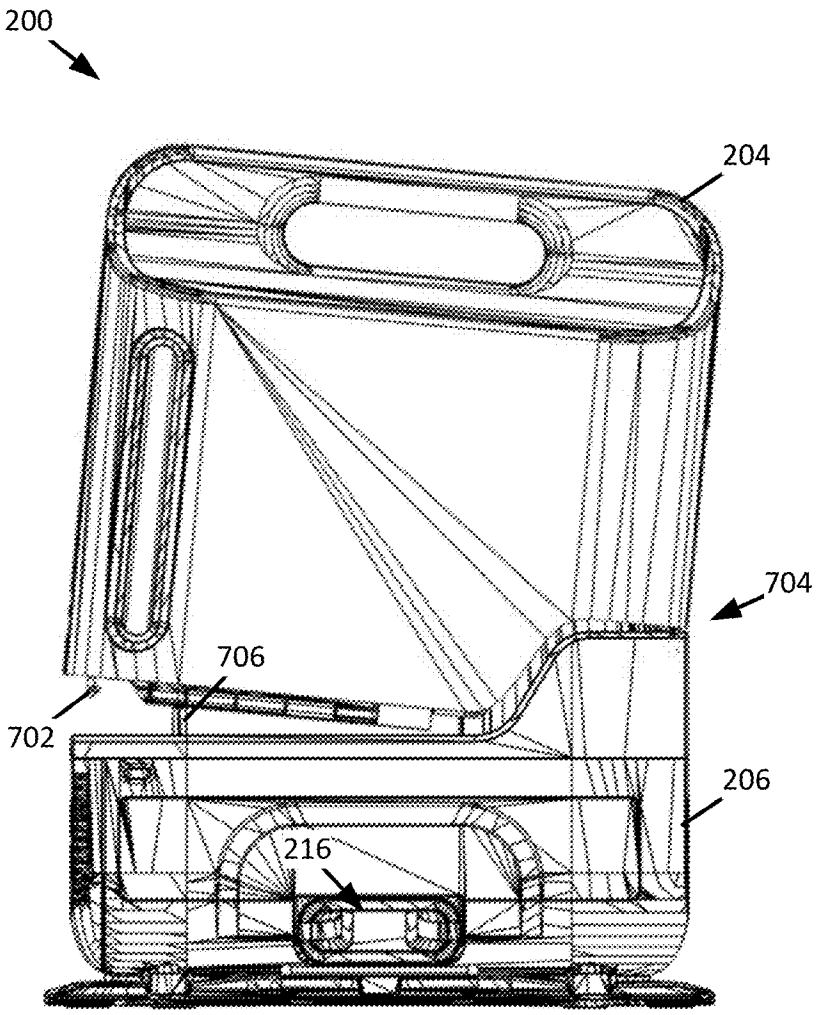
FIG. 7 shows a front view of the docking station of FIG. 2 having a docking station dust cup in a removal position, consistent with embodiments of the present disclosure.

FIGS. 7 and 8 show the docking station 200, wherein the docking station dust cup 204 is being removed from the base 206 such that, for example, debris collected in the docking station dust cup 204 can be emptied therefrom. As shown, when removing the docking station dust cup 204 from the base 206, the docking station dust cup 204 is configured to be pivoted relative to the base 206. In other words, the docking station dust cup 204 is configured to be removed from the base 206 in response to a pivotal movement of the docking station dust cup 204 relative to the base 206.

The docking station dust cup 204 includes a latch 702 configured to releasably engage a portion of the base 206 such that the latch 702 substantially prevents pivotal movement of the docking station dust cup 204. As shown, the latch 702 is horizontally spaced apart from a dust cup pivot point 704 of the docking station dust cup 204. For example, the latch 702 and the dust cup pivot point 704 can be disposed on opposing sides of the docking station suction inlet 216.

At least a portion of the docking station dust cup 204 can be urged in a direction away from the base 206 in response to the latch 702 being actuated. For example, the base 206 may include a plunger 706 configured to be urged into engagement with the docking station dust cup 204. When the latch 702 is actuated such that the latch 702 disengages the base 206, the plunger 706 urges the docking station dust cup 204 to pivot about the dust cup pivot point 704 in a direction away from the base 206. As such, when the latch 702 disengages the base 206, the plunger 706 causes the docking station dust cup 204 to transition from an in-use position (e.g., as shown in FIG. 2) to a removal position (e.g., as shown in FIG. 7). When in the removal position, the docking station dust cup 204 can be removed from the base 206 (e.g., as shown in FIG. 8).

As shown in FIG. 8, when the docking station dust cup 204 is removed from the base 206, a premotor filter 802 is exposed. As such, the premotor filter 802 can be replaced and/or cleaned when the docking station dust cup 204 is removed from the base 206. In some instances, the base 206 may include a sensor configured to detect the presence of the premotor filter 802 and prevent the docking station from being used without the premotor filter 802. Additionally, or alternatively, when the premotor filter 802 is received within the base 206, the premotor filter 802 can actuate a coupling feature that allows the docking station dust cup 204 to be recoupled to the base 206. As such, in some instances, the docking station 200 may generally be described as being configured to prevent use without the premotor filter 802 being installed.

Figures 9, 9A, 9B:
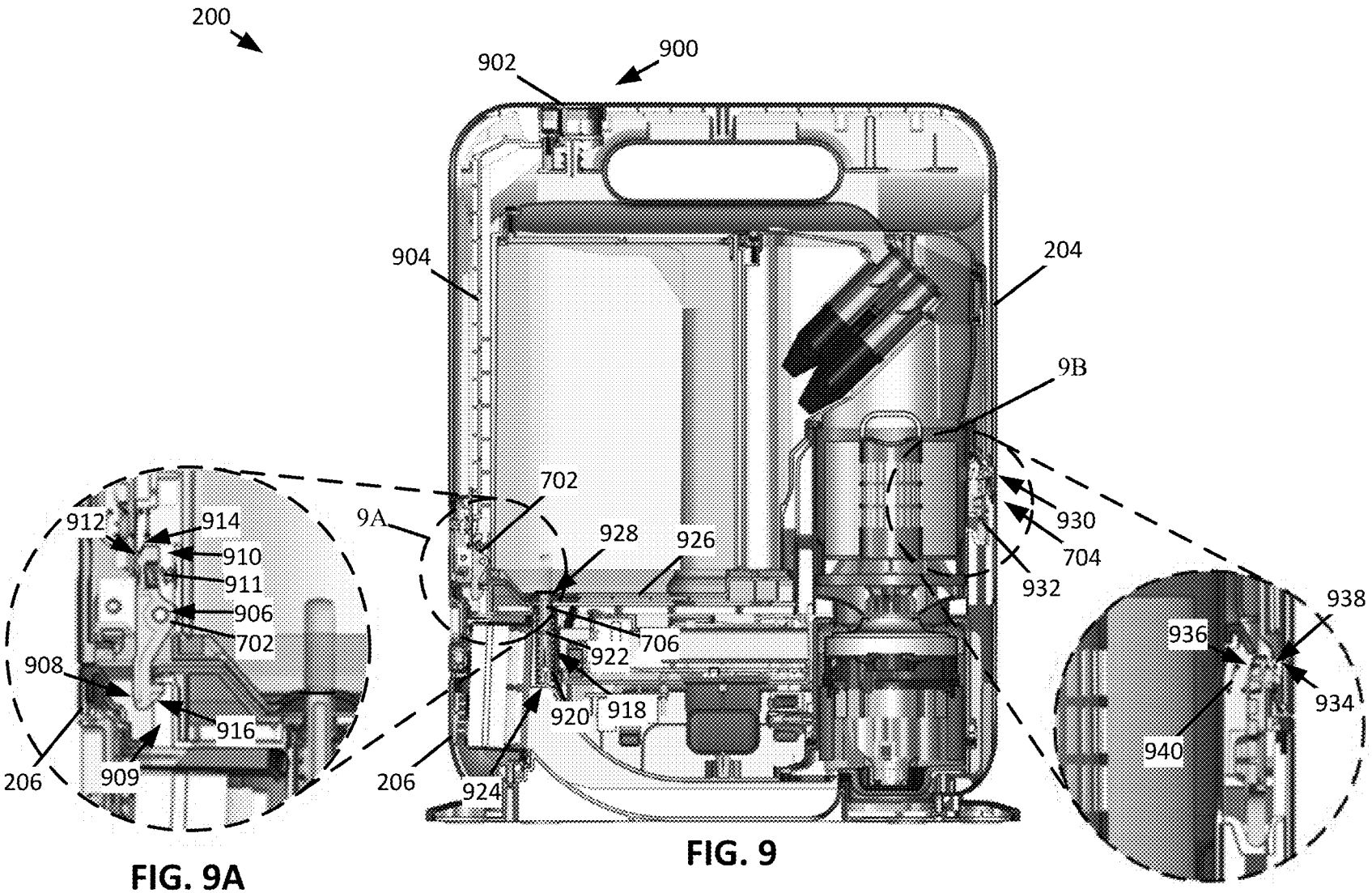
FIG. 9 shows a cross-sectional view of the docking station of FIG. 2 taken along the line IX-IX of FIG. 2, consistent with embodiments of the present disclosure.
FIG. 9A shows a magnified view of the docking station of FIG. 9 corresponding to region 9A, consistent with embodiments of the present disclosure.
FIG. 9B shows a magnified view of the docking station of FIG. 9 corresponding to region 9B, consistent with embodiments of the present disclosure.

FIG. 9 shows a cross-sectional view of the docking station 200 taken along the line IX-IX of FIG. 2, wherein FIGS. 9A and 9B are magnified views corresponding to regions 9A and 9B of FIG. 9, respectively. As shown, the docking station dust cup 204 includes a release system 900 configured to actuate the latch 702. The release system 900 includes an actuator 902 (e.g., a depressible button) configured to urge a push bar 904 between a first push bar position and a second push bar position. When the push bar 904 is urged between the first and second push bar positions, the latch 702 is urged between an engagement (or retaining) position and a disengagement (or release) position. When the latch 702 is in the retaining position, pivotal movement of the docking station dust cup 204 is substantially prevented and, when the latch 702 is in the release position, the docking station dust cup 204 is capable of pivotal movement.

As shown, the latch 702 is pivotally coupled to the docking station dust cup 204 at a latch pivot point 906 such that a latch retaining end 908 and an actuation end 910 of the latch 702 are disposed on opposing sides of the latch pivot point 906. The latch retaining end 908 of the latch 702 is configured to releasably engage the base 206 of the docking station 200. For example, and as shown, at least a portion of the latch retaining end 908 can be received within a retaining cavity 909 defined in the base 206. In some instances, a latch biasing mechanism 911 (e.g., a compression spring, a torsion spring, an elastomeric material, and/or any other biasing mechanism) may urge the latch retaining end 908 towards the retaining cavity 909. As shown, the latch biasing mechanism 911 engages the latch 702 proximate the actuation end 910 such that the latch biasing mechanism 911 exerts a force on the latch 702 that causes the latch retaining end 908 to be urged towards the retaining cavity 909. As such, the latch 702 may generally be described as being configured to be urged towards the retaining position.

The actuation end 910 is configured to engage the push bar 904 such that, when the push bar 904 transitions between the first and second push bar positions, the latch 702 is caused to pivot about the latch pivot point 906. The pivotal movement of the latch 702 causes the latch retaining end 908 to move into and out of engagement with the base 206. The actuation end 910 of the latch 702 can include an actuation taper 912. The actuation taper 912 can be configured to encourage the latch 702 to pivot in response to movement of the push bar 904. In some instances, the push bar 904 may include a corresponding push bar taper 914 configured to engage the actuation taper 912 of the latch 702.

The latch retaining end 908 of the latch 702 may include a coupling taper 916. The coupling taper 916 can be configured to engage the base 206 of the docking station 200 when the docking station dust cup 204 is being recoupled to the base 206. In other words, the coupling taper 916 can be configured to encourage the latch 702 to pivot when the docking station dust cup 204 is being recoupled to the base 206 such that at least a portion of the latch retaining end 908 can be received within the retaining cavity 909.

When the latch retaining end 908 of the latch 702 is urged out of engagement with the retaining cavity 909, the plunger 706 can urge the docking station dust cup 204 in a direction away from the base 206. As shown, the plunger 706 is slideably disposed within a plunger cavity 918 defined in the base 206. A plunger biasing mechanism 920 (e.g., a compression spring, a torsion spring, an elastomeric material, and/or any other biasing mechanism) may be disposed within the plunger cavity 918 and be configured to urge the plunger 706 in a direction of the docking station dust cup 204. For example, and as shown, the plunger biasing mechanism 920 may be a compression spring that extends around at least a portion of the plunger 706 at a location between a flange 922 of the plunger 706 and a distal end 924 of the plunger cavity 918. The flange 922 may also be configured to engage a portion of the base 206 to retain at least a portion of the plunger 706 within the plunger cavity 918.

When the docking station dust cup 204 is coupled to the base 206, a portion of the plunger 706 may extend from the plunger cavity 918 and into engagement with the docking station dust cup 204. For example, the plunger 706 may engage a portion of an openable door 926 of the docking station dust cup 204. The openable door 926 may define a plunger receptacle 928 for receiving at least a portion of the plunger 706 that extends from the plunger cavity 918 when the docking station dust cup 204 is coupled to the base 206.

The docking station dust cup 204 can include a pivot catch 930 configured to engage a corresponding pivot lever 932 of the base 206. The pivot catch 930 defines a location of the dust cup pivot point 704 of the docking station dust cup 204 relative to the base 206. As such, the pivot catch 930 and the latch 702 may generally be described as being located proximate opposing sides of the base 206.

As shown, the pivot catch 930 defines a catch cavity 934 that extends at least partially through a sidewall of the docking station dust cup 204. The catch cavity 934 is configured to engage at least a portion of the pivot lever 932. For example, and as shown, the pivot lever 932 includes a lever retaining end 936, wherein at least a portion of the lever retaining end 936 extends into the catch cavity 934. When the latch 702 is in the retaining position, the engagement between the lever retaining end 936 of the pivot lever 932 and the catch cavity 934 of the pivot catch 930 result in the docking station dust cup 204 being coupled to the base 206. In other words, the latch 702 and the pivot catch 930 may generally be described as cooperating to couple the docking station dust cup 204 to the base 206.

When the latch 702 is urged to the release position, at least a portion of the lever retaining end 936 of the pivot lever 932 may remain in engagement with the catch cavity 934. The engagement between the lever retaining end 936 and the catch cavity 934 encourage further pivoting of the docking station dust cup 204 after the plunger 706 urges the docking station dust cup 204 to the removal position. In other words, when removing the docking station dust cup 204 from the base 206, the engagement between at least a portion of the lever retaining end 936 and the catch cavity 934 may encourage further pivotal movement of the docking station dust cup 204 about the dust cup pivot point 704 before removing the docking station dust cup 204 from the base 206.

The lever retaining end 936 of the pivot lever 932 can define a recoupling taper 938. The recoupling taper 938 is configured to engage a portion of the docking station dust cup 204 when the docking station dust cup 204 is being recoupled to the base 206. The engagement between the docking station dust cup 204 and the recoupling taper 938 urges the pivot lever 932 in a direction away from the catch cavity 934. When the catch cavity 934 aligns with at least a portion of the lever retaining end 936, at least a portion of the lever retaining end 936 is urged into the catch cavity 934. A lever biasing mechanism 940 (e.g., a compression spring, a torsion spring, an elastomeric material, and/or any other biasing mechanism) can be configured to urge the lever retaining end 936 in a direction of the catch cavity 934 such that at least a portion of the lever retaining end 936 is received within the catch cavity 934. For example, the pivot lever 932 can be pivotally coupled to the base 206 such that the biasing mechanism 940 urges the pivot lever 932 to pivot towards the catch cavity 934.

Figures 10, 10A, 10B:
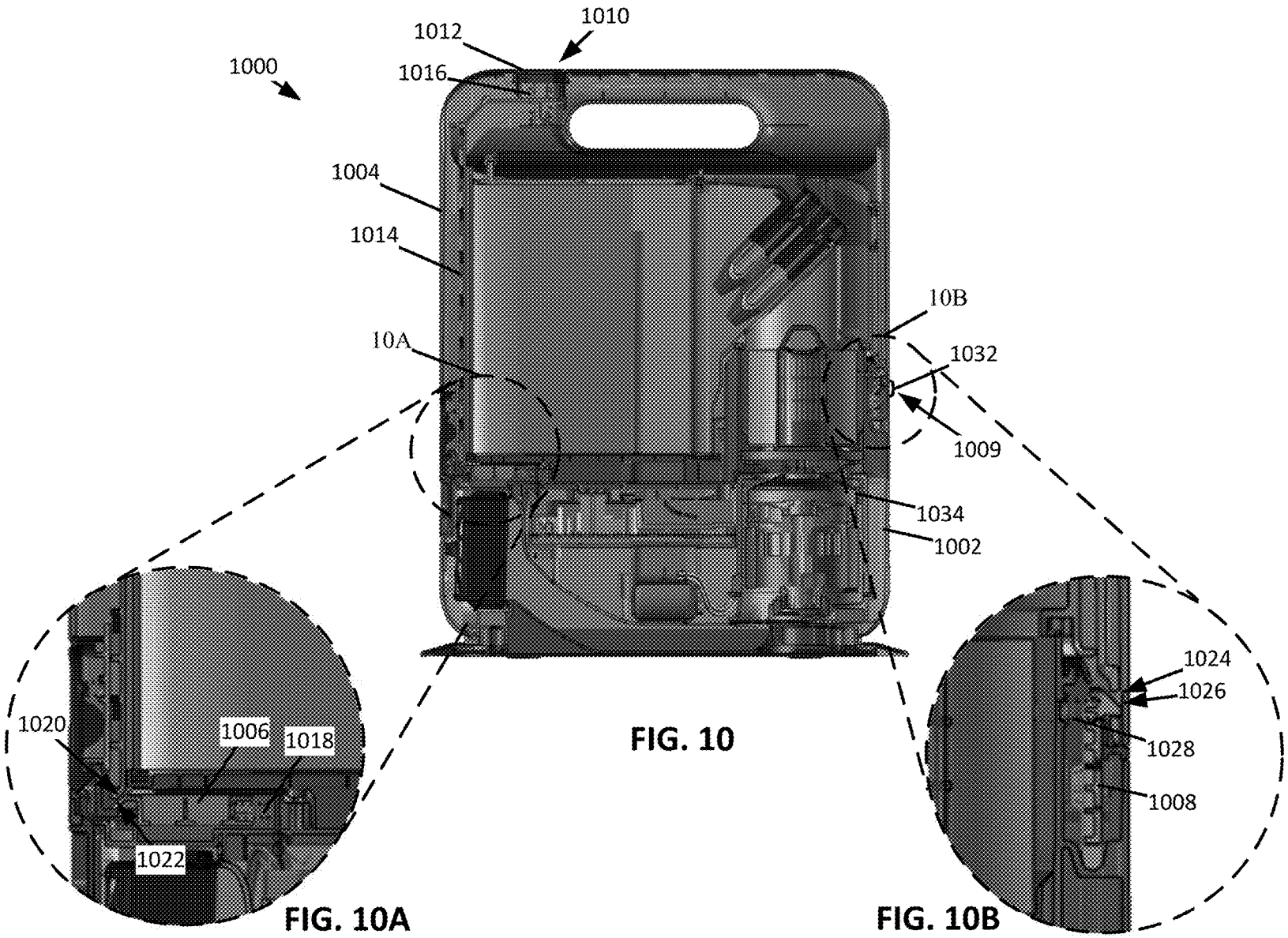
FIG. 10 shows a cross-sectional view of a docking station, consistent with embodiments of the present disclosure.
FIG. 10A shows a magnified view corresponding to region 10A of FIG. 10, consistent with embodiments of the present disclosure.
FIG. 10B shows a magnified view corresponding to region 10B of FIG. 10, consistent with embodiments of the present disclosure.

FIG. 10 shows a cross-sectional view of a docking station 1000, which may be an example of the docking station 100 of FIG. 1, wherein FIGS. 10A and 10B are magnified views corresponding to regions 10A and 10B of FIG. 10, respectively. As shown, the docking station 1000 includes a base 1002 and a docking station dust cup 1004 pivotally coupled to the base 1002. The base includes a latch 1006 and a pivot lever 1008 configured to releasably engage the docking station dust cup 1004 such that the docking station dust cup 1004 can generally be described as being configured to be decoupled from the base 1002 at least partially in response to a pivotal movement of the docking station dust cup 1004 and recoupled to the base 1002 in response to a substantially vertical movement. Additionally, or alternatively, the docking station dust cup 1004 may be recoupled to the base 1002 at least partially in response to a pivotal movement.

The latch 1006 is slideably coupled to the base 1002 such that the latch 1006 can transition between a retaining position and a release position in response to actuation of a release system 1010. When in the retaining position, the latch 1006 substantially prevents pivotal movement of the docking station dust cup 1004. For example, the latch 1006 can be configured to engage (e.g., contact) the docking station dust cup 1004 such that pivotal movement of the docking station dust cup 1004 is substantially prevented. When the latch 1006 is in the release position, the docking station dust cup 1004 can be pivoted. For example, the latch 1006 can be configured to disengage the docking station dust cup 1004 such that the docking station dust cup 1004 can pivot.

As shown, the release system 1010 includes an actuator 1012 (e.g., a depressible button) and a push bar 1014. The actuator 1012 can be biased towards an unactuated state by an actuator biasing mechanism 1016 (e.g., a compression spring, a torsion springs, an elastomeric material, and/or any other biasing mechanism). The push bar 1014 is configured to engage the latch 1006. The latch 1006 is configured to transition between the retaining position and the release position in response to movement of the push bar 1014. The latch 1006 can be urged towards the retaining position using a latch biasing mechanism 1018 (e.g., a compression spring, a torsion spring, an elastomeric material, and/or any other biasing mechanism).

The push bar 1014 includes a latch engaging surface 1020 configured to engage (e.g., contact) a release surface 1022 of the latch 1006 such that movement of the push bar 1014 urges the latch 1006 towards the release position. For example, and as shown, the release surface 1022 can extend in a direction transverse to a longitudinal axis of the push bar 1014. In other words, the release surface 1022 may define a taper.

As shown, the pivot lever 1008 is coupled to the base 1002 at a location proximate a pivot point 1009 of the docking station dust cup 1004. The docking station dust cup 1004 can include a catch cavity 1024 that extends at least partially through a portion of the docking station dust cup 1004. The catch cavity 1024 is configured to receive at least a portion of the pivot lever 1008 when the docking station dust cup 1004 is coupled to the base 1002.

When the latch 1006 is in the release position, the docking station dust cup 1004 can be pivoted until the docking station dust cup 1004 comes out of engagement with the pivot lever 1008. For example, the pivotal movement of the docking station dust cup 1004 can result in the pivot lever 1008 moving out of the catch cavity 1024, allowing the docking station dust cup 1004 to be removed from the base 1002. As such, the docking station dust cup 1004 can generally be described as being decoupled from the base 1002 at least partially in response to a pivotal movement of the docking station dust cup 1004.

As shown, the pivot lever 1008 is moveably coupled (e.g., pivotally coupled) to the base 1002 such that when the docking station dust cup 1004 is recoupled to the base 1002, the pivot lever 1008 is urged towards a center of the base 1002. The pivot lever 1008 includes a dust cup engaging surface 1026. The engagement between the dust cup engaging surface 1026 and the docking station dust cup 1004 urges the pivot lever 1008 towards the center of the base 1002. When the pivot lever 1008 aligns with the catch cavity 1024, a pivot lever biasing mechanism 1028 (e.g., a compression spring, a torsion spring, an elastomeric material, and/or any other biasing mechanism) urges the pivot lever 1008 in a direction away from the center of the base 1002 and into the catch cavity 1024.

When recoupling the docking station dust cup 1004 to the base 1002, the docking station dust cup 1004 also urges the latch 1006 towards the release position in response to engaging the release surface 1022 of the latch 1006. The latch biasing mechanism 1018 urges the latch 1006 towards the retaining position such that, when the docking station dust cup 1004 is in the coupled position, the latch 1006 is urged into the retaining position.

In some instances, the docking station dust cup 1004 and/or the base 1002 may include a relief region 1032 proximate the pivot point 1009. The relief region 1032 can be configured such that, when the docking station dust cup 1004 is pivoted, the base 1002 and docking station dust cup 1004 are prevented from engaging each other in such a way that pivotal movement about the pivot point 1009 is prevented. The relief region 1032 may include, for example, a chamfered portion, a filleted portion, and/or the like formed in one or more of the base 1002 and/or the docking station dust cup 1004 at a location proximate the pivot point 1009. Additionally, or alternatively, one or more biasing mechanisms (e.g., compression springs, torsion springs, elastomeric materials, and/or any other biasing mechanism) may be disposed between at least a portion of the base 1002 and the docking station dust cup 1004 such that the docking station dust cup 1004 is biased in a direction away from the base 1002. As such, when the actuator 1012 is actuated, the docking station dust cup 1004 is urged in a direction away from the base 1002 such that the docking station dust cup 1004 is separated from the base 1002 by a predetermined distance. Such a configuration may prevent the docking station dust cup 1004 and the base 1002 from engaging (e.g., contacting) each other in such a way that pivotal movement is substantially prevented. In some instances, a plurality of biasing mechanisms can be used, wherein one of the biasing mechanisms is configured to urge the docking station dust cup 1004 away from the base 1002 a greater distance than the other.

Additionally, or alternatively, the docking station dust cup 1004 may be configured to be decoupled and/or recoupled to the base 1002 in response to pivoting about a vertical axis extending through a midpoint of a suction motor 1034. In some instances, the docking station dust cup 1004 can be configured to be decoupled and/or recoupled to the base 1002 in response to pivoting about an axis extending substantially parallel to a horizontal longitudinal axis of the docking station 1000. Additionally, or alternatively, the docking station dust cup 1004 can be configured to be decoupled and/or recoupled to the base 1002 in response to a sliding movement of the docking station dust cup 1004 in a direction substantially parallel to the horizontal longitudinal axis of the docking station 1000.

Figure 11:
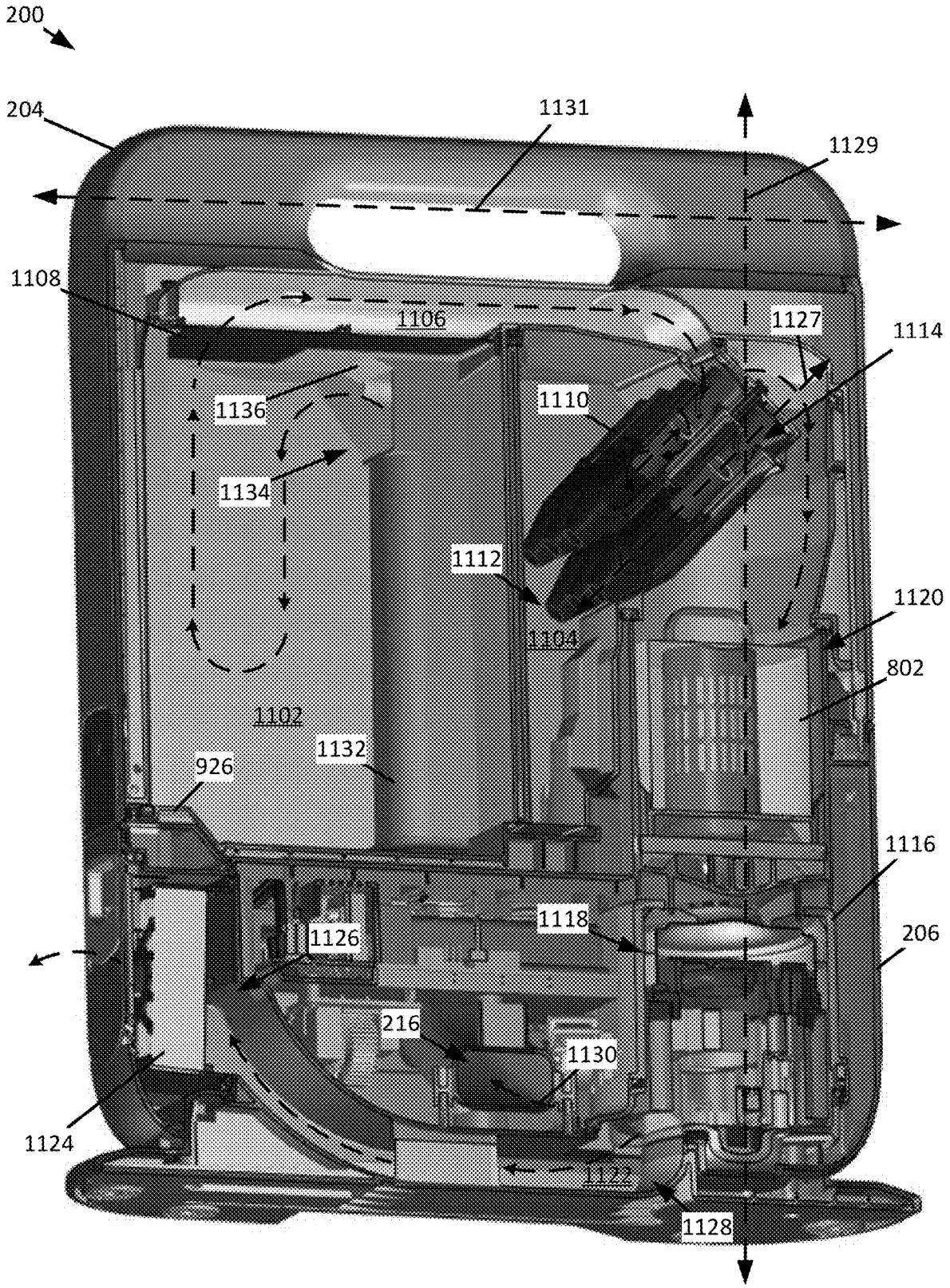
FIG. 11 shows a perspective cross-sectional view of an example of the docking station of FIG. 2 taken along the line IX-IX of FIG. 2 having a filter therein, wherein the filter is a filter medium, consistent with embodiments of the present disclosure.

FIG. 11 shows a cross-sectional perspective view of the docking station 200 taken along the line IX-IX of FIG. 2. As shown, the docking station dust cup 204 includes a first debris collection chamber 1102 and a second debris collection chamber 1104. A plenum 1106 is fluidly coupled to the first debris collection chamber 1102 and the second debris collection chamber 1104. As such, the first debris collection chamber 1102 may generally be described as being fluidly coupled to the second debris collection chamber 1104. At least a portion of the plenum 1106 is defined by at least a portion of a filter 1108 (e.g., a filter medium such as mesh screen and/or a cyclonic separator). As such, the filter 1108 may generally be described as being fluidly coupled to the first debris collection chamber 1102 and the second debris collection chamber 1104. At least a portion of the filter 1108 can extend over and/or within at least a portion of the first debris collection chamber 1102 such that air entering the plenum 1106 passes through the filter 1108. For example, and as shown, the filter 1108 is a filter medium such as a mesh screen that extends over at least a portion of the debris collection chamber 1102.

Each of the first and second debris collection chambers 1102 and 1104 can be defined by one or more sidewalls. The openable door 926 can be configured to engage distal ends of the sidewalls defining the first and second debris collection chambers 1102 and 1104. As such, the openable door 926 may define at least a portion of each of the first and second debris collection chambers 1102 and 1104. In some instances, the openable door 926 may include a seal that is configured to extend along the interface between the openable door 926 and the one or more sidewalls defining the first and second debris collection chambers 1102 and 1104.

The docking station dust cup 204 can include a cyclonic separator 1110 (e.g., a fine debris cyclonic separator) configured to generate one or more cyclones (e.g., an array of cyclones) in response to air flowing therethrough. The cyclonic separator 1110 can be fluidly coupled to the plenum 1106 such that air exiting the plenum 1106 passes through the cyclonic separator 1110. The cyclonic separator 1110 includes a debris outlet 1112 fluidly coupled to the second debris collection chamber 1104 and an air outlet 1114 fluidly coupled to a suction motor 1116. The debris outlet 1112 is configured such that debris separated from air flowing through cyclonic separator 1110 is deposited in the second debris collection chamber 1104. An axis 1127 extending between the air outlet 1114 and the debris outlet 1112 of the cyclonic separator 1110 can extend transverse (e.g., at a non-perpendicular angle) to a vertical axis 1129 and a horizontal axis 1131 of the docking station 200. As such, the cyclonic separator 1110 may generally be described as being arranged transverse (e.g., at a non-perpendicular angle) to the vertical axis 1129 and the horizontal axis 1131 of the docking station 200.

The suction motor 1116 can be disposed within a suction motor cavity 1118 defined in the base 206 of the docking station 200. The premotor filter 802 may be disposed within a premotor filter cavity 1120 defined in the base 206 such that air entering the suction motor 1116 passes through the premotor filter 802 before entering the suction motor 1116. The suction motor 1116 may be fluidly coupled to an exhaust duct 1122 defined within the base 206 such that air exhausted from the suction motor 1116 can be exhausted to a surrounding environment.

The exhaust duct 1122 can be configured to reduce a quantity of noise generated by air being exhausted from the suction motor 1116. For example, the exhaust duct 1122 can have a cross-sectional area that measures greater than a cross-sectional area of an exhaust outlet of the suction motor 1116 such that a velocity of air exiting the suction motor 1116 is reduced. The exhaust duct 1122 may include a post-motor filter 1124. As shown, the post-motor filter 1124 is located at a distal end 1126 of the exhaust duct 1122 and the suction motor 1116 is located at a proximal end 1128 of the exhaust duct 1122, the distal end 1126 being opposite the proximal end 1128.

In operation, the suction motor 1116 causes air to be drawn into the docking station dust cup 204 according to a flow path 1130. As shown, the flow path 1130 extends through the docking station suction inlet 216 and into the first debris collection chamber 1102. In some instances, and as shown, the flow path 1130 can extend through an up-duct 1132 extending within the first debris collection chamber 1102. The up-duct 1132 can extend from the openable door 926 in a direction of the plenum 1106 (e.g., the filter 1108). For example, and as shown, the up-duct 1132 can extend from the openable door 926 to the plenum 1106 (e.g., the filter 1108).

The up-duct 1132 can define an up-duct air outlet 1134 that is spaced apart from the openable door 926. For example, the up-duct air outlet 1134 can be proximate the plenum 1106 (e.g., the filter 1108). A flow directer 1136 (e.g., a deflector) can extend from the up-duct air outlet 1134 and along at least a portion of the plenum 1106 (e.g., the filter 1108). The flow directer 1136 is configured to urge at least a portion of air flowing from the up-duct air outlet 1134 in a direction away from the plenum 1106 (e.g., the filter 1108) such that the flow path 1130 extends towards the openable door 926. The suction generated by the suction motor 1116 urges air deflected towards the openable door 926 in a direction of the plenum 1106 (e.g., the filter 1108) such that the flow path 1130 transitions from extending in a direction towards the openable door 926 to extending in a direction towards the plenum 1106 (e.g., the filter 1108). The change in flow direction of air flowing along the flow path 1130 may cause at least a portion of any debris entrained within the air to fall out of entrainment such that at least a portion of the entrained debris can be deposited within the first debris collection chamber 1102.

The flow path 1130 extends through the filter 1108 and into the plenum 1106. The filter 1108 can be configured to prevent debris having a predetermined size that is entrained within air flowing along the flow path 1130 from entering the plenum 1106. As such, the first debris collection chamber 1102 can generally be described as a large debris collection chamber. From the plenum 1106 the flow path 1130 extends through the cyclonic separator 1110. The cyclonic separator 1110 is configured to cause air flowing within the cyclonic separator 1110 to have a cyclonic motion such that the flow path 1130 extends cyclonically therein. The cyclonic motion of the air may cause at least a portion of any remaining debris entrained within the air to fall out of entrainment with the air flowing along the flow path 1130 and be deposited within the second debris collection chamber 1104. As such, the second debris collection chamber 1104 may generally be described as a fine debris collection chamber.

From the cyclonic separator 1110, the flow path 1130 can extend through the premotor filter 802 such at least a portion of any remaining debris entrained within the air flowing through the premotor filter 802 is collected by the premotor filter 802. Upon exiting the premotor filter 802, the flow path 1130 extends through the suction motor 1116 and into the exhaust duct 1122. As shown, before exiting the exhaust duct 1122 the flow path 1130 may extend through the post-motor filter 1124 such that at least a portion of any remaining debris entrained within the air is collected by the post-motor filter 1124.

Figure 11A:
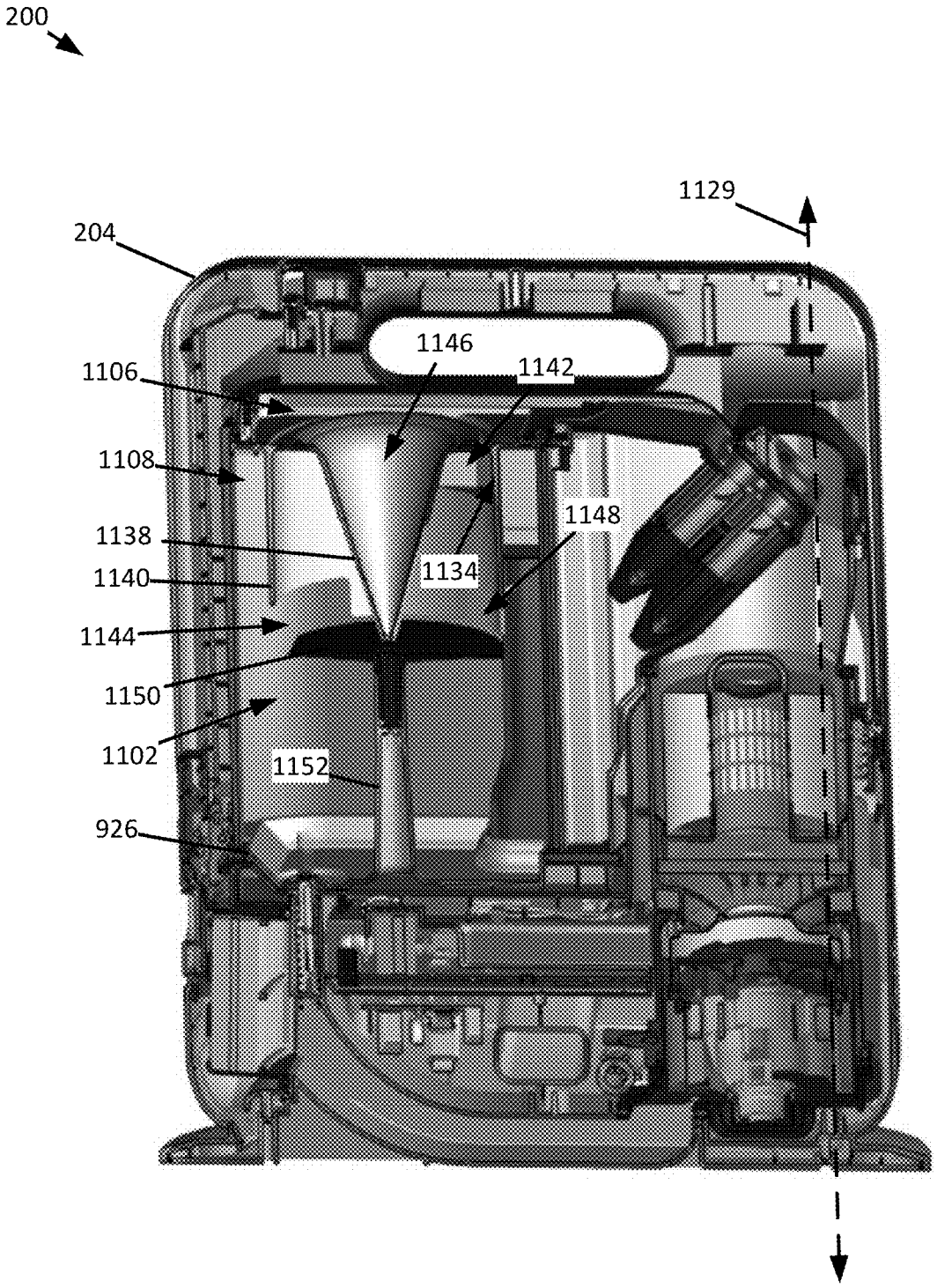
FIG. 11A shows another perspective cross-sectional view of another example of the docking station of FIG. 2 taken along the line IX-IX having a filter therein, wherein the filter is a cyclonic separator, consistent with embodiments of the present disclosure.

FIG. 11A shows an example of the docking station dust cup 204, wherein the filter 1108 is a cyclonic separator (e.g., a large debris cyclonic separator) having a vortex finder 1138 extending within a cyclone chamber 1140. The cyclone chamber 1140 extends within the first debris collection chamber 1102. The cyclone chamber 1140 includes a cyclone chamber inlet 1142 fluidly coupled to the up-duct air outlet 1134 and a cyclone chamber outlet 1144 through which debris cyclonically separated from air flowing therein passes through. In some instances, and as shown, the cyclone chamber 1140 may include an open end 1148 that is spaced apart from the plenum 1106. A plate 1150 may extend across at least a portion of the open end 1148, wherein the plate 1150 is spaced apart from the cyclone chamber 1140. The plate 1150 may be coupled to the openable door 926 via, for example, a pedestal 1152.

The vortex finder 1138 defines an air channel 1146 extending therein such that the first debris collection chamber 1102 is fluidly coupled to the plenum 1106 via the air channel 1146. At least a portion of the vortex finder 1138 may be defined by a filter medium such as, for example, a mesh screen.

As shown, the vortex finder 1138 and the cyclone chamber 1140 extend in a direction away from the plenum 1106 that is generally parallel the vertical axis 1129 of the docking station 200. As such, the filter 1108 may generally be described as a vertical cyclonic separator.

Figure 12:
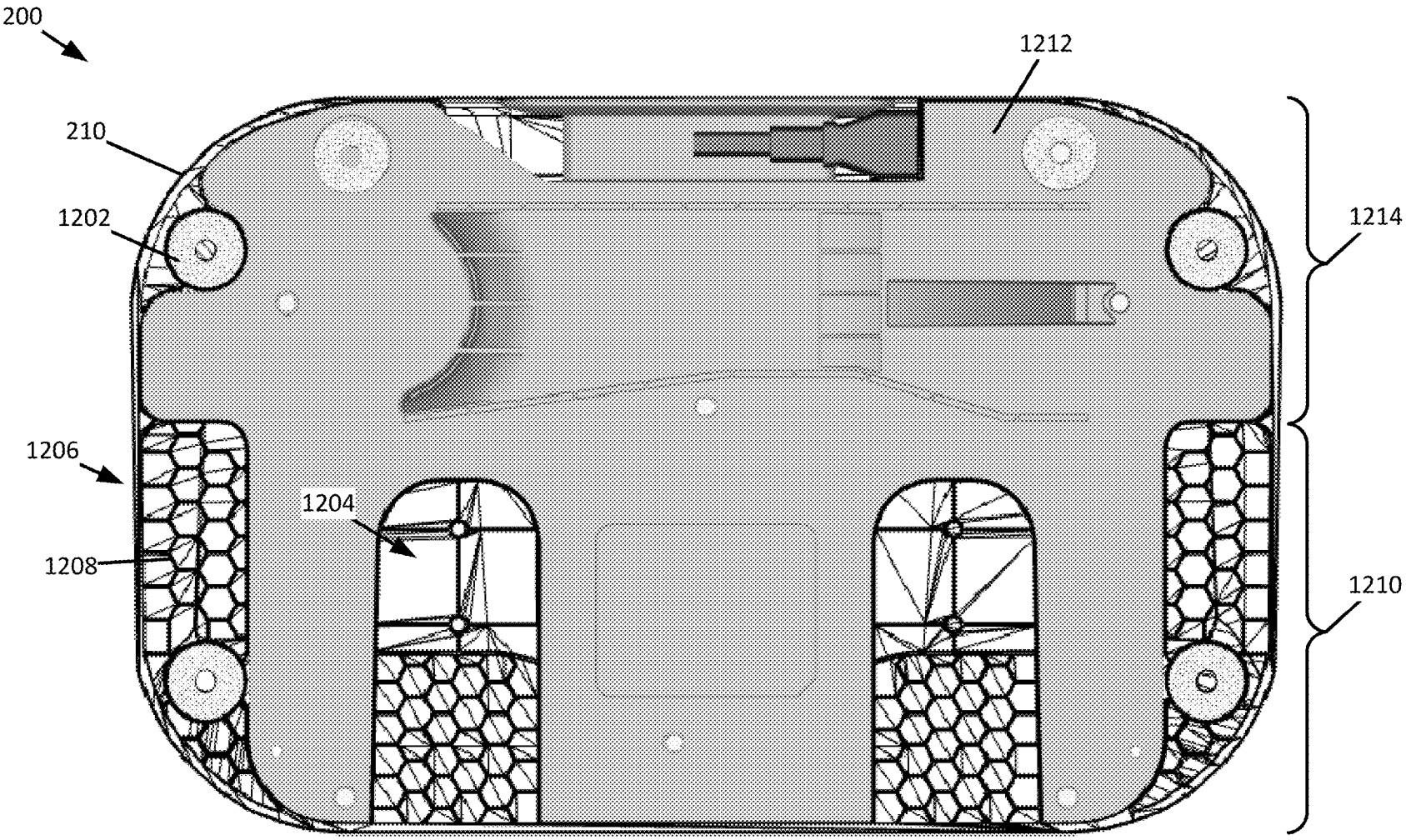
FIG. 12 shows a bottom view of the docking station of FIG. 2, consistent with embodiments of the present disclosure.

FIG. 12 shows a bottom view of the docking station 200. The floor facing surface 1204 may include one or more grated regions 1206 having a plurality of grate cavities 1208. The grate cavities 1208 may be configured to receive at least a portion of a material extending from a floor (e.g., a portion of carpet). For example, when a portion of a carpet is received within the grate cavities 1208, the stability of the docking station 200 may be improved.

As shown, the support 210 includes a plurality of grated regions 1206 extending around a periphery of the support 210. For example, the grated regions 1206 may extend within a forward portion 1210 of the support 210. The forward portion 1210 of the support 210 may generally be described as the portion of the support 210 from which the base 206 does not extend. A base plate 1212 may extend within a rearward portion 1214 of the support 210. The rearward portion 1214 of the support 210 may generally be described as the portion of the support 210 from which the base 206 extends. In some instances, at least a portion of the base plate 1212 may extend between the grated regions 1206 extending within the forward portion 1210. Additionally, or alternatively, the grated regions 1206 may extend substantially only within the forward portion 1210 (e.g., less than 5% of the total surface area of the grated regions 1206 extends within the rearward portion 1214).

The grate cavities 1208 can have any shape. In some instances, the grate cavities 1208 may have a plurality of shapes. For example, one or more of the grate cavities 1208 may have one or more of a hexagonal shape, a triangular shape, a square shape, an octagonal shape, and/or any other shape. In some instances, at least a portion of the grate cavities 1208 for a respective grated region 1206 may generally be described as defining a honeycomb structure.

As also shown, the support 210 includes a plurality of feet 1202 spaced around a periphery of a floor facing surface 1204 of the support 210. The feet 1202 may, in some instances, may have different heights. For example, the feet 1202 may be configured such that the feet 1202 positioned in the rearward portion 1214 of the support 210 have a height that measures greater than the feet 1202 positioned within the forward portion 1210 of the support 210. Such a configuration may improve the stability of the docking station 200 on carpeted surfaces. For example, on carpeted surfaces, the rearward portion 1214 may have a tendency to settle deeper into the carpet due to the weight of the docking station 200 being concentrated over the rearward portion 1214. The longer feet 1202 may mitigate the amount the rearward portion 1214 settles into the carpet.

Figure 13:
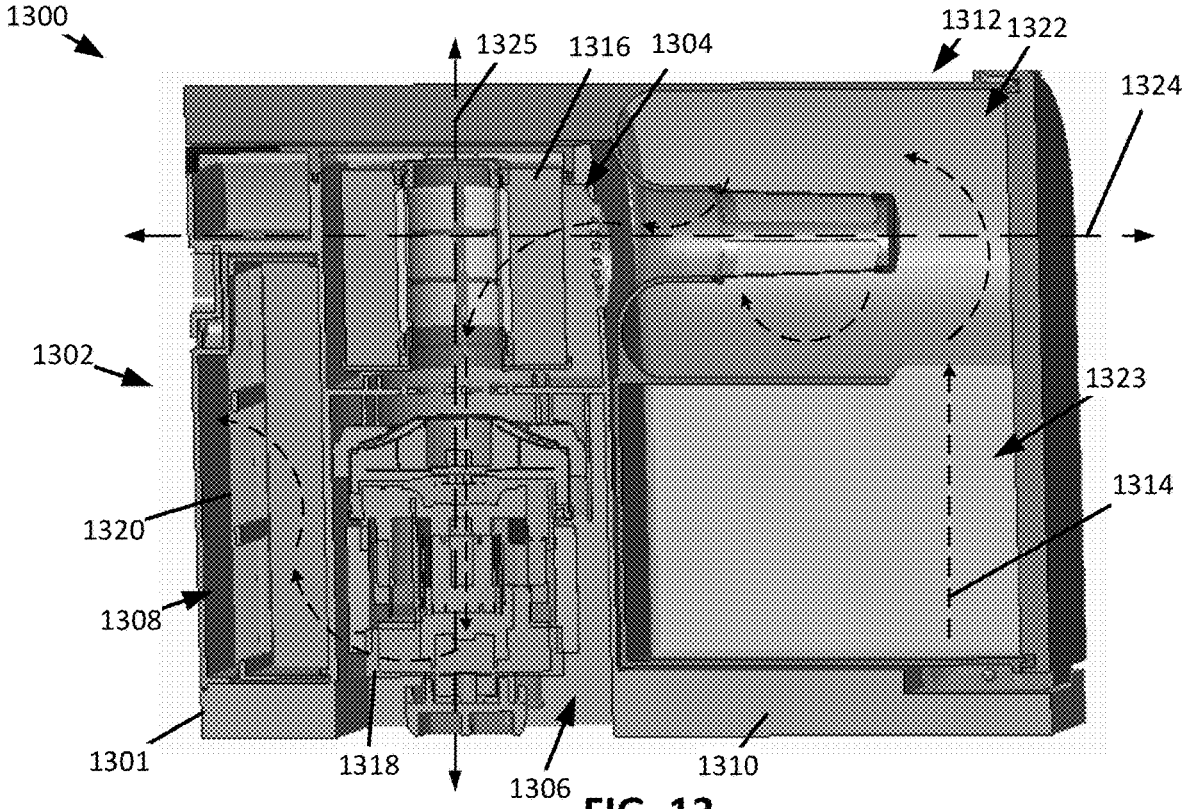
FIG. 13 shows a perspective cross-sectional view of a docking station, consistent with embodiments of the present disclosure.

FIG. 13 shows a cross-sectional view of a docking station 1300, which may be an example of the docking station 100 of FIG. 1. As shown, the docking station 1300 includes a base 1302 having a suction housing 1301 and a support 1310. The suction housing 1301 defines a pre-motor filter chamber 1304, a motor chamber 1306, and a post-motor filter chamber 1308.

The support 1310 extends from the suction housing 1301 and is configured to support a docking station dust cup 1312. A flow path 1314 extends from the docking station dust cup 1312 into the pre-motor filter chamber 1304 through the motor chamber 1306 and the post-motor filter chamber 1308 and then is exhausted from the docking station 1300. Debris may be entrained within air flowing along the flow path 1314. A portion of the debris entrained in the air may be deposited in the docking station dust cup 1312 before the air enters the pre-motor filter chamber 1304. The pre-motor filter chamber 1304 includes a pre-motor filter 1316 configured to remove at least a portion of any remaining debris entrained in the air before the air reaches a suction motor 1318. Any debris remaining in the air after passing through the pre-motor filter 1316 passes through the suction motor 1318 and enters the post-motor filter chamber 1308. The post-motor filter chamber 1308 includes a post-motor filter 1320 configured to remove at least a portion of any debris remaining in the air after passing through the suction motor 1318. The post-motor filter 1320 may be a finer filter medium than the pre-motor filter 1316. For example, the post-motor filter 1320 may be a high efficiency particulate air (HEPA) filter. In some instances, the motor chamber 1306 may include sound dampening insulation and the suction motor 1318 may have at least 750 watts of power or at least 800 watts of power.

As also shown, the docking station dust cup 1312 includes a cyclonic separator 1322 and a debris collector 1323. A longitudinal axis 1324 of the cyclonic separator 1322 extends generally parallel to the support 1310 and/or transverse (e.g., perpendicular) to an axis 1325 extending through the suction motor 1318 (e.g., a central longitudinal axis of the suction motor 1318) and the pre-motor filter 1316. In other words, the cyclonic separator 1322 may generally be described as a horizontal cyclonic separator.

Figure 14:
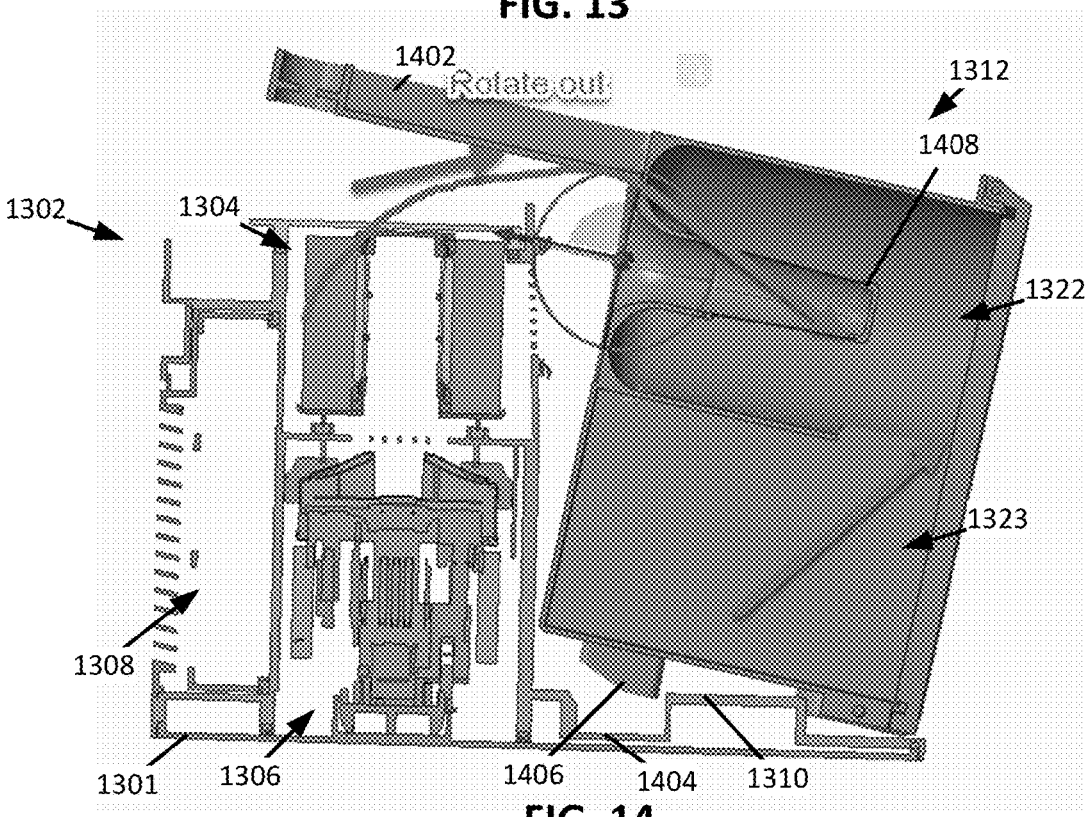
FIG. 14 shows another cross-sectional view of the docking station of FIG. 13, consistent with embodiments of the present disclosure.

FIG. 14 shows an example of the docking station dust cup 1312 being pivoted relative to the base 1302 about an axis in a direction away from the base 1302. As shown, the docking station dust cup 1312 includes a handle 1402 that extends over a portion of the base 1302. For example, the handle 1402 may extend over a portion of the suction housing 1301 that defines the pre-motor filter chamber 1304, the motor chamber 1306, and the post-motor filter chamber 1308. In some instances, the handle 1402 may include a latch which couples the handle 1402 to the base 1302 such that the docking station dust cup 1312 doesn't inadvertently become decoupled from the base 1302.

As also shown, the support 1310 includes one or more recesses 1404 configured to receive a corresponding protrusion 1406 extending from the docking station dust cup 1312. Each protrusion 1406 engages a corresponding recess 1404 such that lateral movement of the docking station dust cup 1312 relative to the base 1302 is substantially prevented. When the docking station dust cup 1312 is pivoted relative to the base 1302, each protrusion 1406 rotates out of each corresponding recess 1404 such that the docking station dust cup 1312 can be removed from the support 1310.

When the docking station dust cup 1312 is removed from the base 1302, the cyclonic separator 1322 and the debris collector 1323 are both removed from the base 1302. However, in some instances, the docking station dust cup 1312 may be configured such that at least a portion of the cyclonic separator 1322 remains coupled to the base 1302. For example, a vortex finder 1408 may remain coupled to the base 1302 when the docking station dust cup 1312 is removed from the base 1302.

Figure 15:
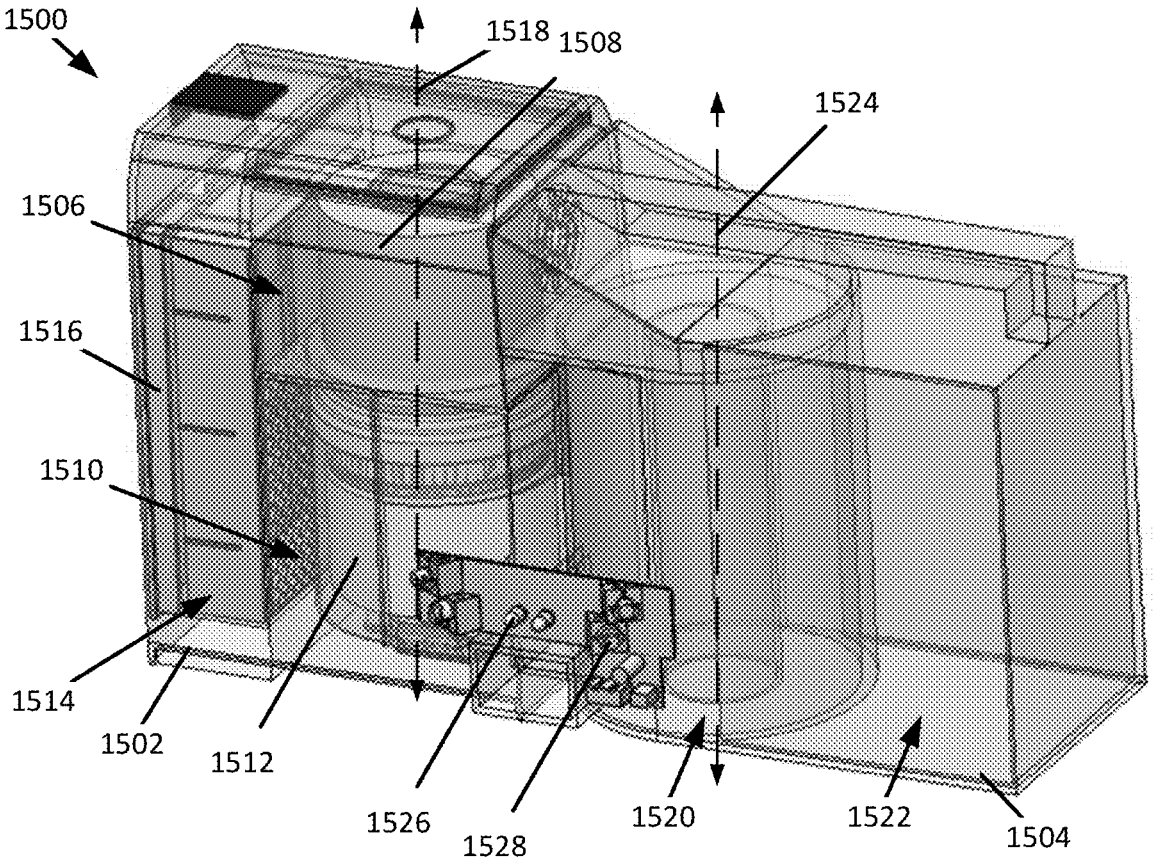
FIG. 15 shows a perspective view of a docking station, consistent with embodiments of the present disclosure.

FIG. 15 shows an example of a docking station 1500, which may be an example of the docking station 100 of FIG. 1. As shown, the docking station 1500 includes a base 1502 and a docking station dust cup 1504. The base 1502 includes a pre-motor filter chamber 1506 configured to receive a pre-motor filter 1508, a suction motor chamber 1510 configured to receive a suction motor 1512, and a post-motor filter chamber 1514 configured to receive a post-motor filter 1516. As shown, the pre-motor filter chamber 1506 and the suction motor chamber 1510 are configured such that an axis 1518 extends through both the pre-motor filter 1508 and the suction motor 1512.

The docking station dust cup 1504 includes a cyclonic separator 1520 and a debris collector 1522. As shown, a longitudinal axis 1524 of the cyclonic separator 1520 extends generally parallel to the axis 1518 extending through the pre-motor filter 1508 and the suction motor 1512. In other words, the cyclonic separator 1520 may generally be described as a vertical cyclonic separator.

As shown, the docking station 1500 includes a plurality of electrodes 1526 and optical emitters 1528 (e.g., one or more light sources configured to emit optical signals to the robotic cleaner 101 such that the robotic cleaner 101 can locate and navigate to the docking station 1500).

Figure 16:
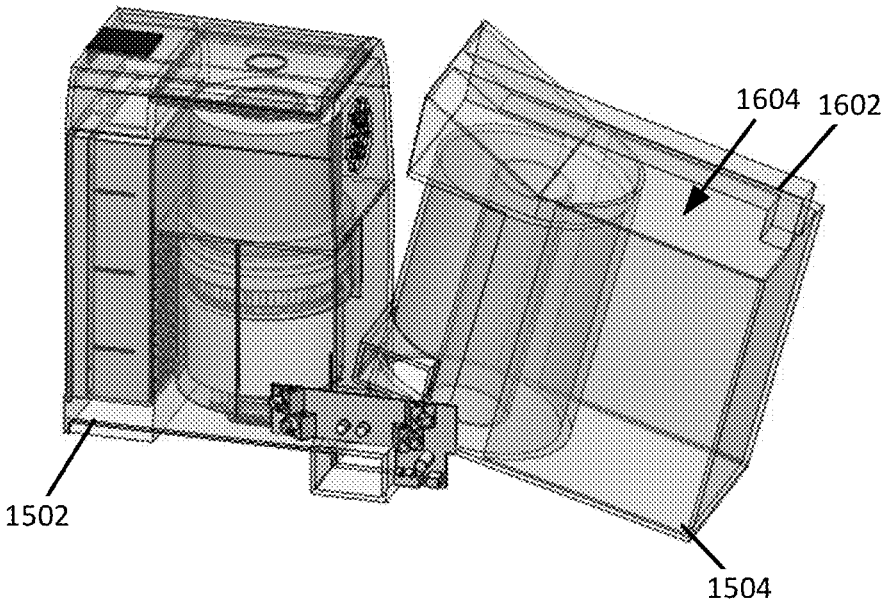
FIG. 16 shows another perspective view of the docking station of FIG. 15, consistent with embodiments of the present disclosure.

As shown in FIG. 16, the docking station dust cup 1504 includes a handle 1602 extending along a top surface 1604 of the docking station dust cup 1504. As also shown, the docking station dust cup 1504 is configured to pivot in a direction away from the base 1502 of the docking station 1500. For example, a user may pivot the docking station dust cup 1504 away from the base 1502 such that the docking station dust cup 1504 can be removed from the base 1502.

In some instances, when the docking station dust cup 1504 is being removed from the base 1502, a user may actuate a release. Upon actuation of the release, the docking station dust cup 1504 may be urged in a substantially horizontal direction away from the base 1502. After being urged horizontally away from the base 1502, the user may pivot the docking station dust cup 1504 in a direction away from the base 1502.

Figure 17:
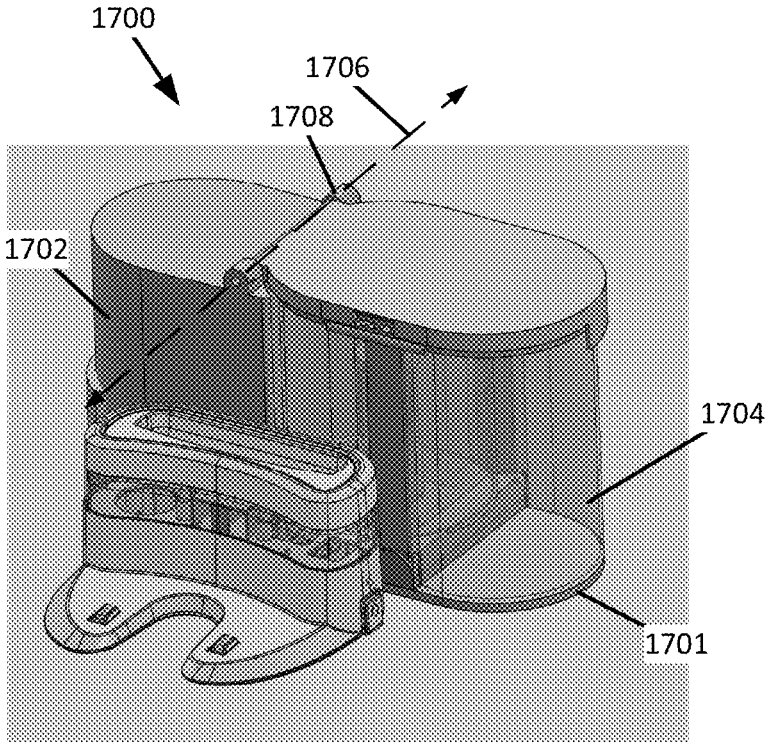
FIG. 17 shows a perspective view of a docking station having a dust cup configured to be pivoted between an in-use and a removal position, consistent with embodiments of the present disclosure.
Figure 18:
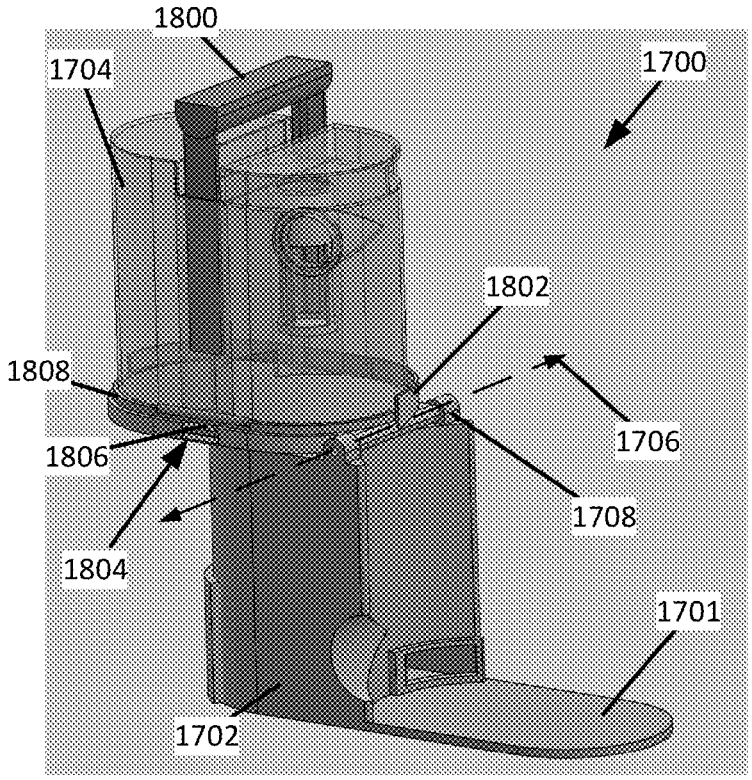
FIG. 18 shows a perspective view of the docking station of FIG. 17 having the dust cup in the removal position, consistent with embodiments of the present disclosure.
Figure 19:
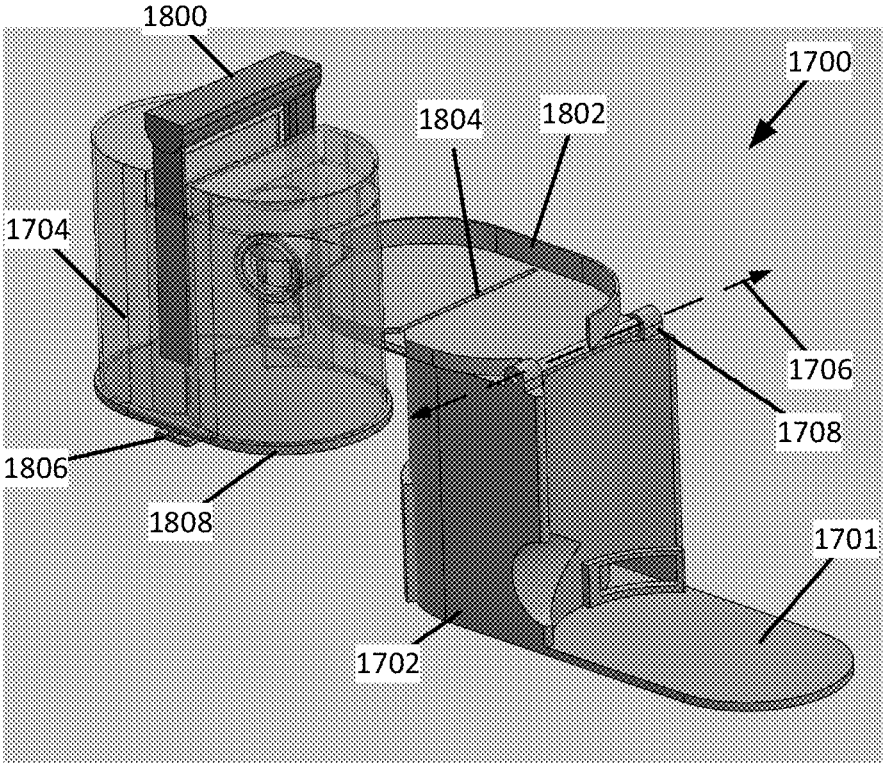
FIG. 19 shows a perspective view of the docking station of FIG. 17 having the dust cup being removed, consistent with embodiments of the present disclosure.

FIGS. 17-19 show an example of a docking station 1700, which may be an example of the docking station 100 of FIG. 1. The docking station 1700 includes a base 1702 and a docking station dust cup 1704 coupled to the base 1702. As shown, the docking station dust cup 1704 is configured to pivot about an axis 1706 extending along a hinge 1708 between an in-use (e.g., as shown in FIG. 17) and a removal position (e.g., as shown in FIG. 18). As also shown, the docking station dust cup 1704 is configured to pivot in a direction of the docking station base 1702 and out of engagement with a support 1701 such that the docking station dust cup 1704 comes to rest on the base 1702 in an inverted position (e.g., a removal position).

As shown in FIGS. 18 and 19 a handle 1800 can be extended from the docking station dust cup 1704 such that the docking station dust cup 1704 can be removed from a coupling platform 1802 that couples the docking station dust cup 1704 to the base 1702. The coupling platform 1802 may define a slot 1804 (e.g., a T-slot) configured to receive a corresponding rail 1806 (e.g., a T-rail) extending from the docking station dust cup 1704. The slot 1804 and the rail 1806 may be configured to slideably engage each other such that the docking station dust cup 1704 can be removed from the coupling platform 1802 in response to a sliding movement. Additionally, or alternatively, the coupling platform 1802 may define a receptacle for receiving the docking station dust cup 1704. In some instances, the receptacle may form a friction fit with at least a portion of the docking station dust cup 1704.

When the docking station dust cup 1704 is decoupled from the coupling platform 1802, a door 1808 can be configured to pivot open (e.g., in response to actuation of a button/trigger, a user pulling on the door 1808, and/or the like). When the door 1808 pivots open, the docking station dust cup 1704 may be emptied of any debris stored therein.

Figure 20:
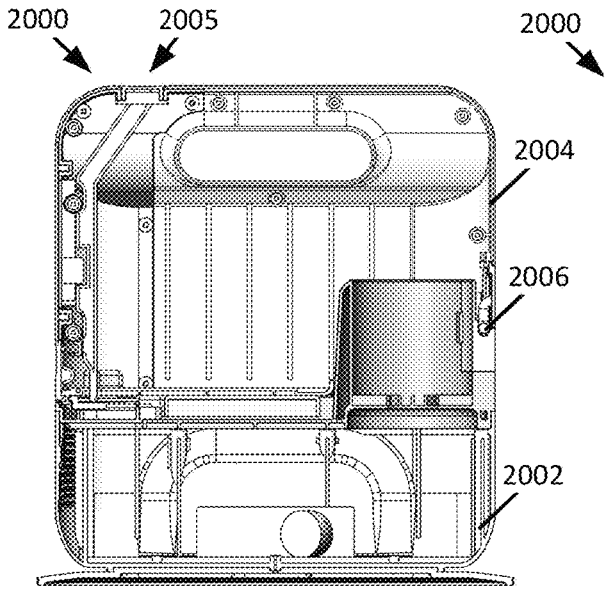
FIG. 20 shows a cross-sectional view of a docking station having a dust cup in an in-use position, consistent with embodiments of the present disclosure.
Figure 21:
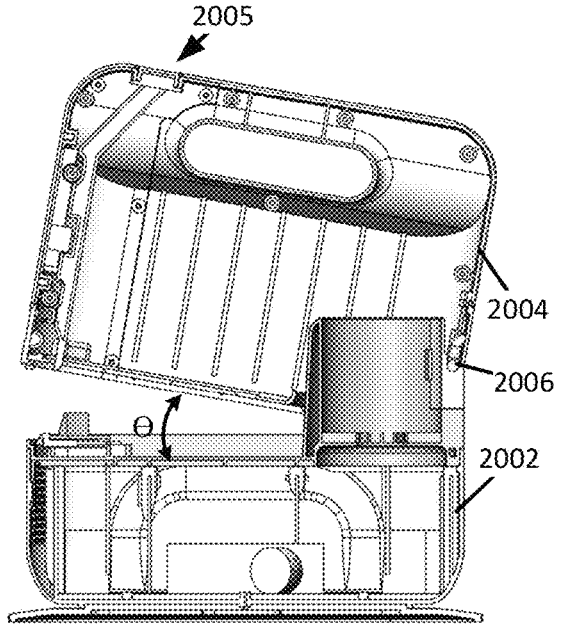
FIG. 21 shows a cross-sectional view of the docking station of FIG. 20 having the dust cup being removed from a base thereof in response to a pivotal movement, consistent with embodiments of the present disclosure.

FIGS. 20 and 21 show a cross-sectional view of an example of a docking station 2000, which may be an example of the docking station 100 of FIG. 1. The docking station 2000 includes a base 2002 and a docking station dust cup 2004. The docking station dust cup 2004 is configured to be decoupled from the base 2002 at least partially in response to a pivotal movement of the docking station dust cup 2004 and recoupled to the base 2002 in response to a substantially vertical movement. Additionally, or alternatively, the docking station dust cup 2004 may be recoupled to the base 2002 at least partially in response to a pivotal movement. FIG. 20 shows an example of the docking station dust cup 2004 coupled to the base 2002 in an-use position and FIG. 21 shows an example of the docking station dust cup 2004 being pivoted such that the docking station dust cup 2004 can be decoupled from the base 2002.

As shown, the docking dust cup 2004 includes a release 2005 configured to allow the docking dust cup 2004 to pivot about a pivot point 2006 in response to actuation. After a predetermined rotation angle θ (e.g., about 5°, about 10°, about 15°, about 20°, about 25°, or any other rotation angle) the docking station dust cup 2004 may be fully decoupled from the base 2002.

Figure 22:
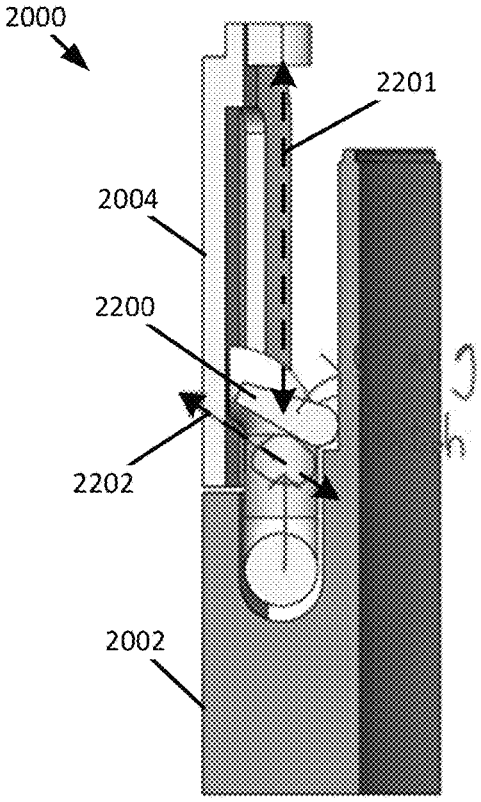
FIG. 22 shows a cross-sectional view of a pivot catch of the docking station of FIG. 20, consistent with embodiments of the present disclosure.

FIG. 22 shows a cross-sectional view of a portion of the docking station dust cup 2004 coupled to the base 2002. As shown, a portion of the docking station dust cup 2004 is disposed between a pivot catch 2200 coupled to the base 2002. As shown, the pivot catch 2200 extends from and is pivotally coupled to the base 2002. In response to actuation of the release 2005, a biasing mechanism (e.g., a compression spring, a torsion springs, an elastomeric material, and/or any other biasing mechanism) may urge the docking station dust cup 2004 away from the base 2002 such the docking station dust cup 2004 engages (e.g., contacts) the pivot catch 2200. Once engaging (e.g., contacting) the pivot catch 2200, the docking station dust cup 2004 can be moved along a removal axis 2202 that extends transverse to a vertical axis 2201. To recouple the docking station dust cup 2004 to the base 2002, the docking station dust cup 2004 can be vertically inserted onto the base 2002 such that a portion of the docking station dust cup 2004 engages (e.g., contacts) the pivot catch 2200, causing the pivot catch 2200 to rotate. Rotation of the pivot catch 2200 allows a portion of the docking station dust cup 2004 to pass the pivot catch 2200 such that the pivot catch 2200 rotates back to a retaining position (e.g., as shown in FIG. 22) when the portion of the docking station dust cup 2004 is disposed between the pivot catch 2200 and the base 2002. A biasing mechanism (e.g., a compression spring, a torsion spring, an elastomeric material, and/or any other biasing mechanism) can be configured urge the pivot catch 2200 towards the retaining position. In some instances, for example, a resiliently deformable seal (e.g., a natural or synthetic rubber seal) can extend between the docking station dust cup 2004 and the base 2002. The resiliently deformable seal can be configured to be compressed when the docking station dust cup 2004 is being coupled to the base 2002 such that the pivot catch 2200 can pivot back to the retaining position. As such, when coupled to the base 2002, the resiliently deformable seal can urge the docking station dust cup 2004 into engagement (e.g., contact) with the pivot catch 2200.

Figure 23:
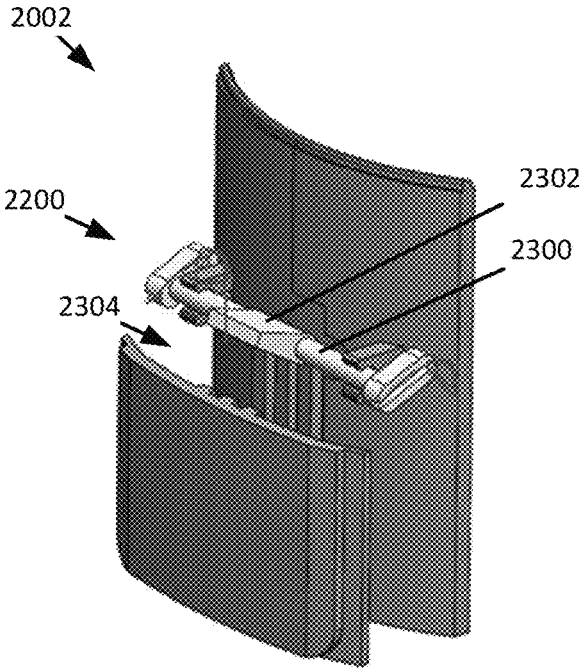
FIG. 23 shows a perspective view of an example of the pivot catch of FIG. 22, consistent with embodiments of the present disclosure.

FIG. 23 shows an example of the pivot catch 2200 coupled to a portion of the base 2002. As shown, the pivot catch 2200 includes an axle 2300 rotatably coupled to the base 2002 and a lever 2302 extending from the axle 2300. When the lever 2302 engages (e.g., contacts) the docking station dust cup 2004, the axle 2300 is caused to rotate such that a portion of the docking station dust cup 2004 can be received within a cavity 2304 defined within the base 2002.

Figure 26:
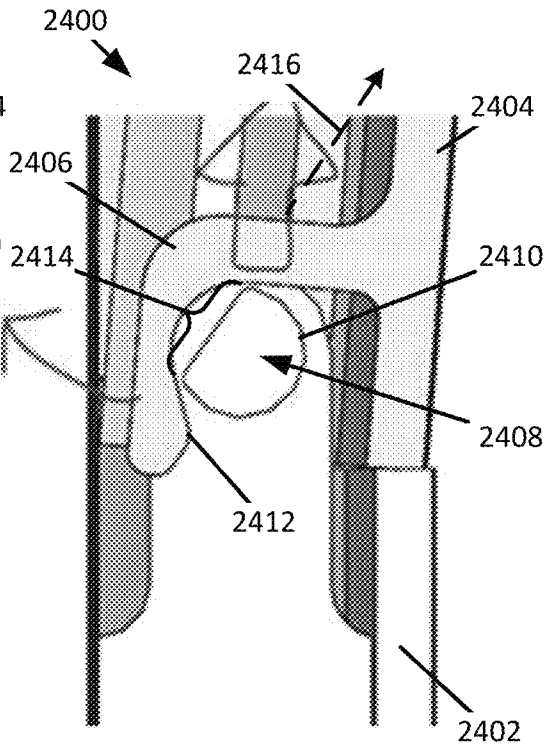
FIG. 26 shows another cross-sectional view of the portion of the docking station of FIG. 24, consistent with embodiments of the present disclosure.
Figure 25:
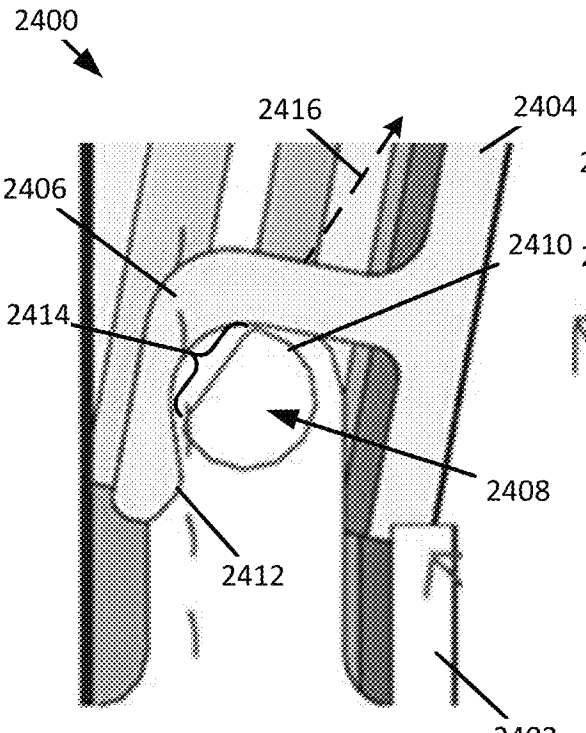
FIG. 25 shows another cross-sectional view of the portion of the docking station of FIG. 24, consistent with embodiments of the present disclosure.
Figure 24:
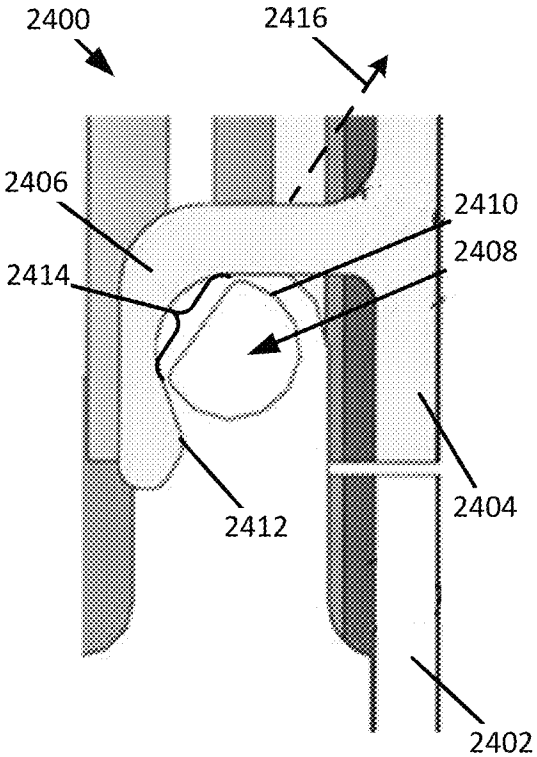
FIG. 24 shows a cross-sectional view of a portion of a docking station, consistent with embodiments of the present disclosure.

FIGS. 24 to 26 show a cross-sectional example of a portion of a docking station 2400, which may be an example of the docking station 100 of FIG. 1. The docking station 2400 includes a base 2402 and a docking station dust cup 2404 removably coupled to the base 2402. The docking station dust cup 2404 can generally be described as being configured to be decoupled from the base 2402 at least partially in response to a pivotal movement of the docking station dust cup 2404 and recoupled to the base 2402 in response to a substantially vertical movement. Additionally, or alternatively, the docking station dust cup 2404 may be recoupled to the base 2402 at least partially in response to a pivotal movement.

As shown, the docking station dust cup 2404 includes a pivot catch 2406 that is configured to pivot around a pivot point 2408 defined by an axle 2410. The pivot catch 2406 can include a protrusion 2412 configured to extend at least partially around the axle 2410. The axle 2410 can include a cutout region 2414 (e.g., a planar portion) such that the protrusion 2412 can pass over the cutout region 2414 in response to movement along a movement axis 2416. The protrusion 2412 comes into alignment with the cutout region 2414 in response to the pivotal movement of the docking station dust cup 2404. The pivot catch 2406 may be configured to be resiliently deformable such that the docking station dust cup 2404 can be recoupled to the base 2402 in response to a substantially vertical movement. In other words, the pivot catch 2406 can be resiliently deformable such that, when the docking station dust cup 2404 is being recoupled to the base 2402, the protrusion 2412 can pass over the axle 2410 without having to be aligned with the cutout region 2414.

Figure 27:
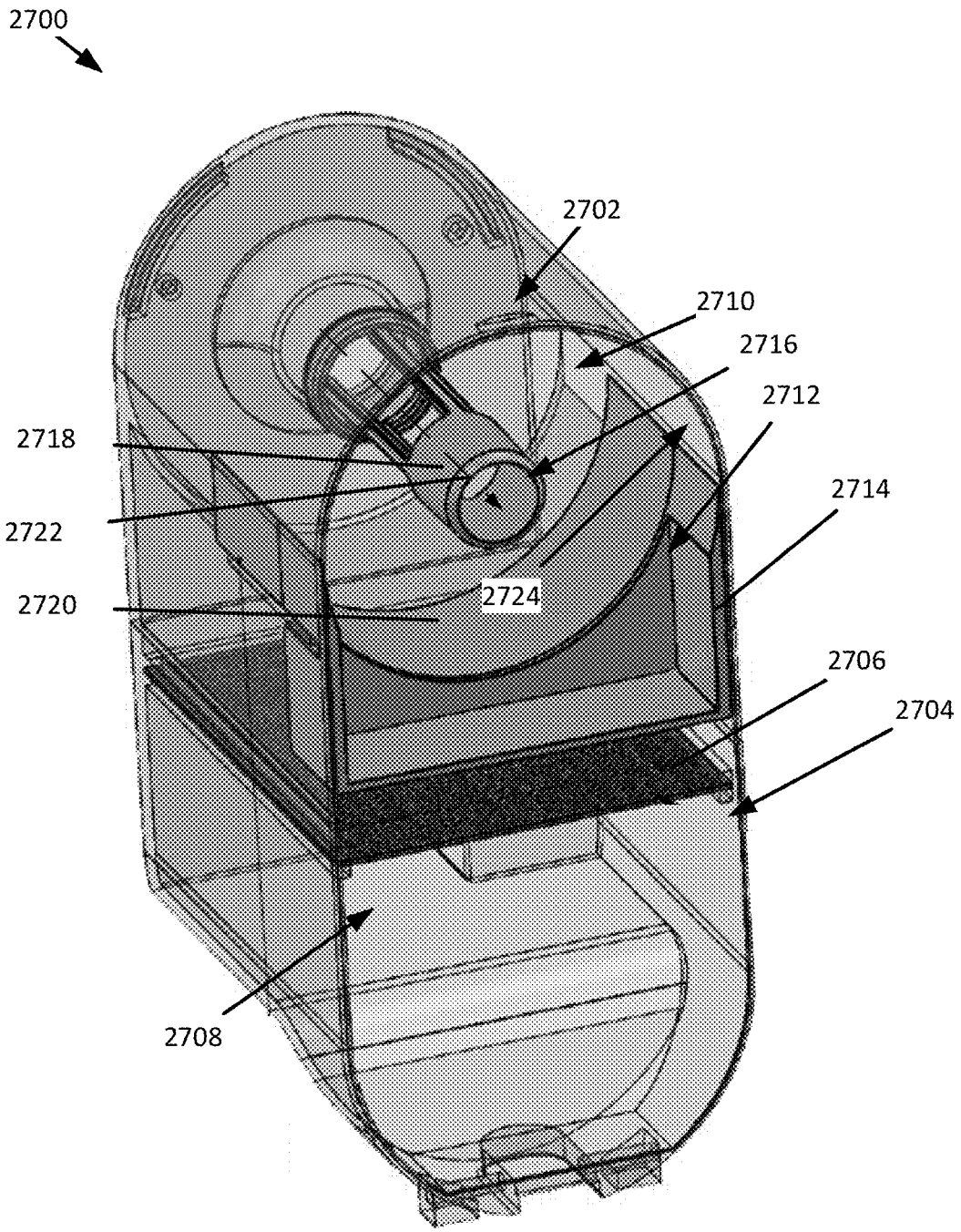
FIG. 27 shows a perspective view of a docking station dust cup, consistent with embodiments of the present disclosure.

FIG. 27 shows an example of a docking station dust cup 2700, which may be an example of the docking station dust cup 104 of FIG. 1, having a horizontal cyclonic separator 2702. The docking station dust cup 2700 defines an internal volume 2704 configured to receive debris entrained within an air flow. As shown, a filter 2706 (e.g., a filter medium) extends within the internal volume 2704 such that a first debris collection chamber 2708 and a second debris collection chamber 2710 are defined therein. An airflow path is configured to extend between the first and second debris collection chambers 2708 and 2710 and through the filter 2706. Air flowing along the airflow path can include debris having varying sizes entrained therein.

The filter 2706 can be configured such that larger debris does not pass through the filter 2706 while smaller debris passes through the filter 2706. As such, larger debris is deposited in the first debris collection chamber 2708 and smaller debris passes through the filter 2706 and enters the second debris collection chamber 2710. The filter 2706 can be, for example, a mesh screen.

Once the smaller debris enters the second debris collection chamber 2710, at least a portion of the smaller debris can be separated from the air flow by cyclonic action. For example, the debris separated from the air flow can be deposited in a debris collector 2714. The debris collector 2714 defines a debris collection region 2712 within the second debris collection chamber 2710. As shown, the debris collector 2714 is disposed proximate a distal end region 2716 of a vortex finder 2718 that extends within the second debris collection chamber 2710.

An adjustable insert 2720 can be provided adjacent the debris collector 2714. The adjustable insert 2720 can extend along a longitudinal axis 2722 of the second debris collection chamber 2710 and slideably engage an inner surface 2724 of the second debris collection chamber 2710. As such, the location of the adjustable insert 2720 can be adjusted relative to the debris collector 2714.

The docking station dust cup 2700 is shown as having a dust cup cover removed therefrom for purposes of clarity. However, the docking station dust cup 2700 may include a dust cup cover pivotally coupled thereto such that the internal volume 2704 is enclosed.

Figure 28:
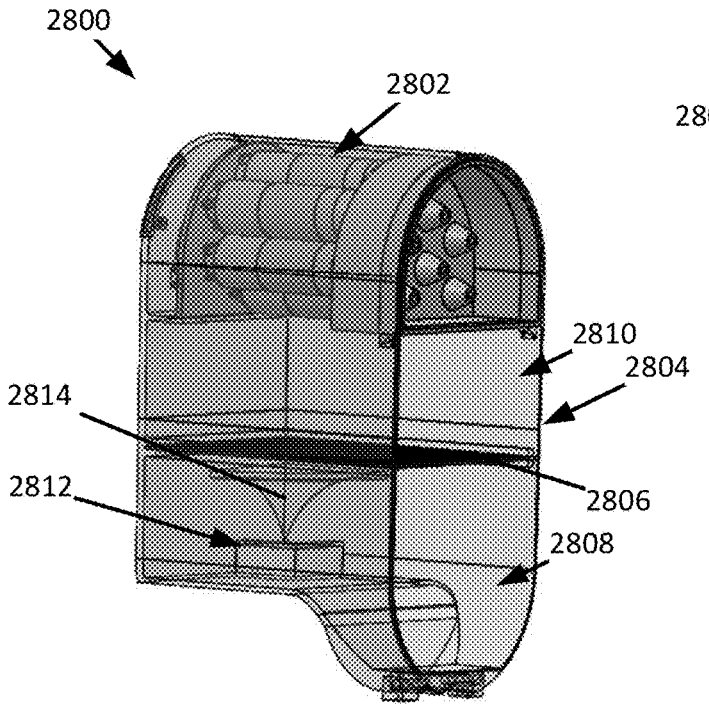
FIG. 28 shows a perspective view of a docking station dust cup defining an internal volume within which a filter extends, consistent with embodiments of the present disclosure.

FIG. 28 shows an example of a docking station dust cup 2800, which may be an example of the docking station dust cup 104 of FIG. 1. The docking station dust cup 2800 includes a cyclonic generator 2802 configured to generate a plurality of horizontal cyclones. As shown, the docking station dust cup 2800 can define an internal volume 2804 having a filter 2806 (e.g., a filter medium) extending therein such that a first and a second debris collection chamber 2808 and 2810 are defined within the internal volume 2804. As also shown, the docking station dust cup 2800 includes a dirty air inlet 2812 and a flow directer 2814 disposed above the dirty air inlet 2812.

The docking station dust cup 2800 is shown as having a dust cup cover removed therefrom for purposes of clarity. However, the docking station dust cup 2800 may include a dust cup cover pivotally coupled thereto such that the internal volume 2804 is enclosed.

Figure 29:
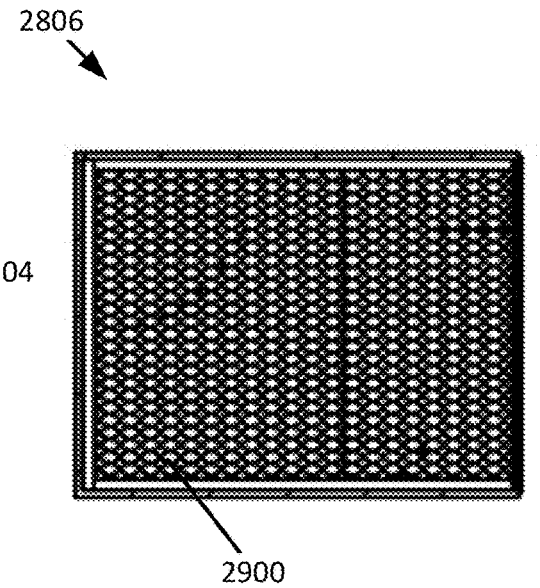
FIG. 29 shows an example of the filter of FIG. 28, consistent with embodiments of the present disclosure.

FIG. 29 shows an example of the filter 2806. As shown, the filter 2806 may include a plurality of apertures 2900 extending therethrough. The apertures 2900 can be sized such that a desired particle size of debris can pass through the apertures 2900 while larger debris are substantially prevented from passing through the apertures 2900. As such, the first debris collection chamber 2808 may generally be described as being configured to receive large debris and the second debris collection chamber 2810 may generally be described as being configured to receive small debris. In some instances, the filter 2806 can be a mesh screen.

Figure 30:
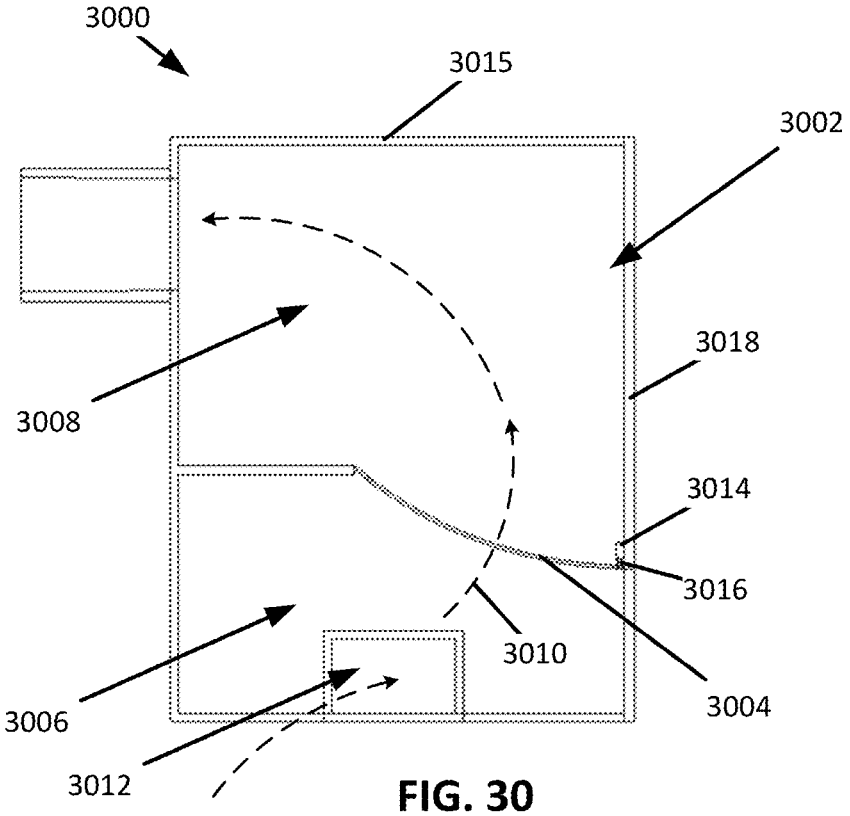
FIG. 30 shows a schematic view of an example of a docking station dust cup having a filter extending therein, wherein the filter is cleaned by actuation of an agitator, consistent with embodiments of the present disclosure.

FIG. 30 shows an example of a docking station dust cup 3000, which may be an example of the docking station dust cup 104 of FIG. 1. As shown, the docking station dust cup 3000 may define an internal volume 3002. A filter 3004 (e.g., a filter medium) can extend within the internal volume 3002 such that a first debris collection chamber 3006 and a second debris collection chamber 3008 are defined therein. An airflow path 3010 can extend from a dirty air inlet 3012 into the first debris collection chamber 3006 through the filter 3004 and into the second debris collection chamber 3008.

The filter 3004 can be, for example, a mesh screen configured to prevent debris of a predetermined size from passing therethrough. For example, the filter 3004 can be configured such that large debris collects in the first debris collection chamber 3006 and small debris collects in the second debris collection chamber 3008.

When separating debris between the first and second debris collection chambers 3006 and 3008, debris may become adhered to the filter 3004. As a result, airflow passing through the filter 3004 may be restricted, reducing the performance of the docking station to which the docking station dust cup 3000 is coupled. Debris adhered to the filter 3004 may be removed through the action of an agitator 3014 coupled to a main body 3015 of the dust cup 3000.

Figure 31:
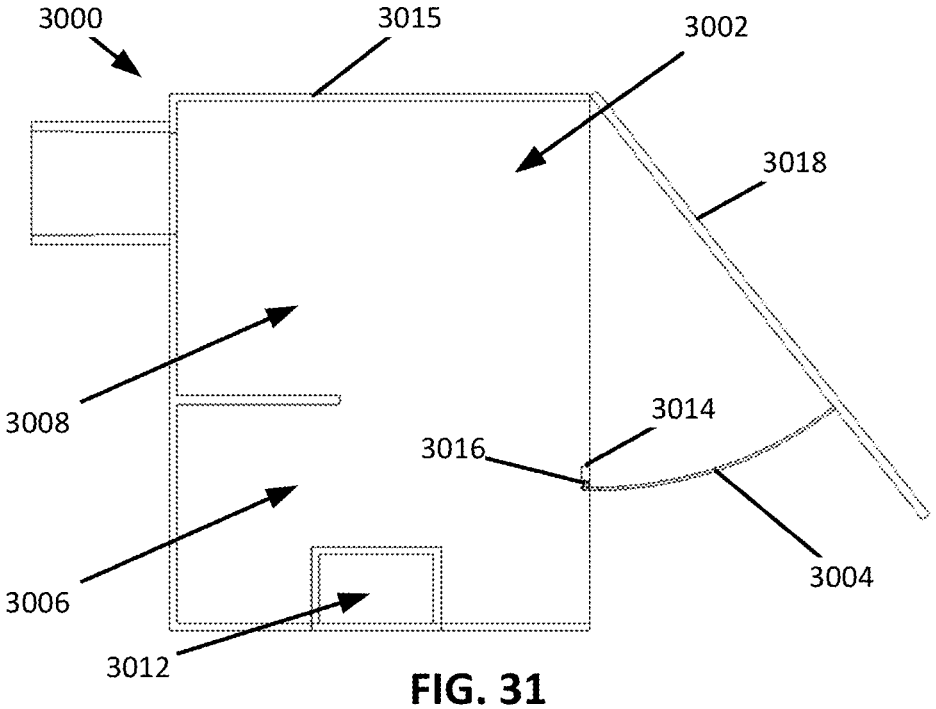
FIG. 31 shows another schematic view of the docking station dust cup of FIG. 30, consistent with embodiments of the present disclosure.

The agitator 3014 can be configured to engage at least a portion of the filter 3004. As shown, the agitator 3014 can include a wiper 3016 configured to slideably engage a portion of the filter 3004. For example, the filter 3004 can be coupled to a pivoting door 3018 that is pivotally coupled to the main body 3015 such that, as the pivoting door 3018 is transitioned from a closed (e.g., as shown in FIG. 30) to an open position (e.g., as shown in FIG. 31), for example, to empty the dust cup 3000, the filter 3004 slides relative to the wiper 3016 such that the wiper removes at least a portion of any debris adhered to the filter 3004. While the wiper 3016 is shown as engaging a surface of the filter 3004 that is facing the second debris collection chamber 3008, the wiper 3016 can be configured to engage a surface of the filter 3004 that is facing the first debris collection chamber 3006. In some instances, a plurality of wipers 3016 can be provided such that both surfaces of the filter 3004 can be engaged.

Figure 32:
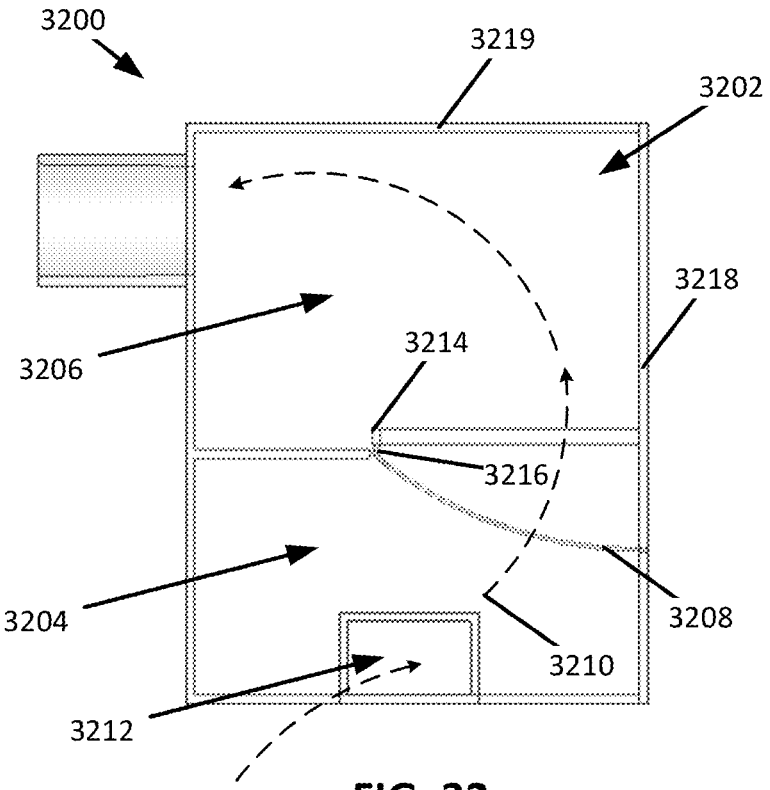
FIG. 32 shows a schematic view of an example of a docking station dust cup having a filter extending therein, wherein the filter is cleaned by actuation of an agitator, consistent with embodiments of the present disclosure.

FIG. 32 shows an example of a docking station dust cup 3200, which may be an example of the docking station dust cup 104 of FIG. 1. As shown, the docking station dust cup 3200 may define an internal volume 3202 that is separated into a first debris collection chamber 3204 and a second debris collection chamber 3206 by a filter 3208 (e.g., a filter medium). An airflow path 3210 can extend from a dirty air inlet 3212 into the first debris collection chamber 3204 through the filter 3208 and into the second debris collection chamber 3206.

The filter 3208 can be, for example, a mesh screen configured to prevent debris of a predetermined size from passing therethrough. As such, the first debris collection chamber 3204 may generally be described as being configured to receive large debris and the second debris collection chamber 3206 may generally be described as being configured to receive smaller debris.

When separating debris between the first and second debris collection chambers 3204 and 3206 debris may become adhered to the filter 3208. As a result, airflow through the filter 3208 may be restricted, reducing the performance of the docking station to which the dust cup 3200 is coupled. As such, an agitator 3214 may be provided to remove debris from the filter 3208. The agitator 3214 can be configured such that air can flow therethrough.

Figure 33:
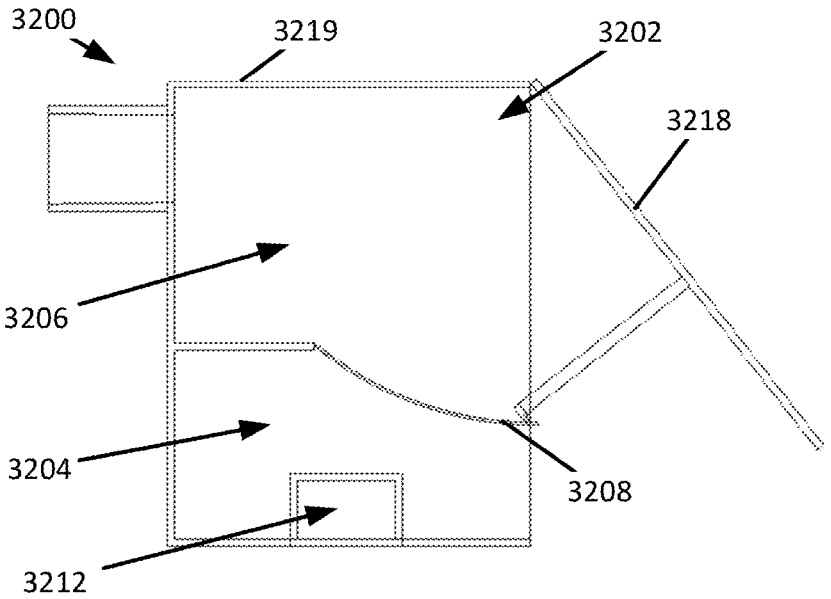
FIG. 33 shows another schematic view of the docking station dust cup of FIG. 32, consistent with embodiments of the present disclosure.

The agitator 3214 can be configured to engage at least a portion of the filter 3208. As shown, the agitator 3214 can include a wiper 3216 that is configured to slideably engage at least a portion of the filter 3208. For example, the agitator 3214 can be coupled to a pivoting door 3218 pivotally coupled to a main body 3219 of the docking station dust cup 3200 such that when the pivoting door 3218 is transitioned from a closed position (e.g., as shown in FIG. 32) to an open position (e.g., as shown in FIG. 33), the wiper 3216 slides relative to the filter 3208 such that at least a portion of the debris adhered to the filter 3208 are removed therefrom. While the wiper 3216 is shown as engaging a surface of the filter 3208 that is facing the second debris collection chamber 3206, the wiper 3216 can be configured to engage a surface of the filter 3208 that is facing the first debris collection chamber 3204. In some instances, a plurality of wipers 3216 can be provided such that both surfaces of the filter 3208 can be engaged.

Figure 34:
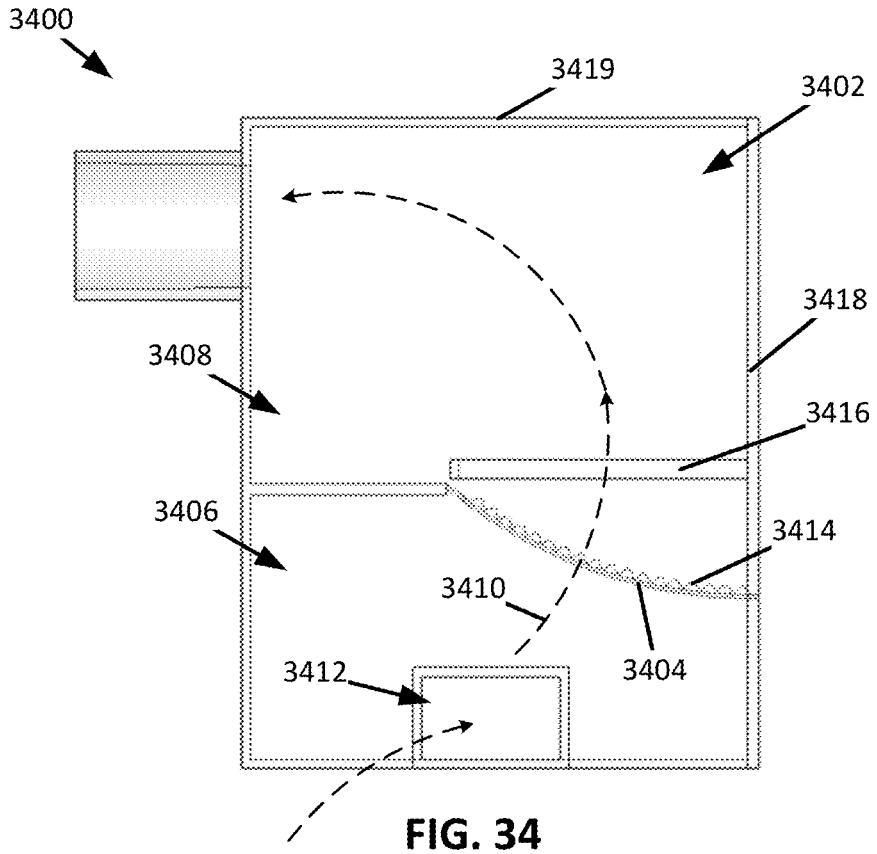
FIG. 34 shows a schematic view of an example of a docking station dust cup having a filter extending therein, wherein the filter is cleaned by actuation of an agitator, consistent with embodiments of the present disclosure.

FIG. 34 shows an example of a docking station dust cup 3400, which may be an example of the docking station dust cup 104 of FIG. 1. As shown, the docking station dust cup 3400 may define an internal volume 3402. The internal volume 3402 can include a filter 3404 (e.g., a filter medium) that separates the internal volume 3402 into a first debris collection chamber 3406 and a second debris collection chamber 3408. An airflow path 3410 can extend from a dirty air inlet 3412 into the first debris collection chamber 3406 through the filter 3404 and into the second debris collection chamber 3408.

The filter 3404 can be, for example, a mesh screen configured to prevent debris of a predetermined size from passing therethrough. For example, the filter 3404 can be configured such that larger debris collects in the first debris collection chamber 3406 and smaller debris collects in the second debris collection chamber 3408. As shown, the filter 3404 can include a plurality of protrusions 3414 extending therefrom. The protrusions 3414 can be configured to engage an agitator 3416 such that movement of the agitator 3416 across the protrusions 3414 can introduce vibrations into the filter 3404. The vibrations introduced into the filter 3404 can cause debris adhered to the filter 3404 to become dislodged. The protrusions 3414 may be a strip coupled to the filter 3404. In some instances, the protrusions 3414 may be formed from the filter 3404. For example, the filter 3404 may be at least partially pleated.

Figure 35:
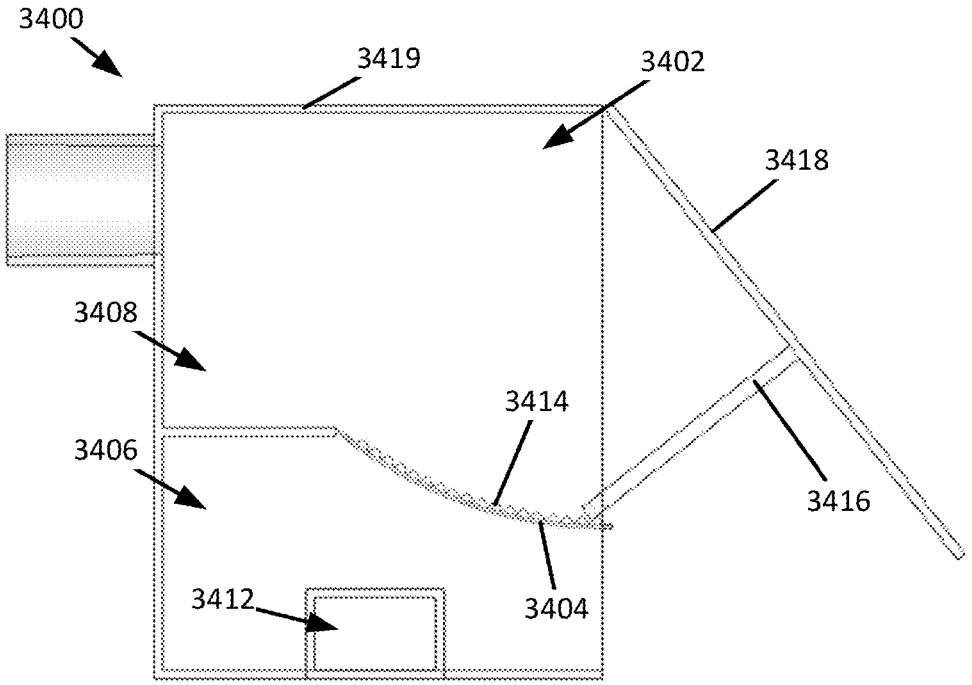
FIG. 35 shows another schematic view of the docking station dust cup of FIG. 34, consistent with embodiments of the present disclosure.

As shown, the agitator 3416 can be coupled to a pivoting door 3418 that is pivotally coupled to a main body 3419 of the docking station dust cup 3400 such that the agitator 3416 is caused to move across the protrusions 3414 in response to the pivoting door transitioning from a closed position (e.g., as shown in FIG. 34) to an open position (e.g., as shown in FIG. 35) to, for example, empty the docking station dust cup 3400. The agitator 3416 can be configured such that air can flow therethrough.

Figure 36:
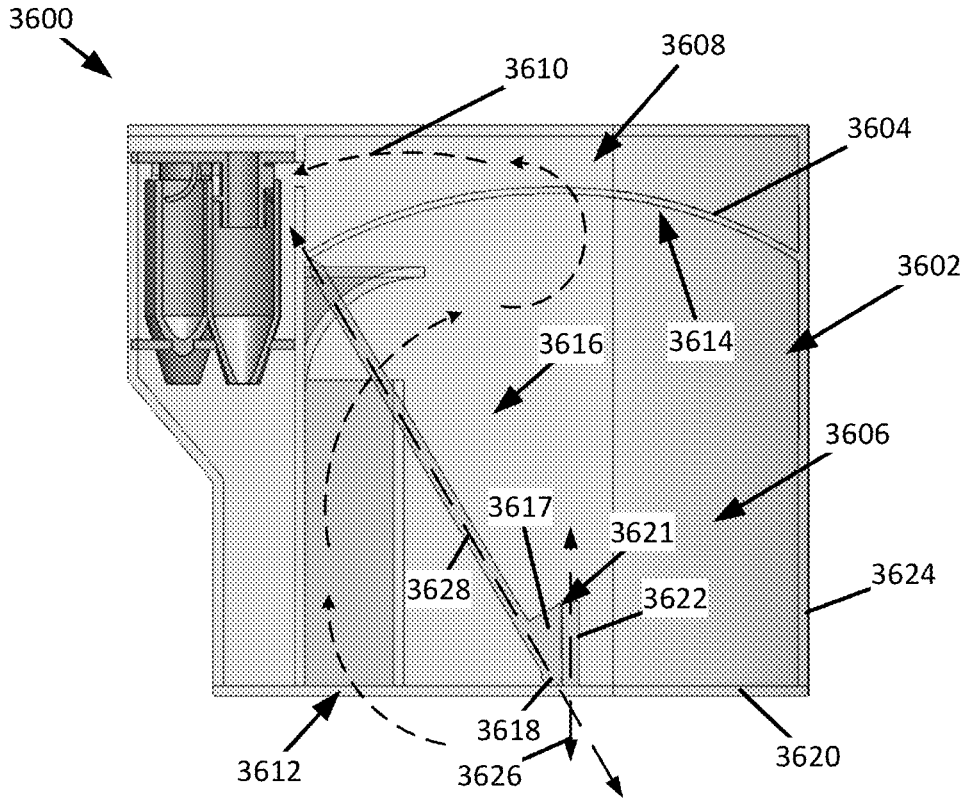
FIG. 36 shows a schematic view of an example of a docking station dust cup having a filter extending therein, wherein the filter is cleaned by actuation of an agitator, consistent with embodiments of the present disclosure.

FIG. 36 shows a side cross-sectional view of a docking station dust cup 3600, which may be an example of the docking station dust cup 104 of FIG. 1. As shown, the docking station dust cup 3600 may define an internal volume 3602 having a filter 3604 (e.g., a filter medium) disposed therein. The filter 3604 can separate the internal volume 3602 into a first debris collection chamber 3606 and a second debris collection chamber 3608. An airflow path 3610 can extend from a dirty air inlet 3612 into the first debris collection chamber 3606 through the filter 3604 and into the second debris collection chamber 3608.

The filter 3604 can be, for example, a mesh screen configured to prevent debris of a predetermined size from passing therethrough. For example, the filter 3604 can be configured such that larger debris collects in the first debris collection chamber 3606 and smaller debris collects in the second debris collection chamber 3608.

As shown, the filter 3604 can have an arcuate shape. A concave surface 3614 of the filter 3604 can be configured to engage an agitator 3616 such that, as the agitator 3616 pivots about a pivot point 3618, the agitator 3616 slideably engages the concave surface 3614 of the filter 3604. As such, at least a portion of any debris adhered to the concave surface 3614 of the filter 3604 can be removed from the filter 3604.

Figure 37:
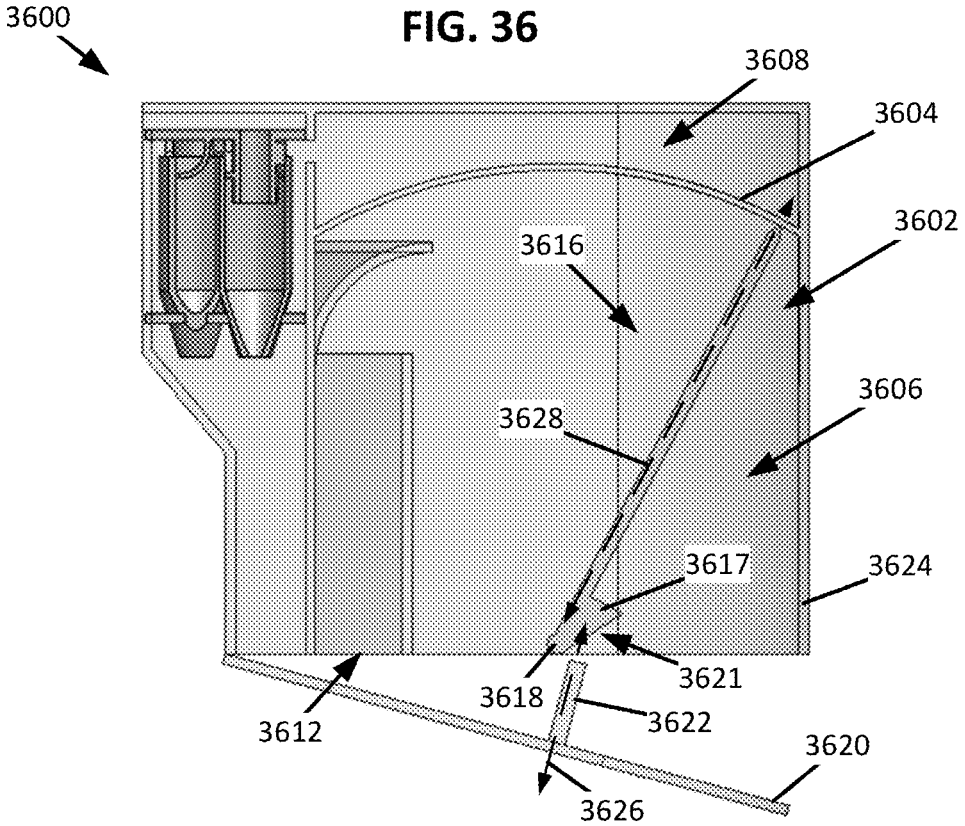
FIG. 37 shows another schematic view of the docking station dust cup of FIG. 36, consistent with embodiments of the present disclosure.

The agitator 3616 can be configured to pivot in response to, for example, the opening of a pivoting door 3620. For example, the pivoting door 3620 can be pivotally coupled to a main body 3624 of the docking station dust cup 3600. As shown, the pivoting door 3620 can include a protrusion 3622 that extends from the pivoting door 3620 at a location adjacent the pivot point 3618. For example, the agitator 3616 can be biased into engagement (e.g., contact) with the protrusion 3622 such that when the pivoting door 3620 is transitioned from a closed position (e.g., as shown in FIG. 36) to an open position (e.g., as shown in FIG. 37) the agitator 3616 pivots about the pivot point 3618. The agitator 3616 can be biased into engagement with the protrusion 3622 using, for example, one or more springs (e.g., torsion springs).

As shown, the agitator 3616 can include a cam 3617 having a protrusion engaging surface 3621 configured to engage (e.g., contact) the protrusion 3622. For example, when the pivoting door 3620 is in the closed position, the protrusion engaging surface 3621 can extend substantially parallel to a longitudinal axis 3626 of the protrusion 3622. Additionally, or alternatively, the protrusion engaging surface 3621 can extend transverse to a longitudinal axis 3628 of the agitator 3616.

Figure 38:
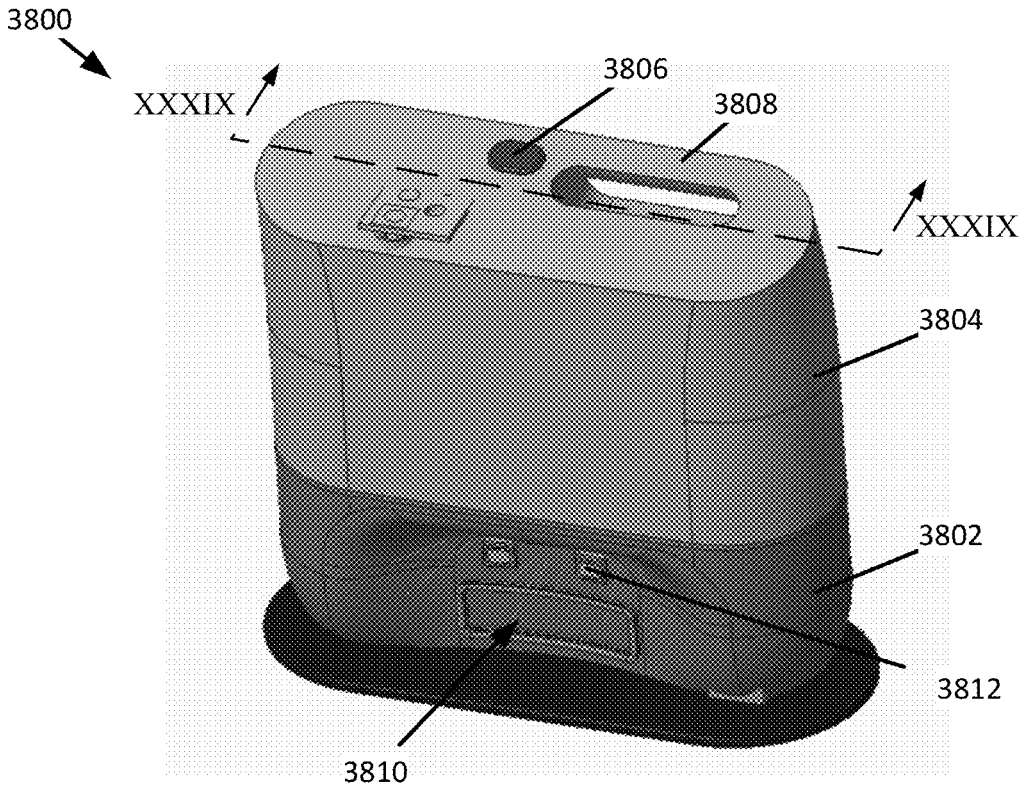
FIG. 38 shows a perspective view of a docking station, consistent with embodiments of the present disclosure.

FIG. 38 shows a perspective view of a docking station 3800, which may be an example of the docking station 100 of FIG. 1. As shown, the docking station 3800 includes a base 3802 having a docking station dust cup 3804 removably coupled thereto. For example, the docking station dust cup 3804 can be decoupled from the base 3802 in response to an actuation of a release 3806 and an application of a force (e.g., by a user) on a handle 3808 formed in the docking station dust cup 3804.

The base 3802 can also include an air inlet 3810 configured to be fluidly coupled to the docking station dust cup 3804 and to a dust cup of a robotic vacuum cleaner such as the robotic cleaner 101 of FIG. 1. As such, debris stored in the dust cup of the robotic vacuum cleaner can be drawn into the docking station dust cup 3804. The base 3802 may also include one or more charging contacts 3812 configured to supply power to a robotic vacuum cleaner to, for example, recharge one or more batteries.

Figure 39:
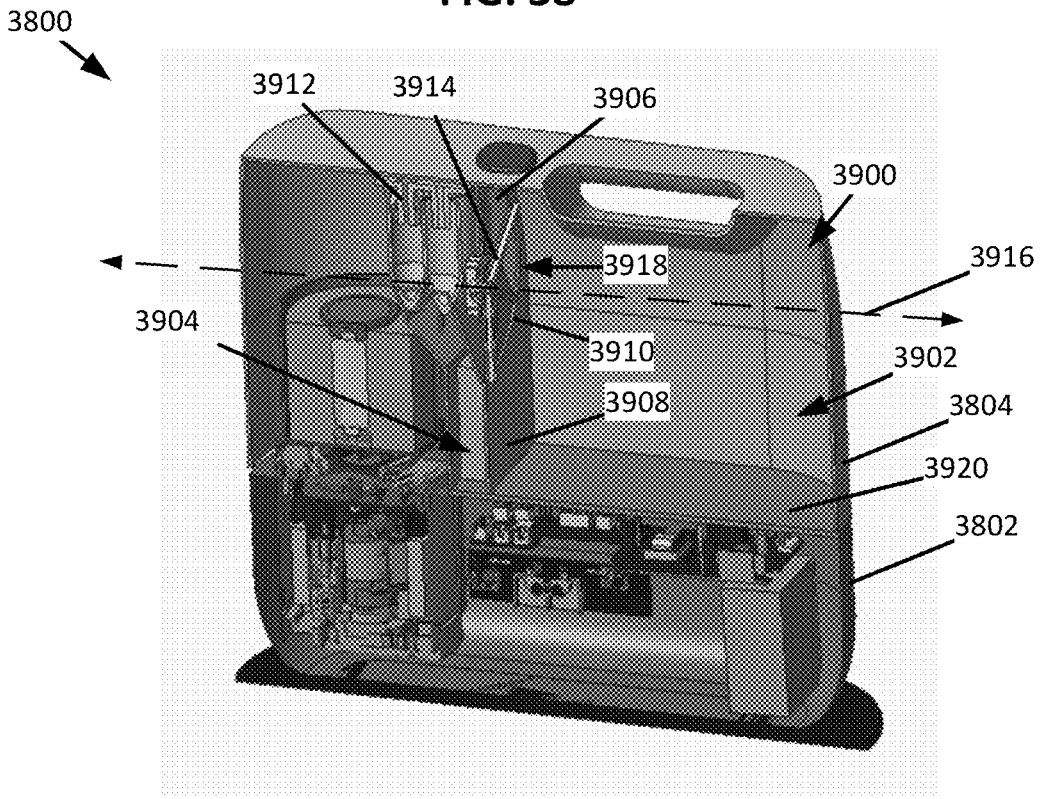
FIG. 39 shows a cross-sectional perspective view of the docking station of FIG. 38 taken along the line XXXIX-XXXIX, consistent with embodiments of the present disclosure.

FIG. 39 is a cross-sectional view of the docking station 3800 taken along the line XXXIX-XXXIX of FIG. 38. As shown, the docking station dust cup 3804 can define an internal volume 3900 having a first (or large) debris compartment (or chamber) 3902 and a second (or small) debris compartment (or chamber) 3904. The large debris compartment 3902 can be fluidly coupled to the small debris compartment 3904 through a filter 3906 (e.g., a filter medium). For example, a separation wall 3908 can extend within the internal volume 3900 to separate the small debris compartment 3904 from the large debris compartment 3902, wherein the separation wall 3908 defines an opening 3910 for receiving the filter 3906.

In operation, air carrying debris can flow from the air inlet 3810 into the large debris compartment 3902 and through the filter 3906. A cyclonic separator 3912 configured to cause one or more cyclones to be generated can be provided to cyclonically separate at least a portion of the debris that passes through the filter 3906 from the air flow. The separated debris can then be deposited in the small debris compartment 3904.

In operation, as air passes through the filter 3906, debris may become adhered to the filter 3906 and may be detrimental to the performance of the docking station 3800. As such, an agitator 3914 may be provided. The agitator 3914 can be configured to rotate about a rotation axis 3916 that extends transverse to (e.g., perpendicular to) a filtering surface 3918 of the filter 3906. As such, as the agitator 3914 rotates, at least a portion of the agitator 3914 engages (e.g., contacts) the filtering surface 3918 of the filter 3906 and dislodges at least a portion of the debris adhered to the filter 3906.

The agitator 3914 can be caused to rotate, for example, in response to the decoupling (or removal) of the docking station dust cup 3804 from the base 3802, in response to the opening of a pivoting door 3920, at predetermined times (e.g., in response to expiration of a predetermined time period), and/or the like. In some instances, the agitator 3914 can be caused to be rotated by a motor and/or be manually rotated (e.g., by pressing a button, by removing the docking station dust cup 3804 from the base 3802, and/or the like).

In some instances, the geometry of the filter 3906 can be configured such that the filter 3906 encourages self-cleaning. For example, the filter 3906 can be oriented (e.g., oriented vertically) such that, when debris is emptied from the docking station dust cup 3804, at least a portion of the debris adhered to the filter 3906 disengages the filter 3906. After disengaging the filter 3906, debris may engage (e.g., contact) additional debris adhered to the filter 3906 and may cause at least a portion of the additional debris to disengage the filter 3906. In these instances, the docking station dust cup 3804 may or may not include the agitator 3914.

Figure 40:
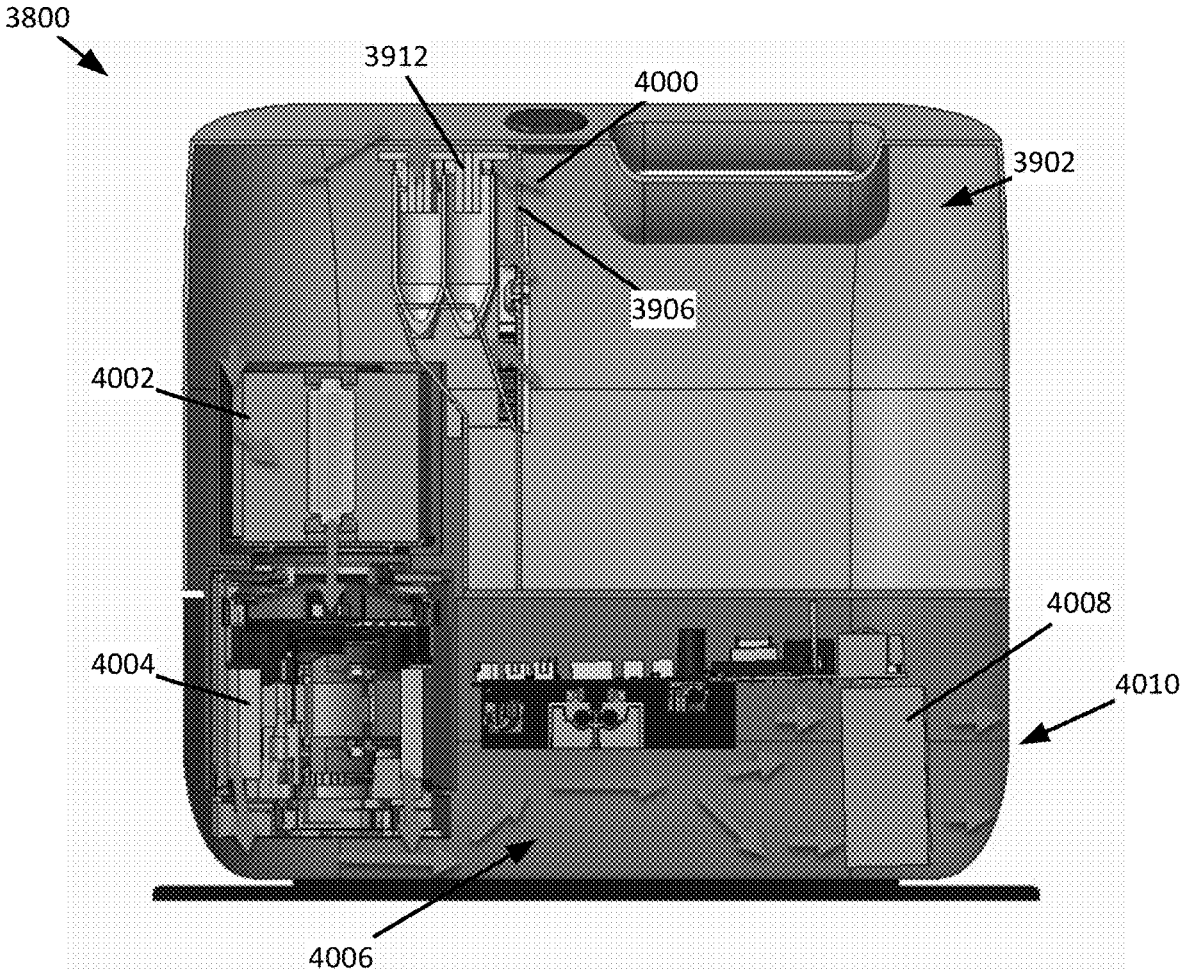
FIG. 40 shows another cross-sectional view of the docking station of FIG. 38 taken along the line XXXIX-XXXIX, consistent with embodiments of the present disclosure.

FIG. 40 is another cross-sectional view of the docking station 3800 taken along the line XXXIX-XXXIX of FIG. 38. FIG. 40 shows an exemplary airflow 4000 extending from the large debris compartment 3902 through the filter 3906 and the cyclonic separator 3912. After exiting the cyclonic separator 3912, the airflow 4000 extends through a premotor filter 4002 and into a suction motor 4004. As shown, the airflow 4000 is exhausted from the suction motor 4004 into an exhaust duct 4006. The exhaust duct 4006 can include a post-motor filter 4008 such as, for example, a high efficiency particulate air (HEPA) filter. The exhaust duct 4006 can be configured such that the noise of the airflow 4000 as it exits an exhaust port 4010 is reduced. For example, the exhaust duct 4006 can be configured to reduce the velocity of the airflow 4000 passing therethrough by for example, increasing the size of the exhaust duct 4006 and/or by increasing a length of a path along which the airflow 4000 travels.

Figure 41:
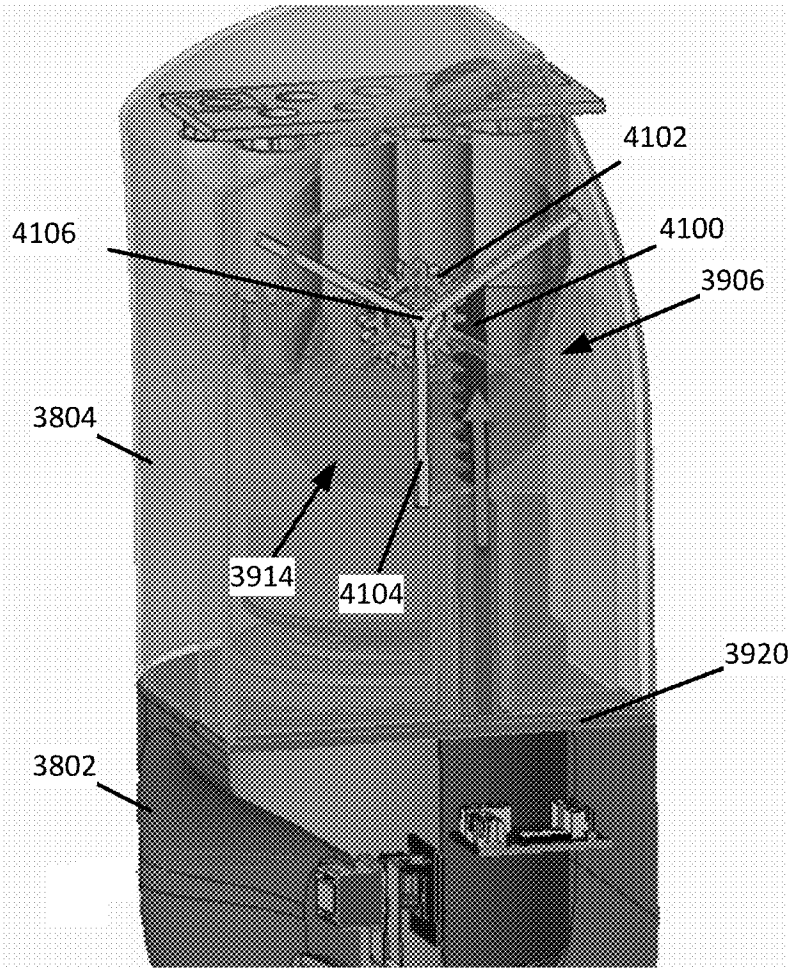
FIG. 41 shows a perspective view of an agitator of the docking station of FIG. 38, consistent with embodiments of the present disclosure.

FIG. 41 shows an example of the agitator 3914, wherein the agitator 3914 is configured to be rotated in response to the decoupling of the docking station dust cup 3804 from the base 3802. As shown, the base 3802 can include a rack 4100 extending from the housing and configured to engage a pinion 4102 coupled to or formed from the agitator 3914. As such, as the docking station dust cup 3804 is removed from the base 3802, the pinion 4102 can be caused to rotate due to its engagement with the rack 4100. The rotation of the pinion 4102 results in a corresponding rotation of the agitator 3914.

In some instances, the rack 4100 can be configured to be stationary such that, as the docking station dust cup 3804 is coupled to or decoupled from the base 3802, the pinion 4102 is urged along the rack 4100. As such, the agitator 3914 is caused to be rotated when the docking station dust cup 3804 is coupled to and decoupled from the base 3802. In some instances, the rack 4100 can be movable relative to the base 3802. For example, the rack 4100 can be configured to be biased in a direction away from the base 3802 (e.g., using a biasing mechanism such as a spring). In these instances, when the docking station dust cup 3804 is being coupled to the base 3802, the docking station dust cup 3804 can be configured to urge the rack 4100 into the base 3802, storing energy in the biasing mechanism (e.g., a compression spring). When the docking station dust cup 3804 is coupled to the base 3802, the rack 4100 can be configured to be retained within the base 3802 by a latching feature and, when, for example, the release 3806 is actuated, the latching feature can disengage the rack 4100 such that the rack 4100 is urged in a direction away from the base 3802 by the biasing mechanism. As such, the movement of the rack 4100 causes the agitator 3914 to rotate.

By way of further example, the rack 4100 may be urged into the pivoting door 3920 by a biasing mechanism (e.g., a compression spring, a torsion spring, an elastomeric material, and/or any other biasing mechanism). As such, when the pivoting door 3920 is opened the rack 4100 may be urged away from the docking station dust cup 3804 causing the agitator 3914 to be rotated. The closing of the pivoting door 3920 may urge the rack 4100 back into the docking station dust cup 3804 such that the biasing mechanism urges the rack 4100 into the pivoting door 3920. In this example, the rack 4100 is separate from the base 3802 and is disposed within the docking station dust cup 3804.

The pinion 4102 can be sized such that the agitator 3914 completes at least one full rotation during removal of the docking station dust cup 3804 from the base 3802. Alternatively, the pinion 4102 can be sized such that the agitator 3914 does not complete a full rotation during removal of the docking station dust cup 3804 from the base 3802.

As also shown, the agitator 3914 includes one or more arms 4104 (e.g., two, three, four, or any other number of arms 4104) extending from a hub 4106, the hub 4106 being coupled to or formed from the pinion 4102. The one or more arms 4104 are configured to engage (e.g., contact) at least a portion of the filter 3906 when rotated. For example, the one or more arms 4104 can include a plurality of bristles extending therefrom, wherein the bristles engage the filter 3906. Additionally, or alternatively, the agitator 3914 can include one or more resiliently deformable wipers.

Figure 42:
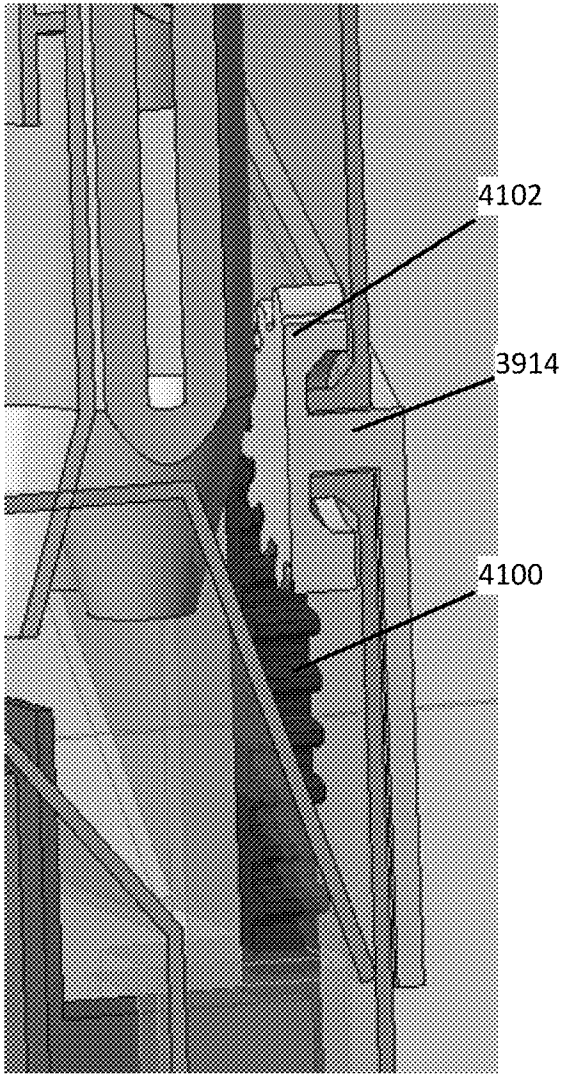
FIG. 42 shows a magnified cross-sectional perspective view of a portion of the agitator of FIG. 41, consistent with embodiments of the present disclosure.

FIG. 42 shows an enlarged cross-sectional side view of the rack 4100, pinion 4102, and agitator 3914 of FIG. 41. In some instances the rack 4100 and pinion 4102 can be enclosed such that ingress of debris into the rack 4100 and pinion 4102 can be mitigated.

Figure 43:
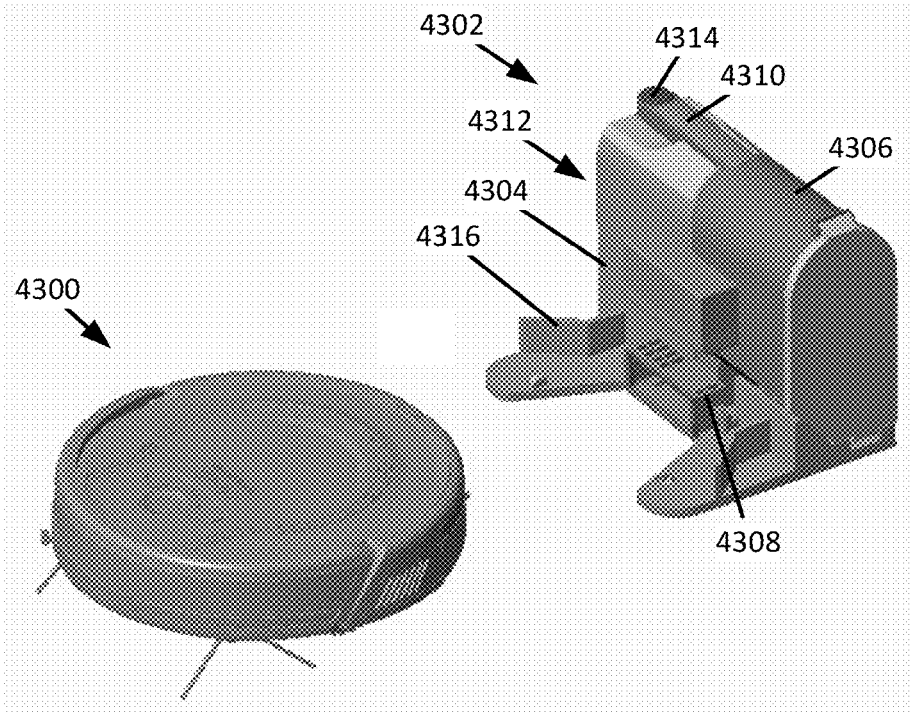
FIG. 43 shows a perspective view of a docking station and a robotic vacuum cleaner, consistent with embodiments of the present disclosure.
Figure 44:
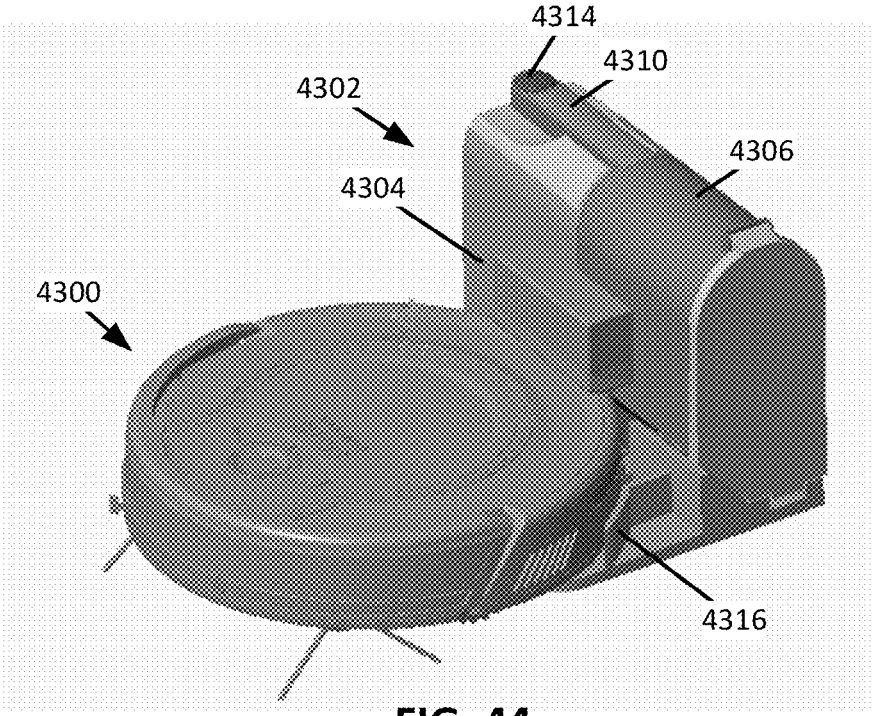
FIG. 44 shows a perspective view of the docking station and robotic vacuum cleaner of FIG. 43, wherein the robotic vacuum cleaner is docked with the docking station, consistent with embodiments of the present disclosure.

FIG. 43 shows a perspective view of a robotic vacuum cleaner 4300, which may be an example of the robotic cleaner 101 of FIG. 1, reversing into a docking station 4302, which may be an example of the docking station 100 of FIG. 1, and FIG. 10 shows a perspective view of the robotic vacuum cleaner 4300 in a docked position (e.g., engaging) the docking station 4302. As shown, the docking station 4302 includes a base 4304 coupled to a docking station dust cup 4306. The docking station dust cup 4306 is configured to be decoupled from the base 4304 in response to a pivotal movement of the docking station dust cup 4306 in a direction away from the base 4304.

As shown, the base 4304 includes a boot 4308 configured to form a seal with at least a portion of the robotic vacuum cleaner 4300. For example, the boot 4308 may engage an outlet port defined in the dust cup of the robotic vacuum cleaner 4300. When the boot 4308 engages the robotic vacuum cleaner 4300 the dust cup of the robotic vacuum cleaner 4300 is fluidly coupled to the docking station dust cup 4306.

As also shown, the docking station dust cup 4306 may include a handle 4310 extending over at least a portion of a suction housing 4312 of the base 4304. The handle 4310 can include a latch 4314 configured to engage with the base 4304. When the latch 4314 is actuated, the docking station dust cup 4306 is permitted to pivot. As such, the latch 4314 can generally be described as being configured to selectively allow the pivotal movement of the docking station dust cup 4306.

In some instances, and as shown, the docking station 4302 can include guides 4316 that extend in a direction away from the boot 4308. The guides 4316 extend from the docking station 4302 on opposing sides of the boot 4308 such that, when the robotic vacuum cleaner 4300 is docked, the guides extend along opposing sides of the robotic vacuum cleaner 4300. The guides 4316 may be configured to urge the robotic vacuum cleaner 4300 into alignment with the boot 4308. Additionally, or alternatively, as the robotic vacuum cleaner 4300 approaches the boot 4308, the docking station 4302 can begin generating a suction at the boot 4308 such that the suction urges the robotic vacuum cleaner 4300 into engagement with the boot 4308. As such, the vacuum generated by the docking station 4302 can also be used to urge the robotic vacuum cleaner 4300 into engagement with the boot 4308.

Figure 45:
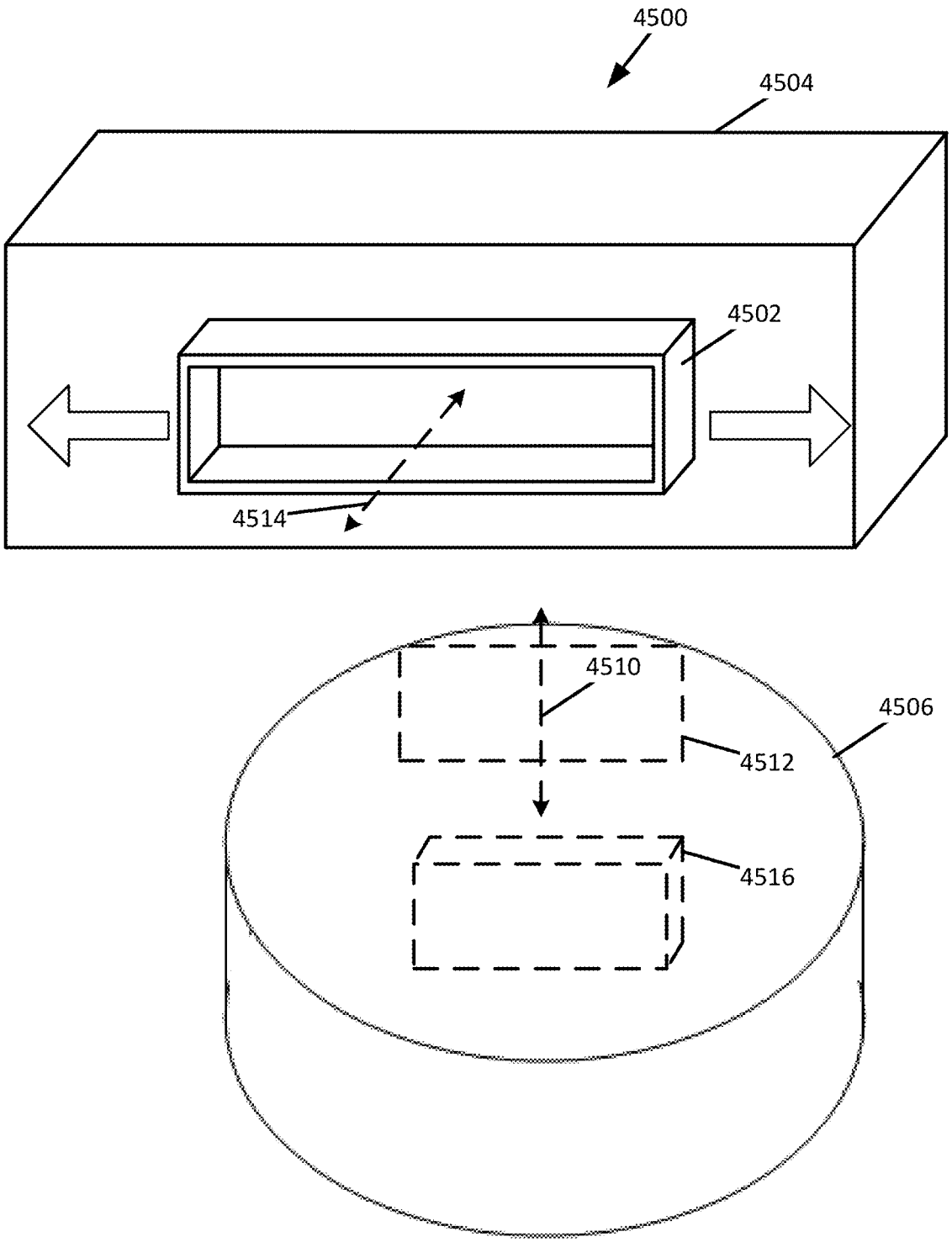
FIG. 45 shows a schematic view of a docking station having an adjustable boot, consistent with embodiments of the present disclosure.

FIG. 45 shows a schematic view of a docking station 4500, which may be an example of the docking station 100, of FIG. 1. The docking station 4500 includes an adjustable boot 4502 configured to slide relative to a base 4504 of the docking station 4500. The adjustable boot 4502 can be configured to slide in response to a robotic vacuum cleaner 4506 engaging the adjustable boot 4502 in a misaligned orientation (e.g., a central axis 4510 of an outlet port 4512 of the robotic vacuum cleaner 4506 is not substantially colinear with a central axis 4514 of the adjustable boot 4502). As such, when the adjustable boot 4502 slides in response to a misaligned orientation, the adjustable boot 4502 can engage the robotic vacuum cleaner 4506 in a substantially aligned orientation, which may allow the adjustable boot 4502 to fluidly couple a dust cup 4516 of the robotic vacuum cleaner 4506 to the docking station 4500.

Figure 46:
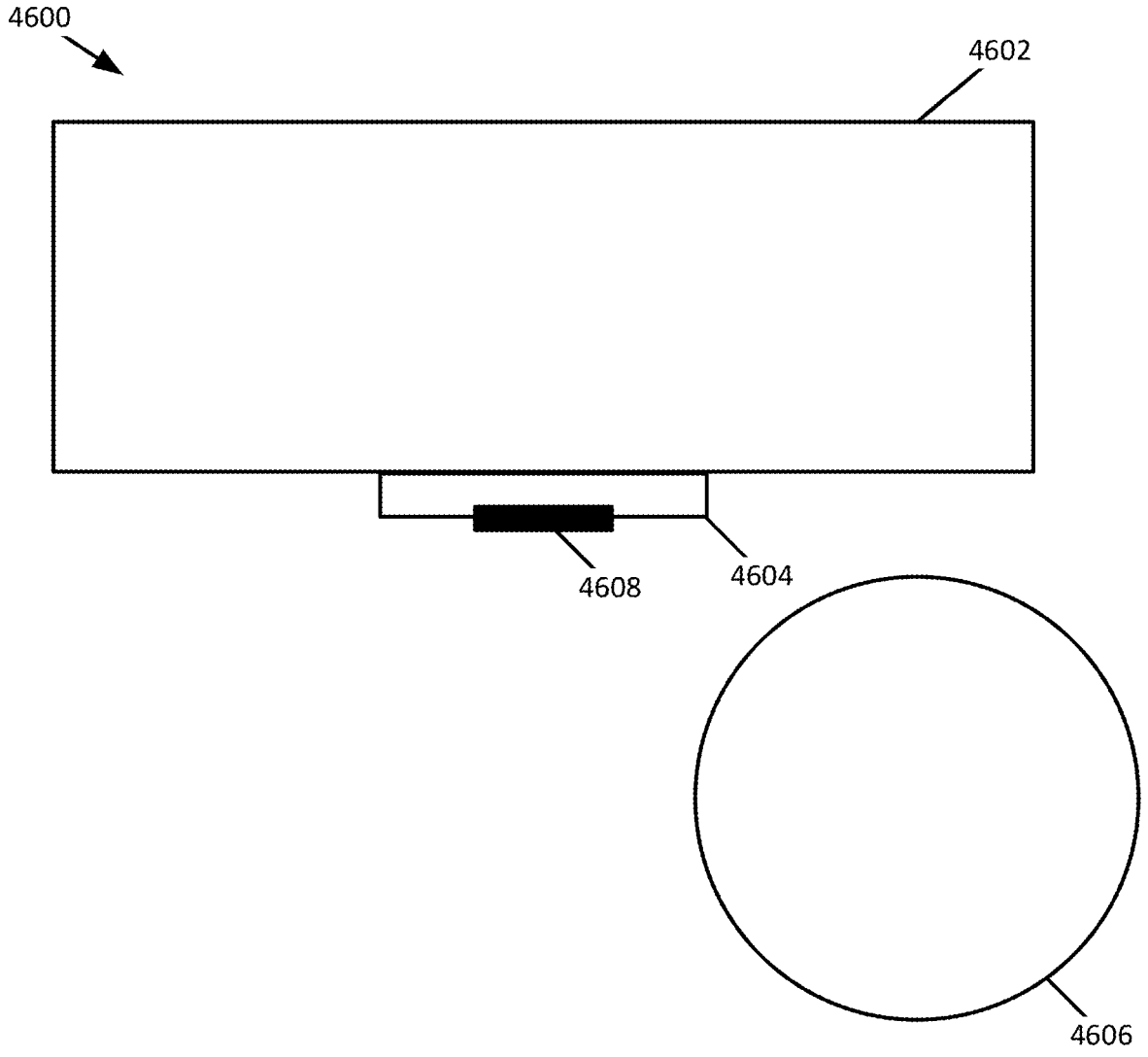
FIG. 46 shows a schematic view of another docking station having an adjustable boot, consistent with embodiments of the present disclosure.

FIG. 46 shows a schematic view of a docking station 4600, which may be an example of the docking station 100 of FIG. 1. The docking station 4600 includes a base 4602 and an adjustable boot 4604. The adjustable boot 4604 is moveable relative to the base 4602 to, at least partially, correct for a misalignment of a robotic cleaner 4606 relative to the adjustable boot 4604. As shown, one or more charging contacts 4608 may be coupled to the adjustable boot 4604 such that the charging contacts 4608 move in response to movement of the adjustable boot 4604. As such, the charging contacts 4608 may electrically couple to the robotic cleaner 4606 when the robotic cleaner 4606 engages the docking station 46100 in a misaligned orientation.

In some instances, the charging contacts 4608 may not be coupled to the adjustable boot 4604. In these instances, the charging contacts 4608 can be configured to electrically couple to the robotic cleaner 4606 for a range of misalignment angles. For example, the dimensions of the charging contacts 4608 may be increased to allow for greater misalignment.

Figure 48:
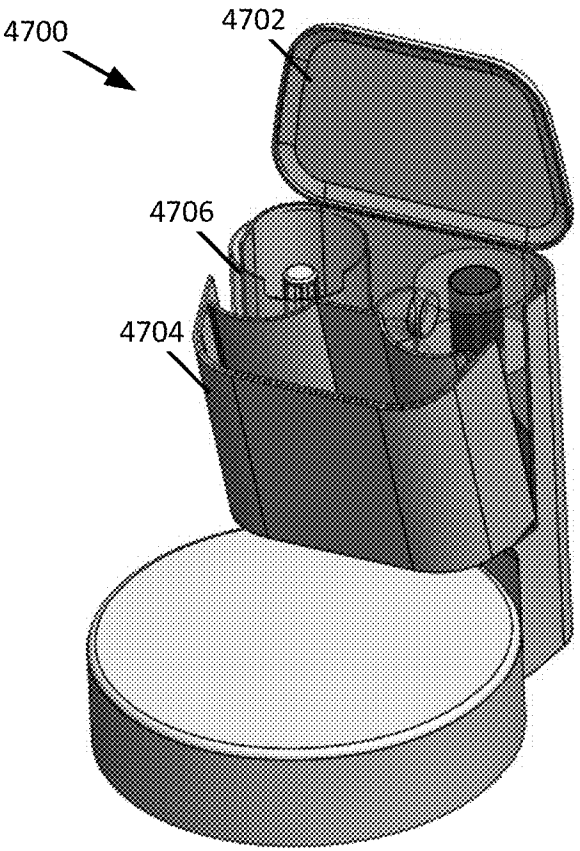
FIG. 48 shows another perspective view of the docking station of FIG. 47, consistent with embodiments of the present disclosure.
Figure 47:
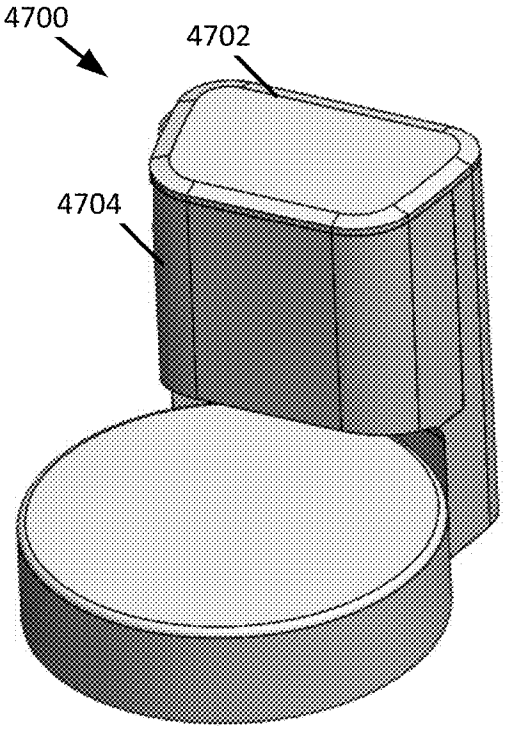
FIG. 47 shows a perspective view of a docking station, consistent with embodiments of the present disclosure.

FIGS. 47 and 48 show an example of a docking station 4700, which may be an example of the docking station 100 of FIG. 1. As shown, the docking station includes a lid 4702 configured to transition between a closed position (e.g., as shown in FIG. 47) and an open position (e.g., as shown in FIG. 48). When the lid 4702 is in the open position, a compartment door 4704 can be pivoted in a direction towards a user and to a dust cup removal position. When the compartment door 4704 is in the dust cup removal position, a docking station dust cup 4706 can be pivoted towards the compartment door 4704 and removed from the docking station 4700.

Figures 49, 50, 51:
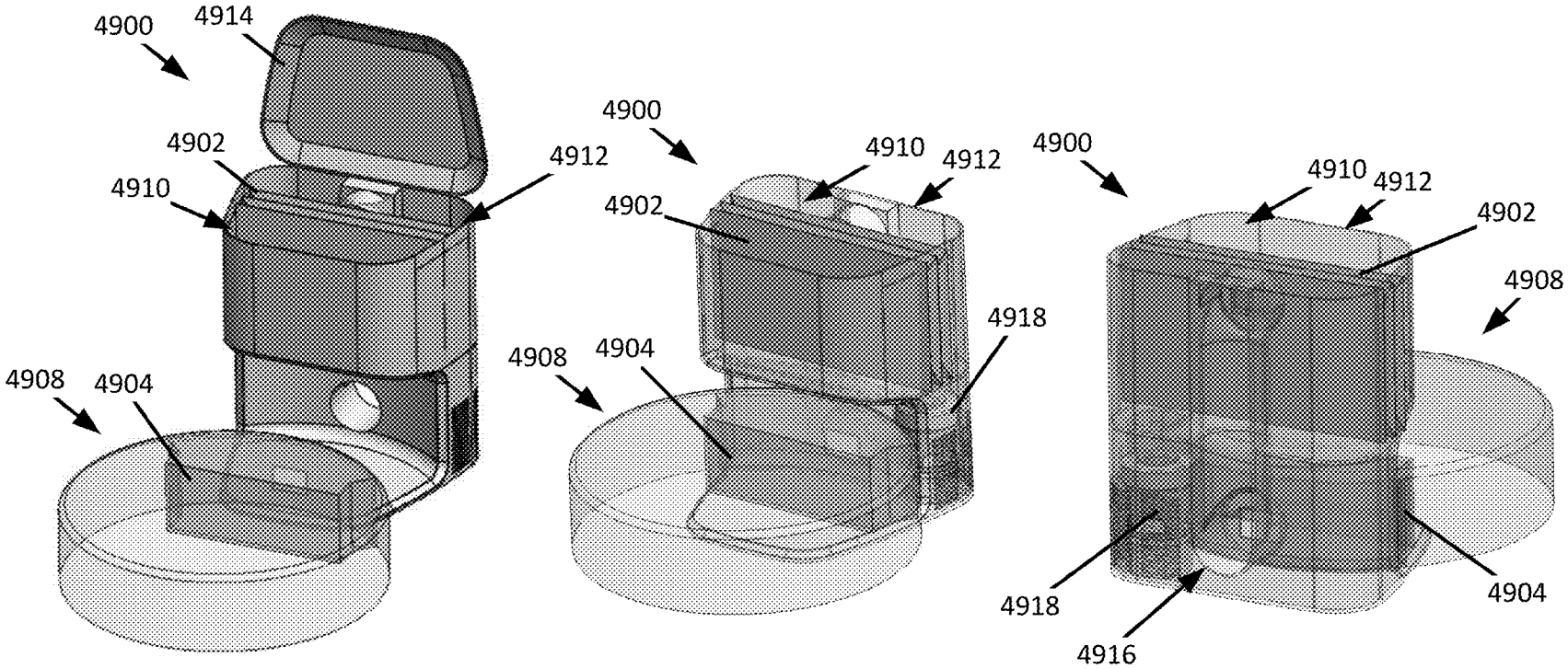
FIG. 49 shows a perspective view of a docking station configured to receive a removable bag, consistent with embodiments of the present disclosure.
FIG. 50 shows another perspective view of the docking station of FIG. 49, consistent with embodiments of the present disclosure.
FIG. 51 shows another perspective view of the docking station of FIG. 49, consistent with embodiments of the present disclosure.

FIGS. 49-51 show an example of a docking station 4900 having a removable bag 4902 configured to receive debris from a dust cup 4904 of a robotic vacuum 4908. The removable bag 4902 may be a disposable bag. In some instances, the removable bag 4902 may include a filter material such that the removable bag 4902 acts a filter. As shown, the removable bag 4902 may be expandable such that as debris is collected in the removable bag 4902 the size of the removable bag 4902 increases.

As also shown, the docking station 4900 defines a cavity 4910 configured to receive the removable bag 4902, wherein the cavity 4910 includes an open end 4912 configured to be closed using a lid 4914. A suction motor 4918 is configured to generate a vacuum within the cavity 4910 such that debris is drawn along a flow path that extends along at least partially along a duct 4916 from the dust cup 4904 of the robotic vacuum 4908 and into the removable bag 4902. As such, in these instances, the removable bag 4902 may act as a pre-motor filter.

Figure 53:
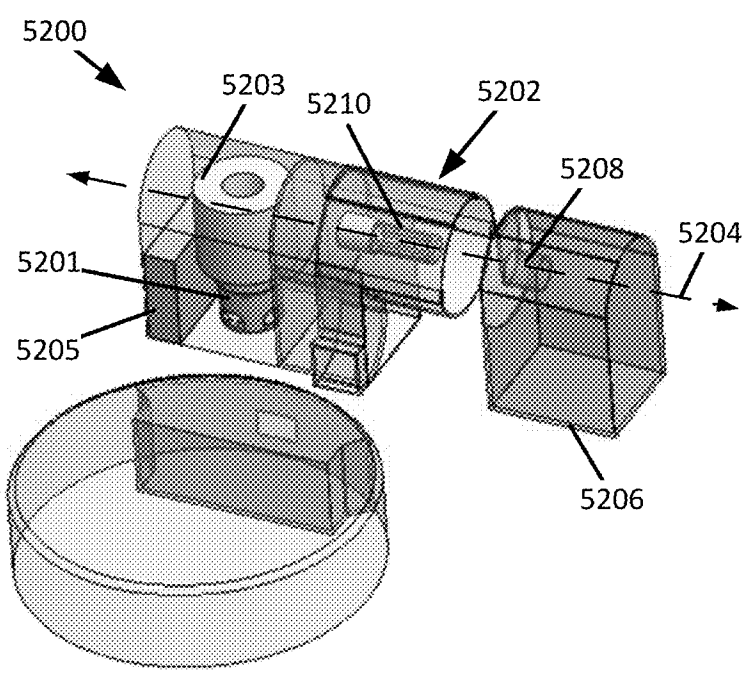
FIG. 53 shows another perspective view of the docking station of FIG. 52 having a dust cup being removed therefrom, consistent with embodiments of the present disclosure.
Figure 52:
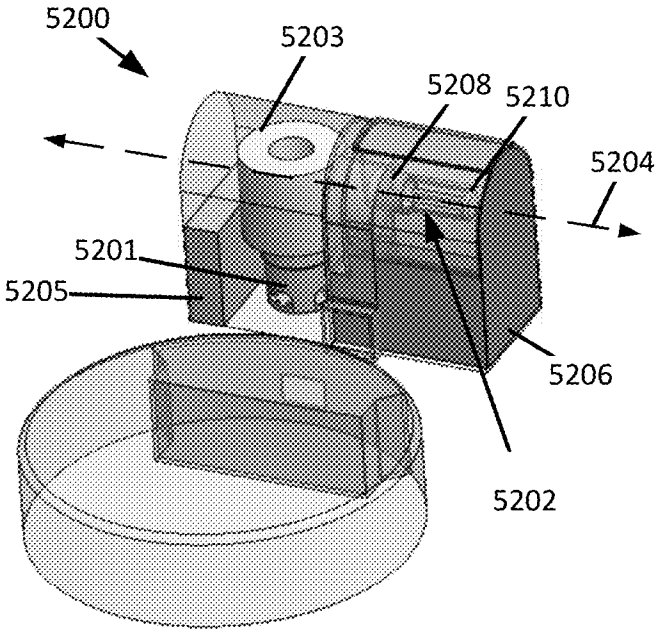
FIG. 52 shows a perspective view of a docking station, consistent with embodiments of the present disclosure.

FIGS. 52 and 53 show an example of a docking station 5200 having a suction motor 5201, a pre-motor filter 5203, a post motor filter 5205, a horizontal cyclonic separator 5202 extending along a longitudinal axis 5204 of the docking station 5200, and a docking station dust cup 5206. As shown, the docking station dust cup 5206 is configured to slideably engage at least a portion of the horizontal cyclonic separator 5202. For example, the docking station dust cup 5206 may be configured to be slideable along the longitudinal axis 5204 such that the docking station dust cup 5206 can be removed from the docking station 5200 to be emptied. As also shown, the docking station dust cup 5206 may include a vortex finder scraper 5208 that is configured to slideably engage a vortex finder 5210 of the horizontal cyclonic separator 5202. For example, the sliding movement of the vortex finder scraper 5208 along the vortex finder 5210 may remove debris from the vortex finder 5210.

Figure 54:
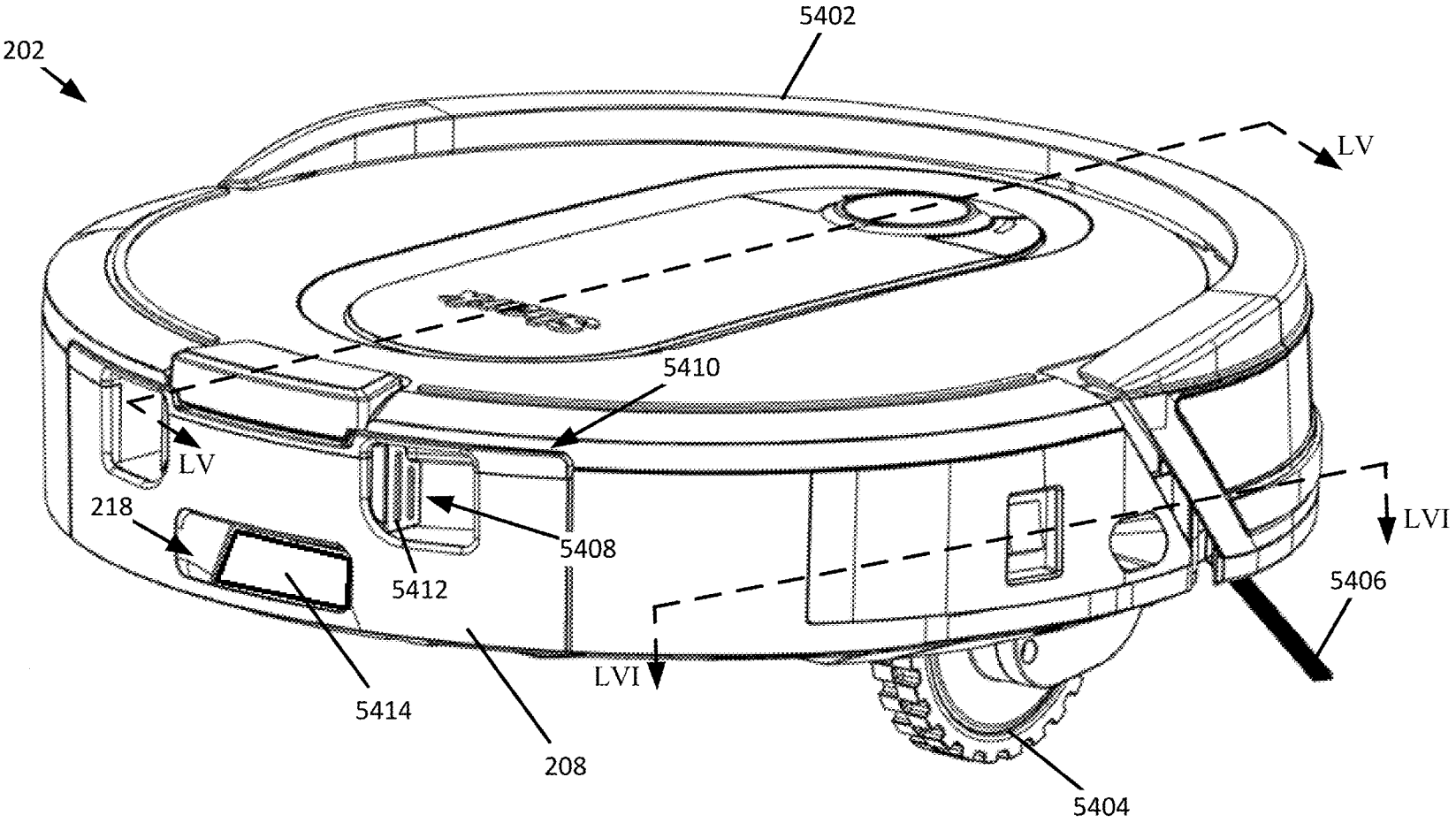
FIG. 54 shows a perspective view of a robotic vacuum cleaner, consistent with embodiments of the present disclosure.

FIG. 54 shows a perspective rearward view of a robotic vacuum cleaner 202. As shown, the robotic vacuum cleaner 202 includes a displaceable bumper 5402, at least one drive wheel 5404, and a side brush 5406. At least a portion of the displaceable bumper 5402 and the robotic vacuum cleaner dust cup 208 are disposed on opposing sides of the drive wheel 5404. As such, the displaceable bumper 5402 is positioned in a forward portion of the robotic vacuum cleaner 202 and the robotic vacuum cleaner dust cup 208 is positioned in a rearward portion of the robotic vacuum cleaner 202.

As shown, the robotic vacuum cleaner dust cup 208 includes a robotic vacuum dust cup release 5408 positioned between a top surface 5410 of the robot vacuum cleaner dust cup 208 and the outlet port 218. The robotic vacuum dust cup release 5408 can include opposing depressable triggers 5412 configured to be actuated in opposing directions. Actuation of the triggers 5412 can cause at least a portion of the robotic vacuum cleaner dust cup 208 to disengage a portion the robotic vacuum cleaner 202 such that the robotic vacuum cleaner dust cup 208 can be removed therefrom.

The outlet port 218 can include an evacuation pivot door 5414. The evacuation pivot door 5414 can be configured to transition from an open position (e.g., when the robotic vacuum cleaner 202 is docked with the docking station 200) and a closed position (e.g., when the robotic vacuum cleaner 202 is carrying out a cleaning operation). When transitioning to the closed position, the evacuation pivot door 5414 can pivot in a direction of the robotic vacuum cleaner dust cup 208. As such, during a cleaning operation, a suction force generated by a suction motor of the robotic vacuum cleaner 202 may urge the evacuation pivot door 5414 towards the closed position. Additionally, or alternatively, in some instances, a biasing mechanism (e.g., a compression spring, a torsion spring, an elastomeric material, and/or any other biasing mechanism) may urge the evacuation pivot door 5414 towards the closed position. When transitioning to the open position, the evacuation pivot door 5414 can pivot in a direction away from the robotic vacuum cleaner dust cup 208. As such, when the robotic vacuum cleaner 202 is docked with the docking station 200, the suction generated by the suction motor 1116 of the docking station 200 may urge the evacuation pivot door 5414 towards the open position.

Figure 55:
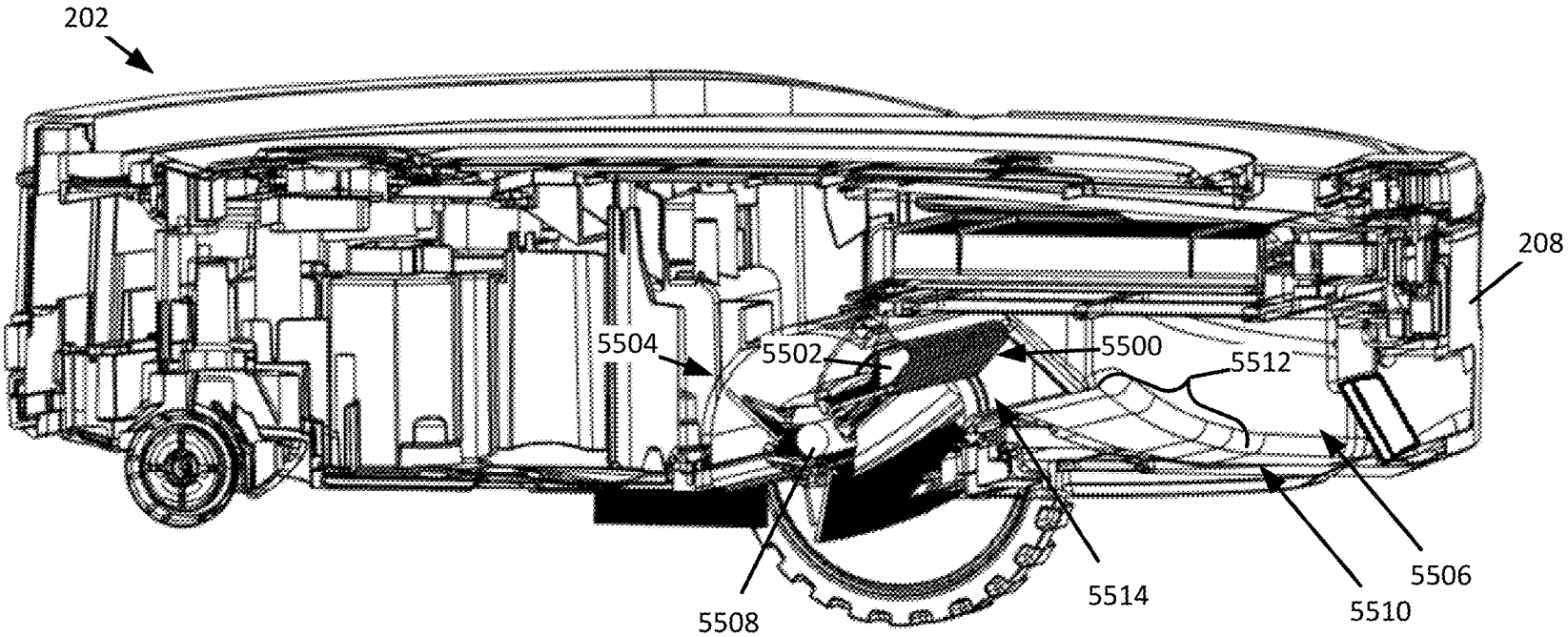
FIG. 55 shows a cross-sectional perspective view of the robotic vacuum cleaner of FIG. 54 taken along the line LV-LV, consistent with embodiments of the present disclosure.

FIG. 55 shows a cross-sectional perspective view of the robotic vacuum cleaner 202 taken along the line LV-LV of FIG. 54. As shown, the robotic vacuum cleaner dust cup 208 includes a rib 5500 having a plurality of teeth 5502. The teeth 5502 are configured to engage a portion of a cleaning roller 5504 of the robotic vacuum cleaner 202. The engagement between the teeth 5502 and the cleaning roller 5504 causes fibrous debris (e.g., hair) wrapped around the cleaning roller 5504 to be removed therefrom. Once removed from the cleaning roller 5504, the fibrous debris can be deposited within a debris collection cavity 5506 of the robotic vacuum cleaner dust cup 208.

In some instances, the cleaning roller 5504 can be configured to be operated in a reverse rotation direction to remove fibrous debris therefrom. The reverse rotation direction may generally correspond to a direction that is opposite to the rotation direction of the cleaning roller 5504 when the robotic vacuum cleaner 202 is performing a cleaning operation. The robotic vacuum cleaner 202 may reverse the cleaning roller 5504 when docking to the docking station 200. For example, the robotic vacuum cleaner 202 may reverse the cleaning roller 5504 when the docking station 200 is suctioning debris from the robotic vacuum cleaner dust cup 208. Additionally, or alternatively, the robotic vacuum cleaner 202 may reverse the cleaning roller 5504 during a cleaning operation.

The cleaning roller 5504 is configured to engage a surface to be cleaned (e.g., a floor). The cleaning roller 5504 may include one or more of bristles and/or flaps extending along a roller body 5508 of the cleaning roller 5504. At least a portion of the cleaning roller 5504 can be configured to engage the surface to be cleaned such that debris residing thereon can be urged into the debris collection cavity 5506 of the robotic vacuum cleaner dust cup 208.

As shown, a bottom surface 5510 of the debris collection cavity 5506 includes a tapering region 5512 that extends between a robotic cleaner dust cup inlet 5514 and the outlet port 218. The tapering region 5512 may encourage deposition of debris at location within the debris collection cavity 5506 proximate the outlet port 218. As such, the evacuation of the robotic vacuum cleaner dust cup 208 may be improved. In some instances, the tapering region 5512 may improve airflow through the robotic vacuum cleaner dust cup 208 when the robotic vacuum cleaner dust cup 208 is being evacuated by the docking station 200. The tapering region 5512 may have, for example, a linear or curved profile.

Figure 56:
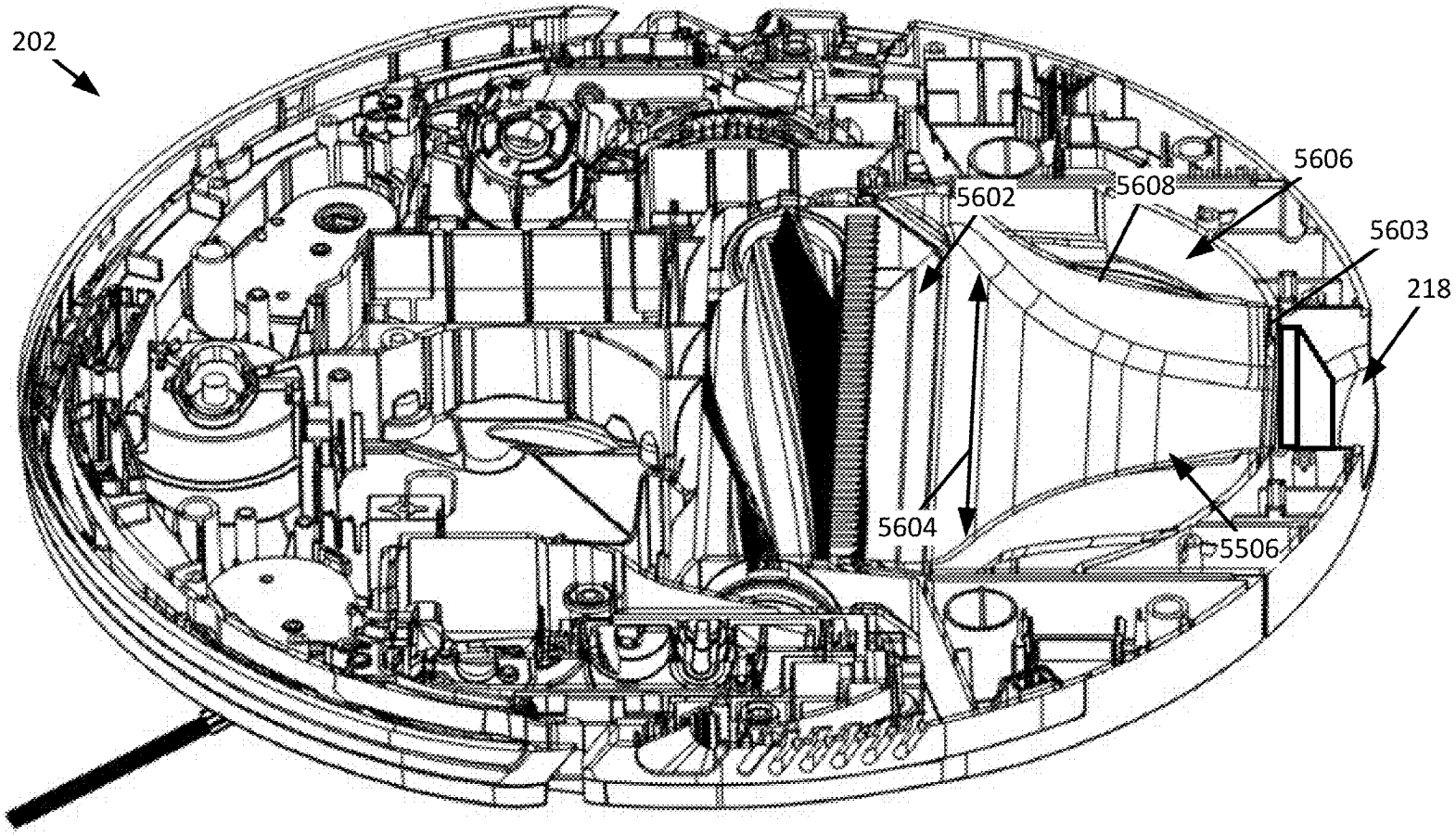
FIG. 56 shows a cross-sectional perspective view of the robotic vacuum cleaner of FIG. 54 taken along the line LVI-LVI, consistent with embodiments of the present disclosure.

FIG. 56 shows a cross-sectional perspective view of the robotic vacuum cleaner 202 taken along the line LVI-LVI of FIG. 54. As shown, the debris collection cavity 5506 tapers from a robotic vacuum cleaner dust cup inlet 5602 to the outlet port 218, wherein the outlet port 218 is defined in a dust cup side wall 5603 extending between the top surface 5410 of the robotic vacuum cleaner dust cup 208 and the dust cup bottom surface 408. In other words, a robotic vacuum cleaner dust cup width 5604 decreases with increasing distance from the robotic vacuum cleaner dust cup inlet 5602. Such a configuration may increase the velocity of air flowing therethrough, cause a more linear velocity gradient to be generated therein, and/or reduce a flow separation between air flowing through the robotic vacuum cleaner dust cup 208 and the sides of the robotic vacuum cleaner dust cup 208 when the robotic vacuum cleaner dust cup 208 is being evacuated.

In some instances, and as shown, the robotic vacuum cleaner dust cup 208 may include constriction regions 5606 on opposing sides of the debris collection cavity 5506. As such, constriction sidewalls 5608, which at least partially define respective constriction regions 5606, may define at least a portion of the taper of the debris collection cavity 5506. In some instances, for example, the constriction sidewalls 5608 may be linear or curved. As shown, the constriction sidewalls 5608 have a convex curvature that extends inwardly into the debris collection cavity 5506 such that the debris collection cavity 5506 tapers from a robotic vacuum cleaner dust cup inlet 5602 to the outlet port 218.

In some instances, the constriction regions 5606 may define an internal volume configured to receive a cleaning liquid to be applied to a surface to be cleaned. For example, the robotic vacuum cleaner 202 may be configured to carry out one or more wet cleaning operations wherein the cleaning liquid is applied to a cleaning pad engaging the surface to be cleaned. In these instances, the cleaning liquid may be replenished by a user and/or automatically when docked with the docking station 200.

Figure 57:
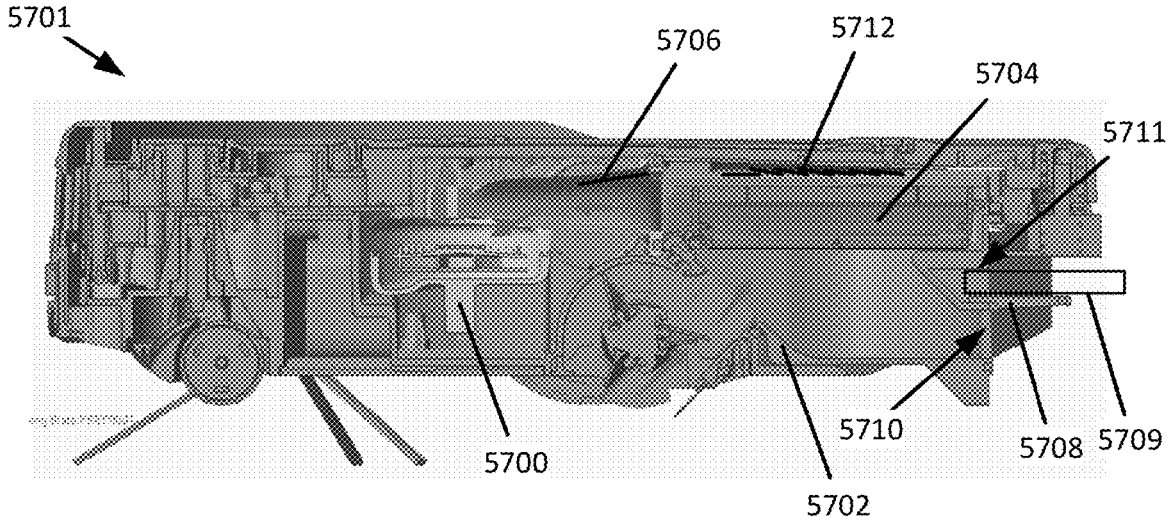
FIG. 57 shows a cross-sectional view of a robotic vacuum cleaner, consistent with embodiments of the present disclosure.
Figure 58:
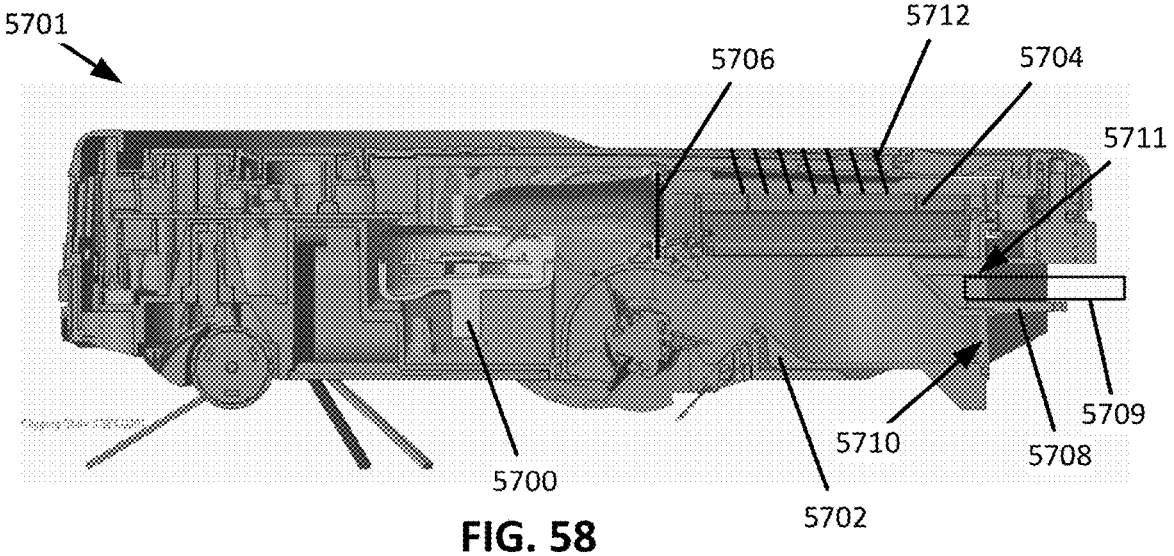
FIG. 58 shows another cross-sectional view of the robotic vacuum cleaner of FIG. 57, consistent with embodiments of the present disclosure.

FIGS. 57 and 58 show a cross-sectional view of the robotic vacuum cleaner 5701, which may be an example of the robotic cleaner 101 of FIG. 1. As shown, the robotic vacuum cleaner 5701 includes a suction motor 5700 fluidly coupled to a robotic vacuum cleaner dust cup 5702. A filter medium 5704 (e.g., a HEPA filter) can be disposed within the flow path extending from the robotic vacuum cleaner dust cup 5702 and the suction motor 5700 such that at least a portion of any debris entrained within the air flowing from the robotic vacuum cleaner dust cup 5702 is captured by the filter medium 5704.

A baffle 5706 can be provided between the filter medium 5704 and the suction motor 5700. As shown, the baffle 5706 is pivotally coupled to the robotic vacuum cleaner 5701 such that, when the suction motor 5700 is activated, the baffle 5706 is pivoted towards an open position and, when the suction motor 5700 isn't activated, the baffle 5706 is pivoted towards a closed position. In other words, the baffle 5706 can generally be described as being configured to selectively fluidly couple the suction motor 5700 to the robotic vacuum cleaner dust cup 5702 of the robotic vacuum cleaner 5701.

As shown, the robotic vacuum cleaner dust cup 5702 of the robotic vacuum cleaner 5701 can include an evacuation pivot door 5708 configured to be actuated when the robotic vacuum cleaner 5701 engages a docking station. For example, the docking station may include a door protrusion 5709 (shown schematically in FIGS. 57 and 58) configured to cause the evacuation pivot door 5708 to pivot from a closed position (e.g., the evacuation pivot door 5708 extends over a fluid outlet 5710 of the robotic vacuum cleaner dust cup 5702) to an open position. As shown, the robotic vacuum cleaner dust cup 5702 can include a protrusion receptacle 5711 configured to receive at least a portion of the door protrusion 5709 such that the evacuation pivot door 5708 is urged to the open position when at least a portion of the door protrusion 5709 is disposed within the protrusion receptacle 5711.

When the robotic vacuum cleaner 5701 engages the docking station, the evacuation pivot door 5708 is in the open position such that the robotic vacuum cleaner dust cup 5702 is fluidly coupled to the docking station dust cup. When the robotic vacuum cleaner dust cup 5702 is fluidly coupled to the docking station dust cup, the baffle 5706 may be in the closed position such that the suction motor 5700 is fluidly decoupled from the robotic vacuum cleaner dust cup 5702. Such a configuration may result in more debris being removed from the robotic vacuum cleaner dust cup 5702 by increasing the suction force generated within the robotic vacuum cleaner dust cup 5702.

In some instances, the robotic vacuum cleaner 5701 can include a vent 5712 configured to be in a closed position (FIG. 57) when the suction motor 5700 is activated and in an open position (FIG. 58) when the robotic vacuum cleaner 5701 is engaging the docking station. When the vent 5712 is in the open position, a flow path may extend from the environment surrounding the robotic vacuum cleaner 5701 through the filter medium 5704 and into the robotic vacuum cleaner dust cup 5702. As such, when the docking station causes a suction force to be generated, debris captured in the filter medium 5704 may be entrained within an air flow flowing through the filter medium 5704.

Figure 59:
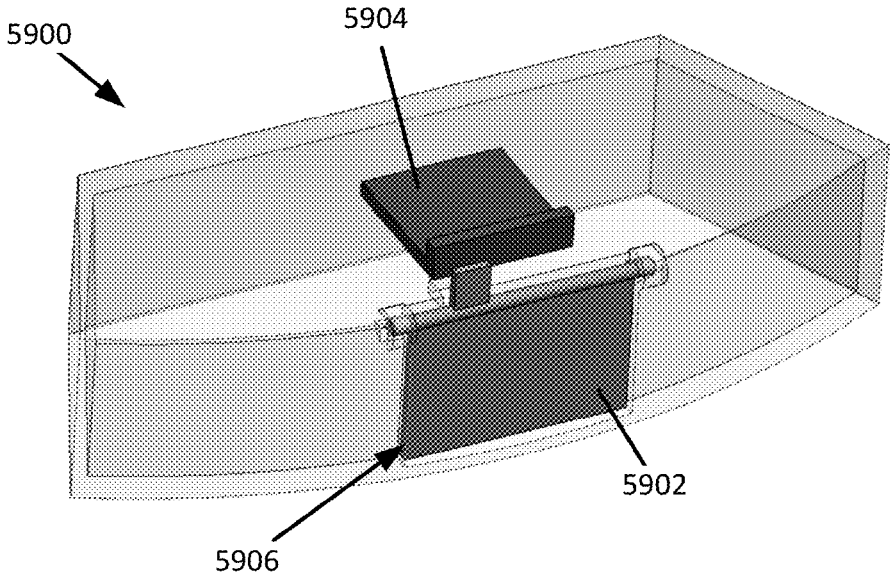
FIG. 59 shows a schematic perspective view of a robotic vacuum cleaner dust cup, consistent with embodiments of the present disclosure.
Figure 60:
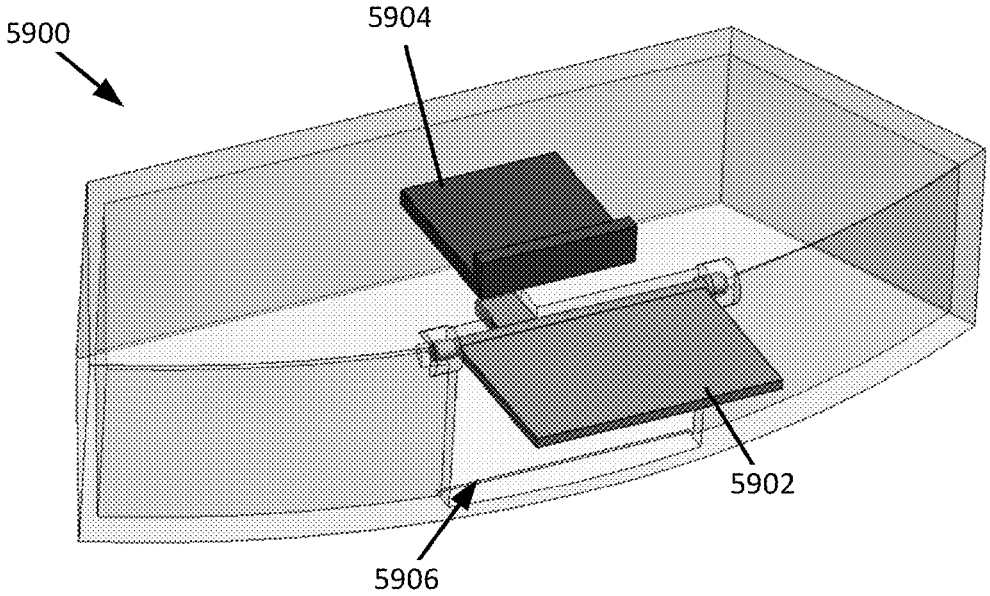
FIG. 60 shows another schematic perspective view of the robotic vacuum cleaner dust cup of FIG. 59, consistent with embodiments of the present disclosure.

FIGS. 59 and 60 show a schematic example of a robotic vacuum cleaner dust cup 5900 having an evacuation pivot door 5902. As shown, the robotic vacuum cleaner dust cup 5900 includes a sliding latch 5904 that slides in response to the robotic vacuum cleaner engaging a docking station. When a suction force is generated by the docking station, the evacuation pivot door 5902 may transition to an open position such that the robotic vacuum cleaner dust cup 5900 is fluidly coupled to the docking station via an outlet port 5906 of the robotic vacuum cleaner dust cup 5900. Additionally, or alternatively, the evacuation pivot door 5902 may be biased towards an open position (e.g., as shown in FIG. 60) using a biasing mechanism (e.g., using a spring, an elastic member, and/or any other biasing mechanism). In these instances, the sliding latch 5904 resists the pivotal movement of the evacuation pivot door 5902 such that, when the sliding latch 5904 moves in response to the robotic vacuum cleaner engaging the docking station, the evacuation pivot door 5902 is urged to the open position by the biasing mechanism. In some instances, the biasing mechanism may urge the evacuation pivot door 5902 towards a closed position (e.g., as shown in FIG. 59).

Figure 61:
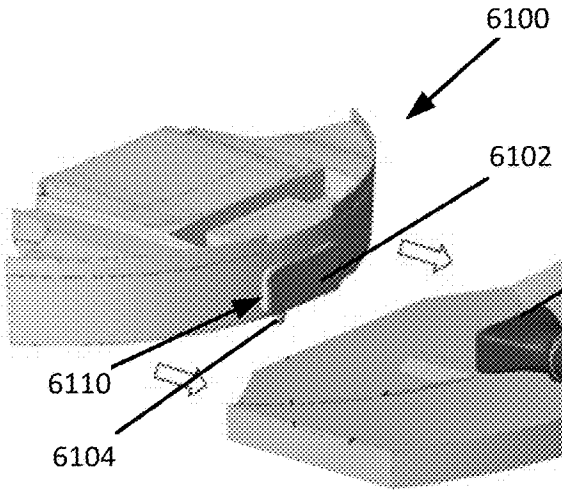
FIG. 61 shows a perspective view of a robotic vacuum cleaner dust cup and a portion of a docking station, consistent with embodiments of the present disclosure.
Figure 62:
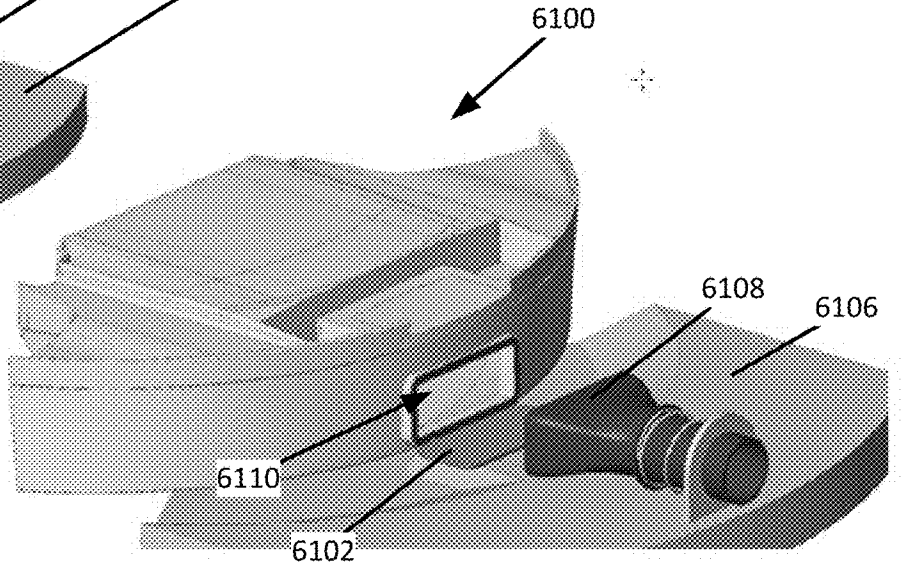
FIG. 62 shows a perspective view of the robotic vacuum cleaner dust cup engaging the portion of the docking station of FIG. 61, consistent with embodiments of the present disclosure.
Figure 63:
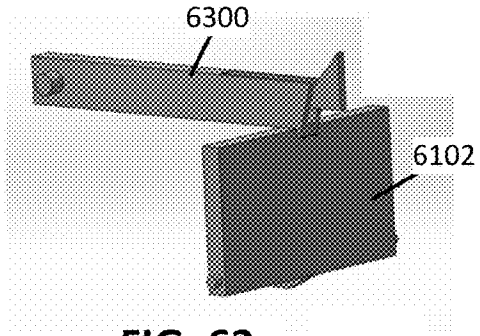
FIG. 63 shows a schematic example of a latch capable of being used to engage an evacuation pivot door of the robotic vacuum cleaner dust cup of FIG. 62, consistent with embodiments of the present disclosure.

FIGS. 61 and 62 show an example of a robotic vacuum cleaner dust cup 6100 having an evacuation pivot door 6102. As shown, the evacuation pivot door 6102 includes a pivot door catch 6104 configured to engage a portion of a docking station 6106 (e.g., the docking station 100 of FIG. 1). As shown, as the robotic vacuum cleaner dust cup 6100 moves over a portion of the docking station 6106, the evacuation pivot door 6102 pivots towards the docking station 6106 such that a docking station suction inlet 6108 can fluidly couple to an outlet port 6110 of the robotic vacuum cleaner dust cup 6100. In some instances, the evacuation pivot door 6102 may be biased towards a closed position (e.g., as shown in FIG. 61) using a biasing mechanism (e.g., using a spring, an elastic member, and/or any other biasing mechanism). Additionally, or alternatively, the evacuation pivot door 6102 may engage a latch 6300 configured to hold the closure flap in the closed position until the latch is actuated by engagement with the docking station (see, e.g., FIG. 63).

A docking station for a robotic vacuum cleaner may include a base, a dust cup configured to pivot relative to the base, and a suction motor configured to cause air to be drawn into the dust cup.

In some instances, the docking station may be configured to be pivoted in a direction away from the base. In some instances, the base may define a pre-motor filter chamber having a pre-motor filter, a motor chamber having the suction motor, and a post-motor filter chamber having a post-motor filter. In some instances, the suction motor and the pre-motor filter may be aligned along an axis that passes through the suction motor and the pre-motor filter. In some instances, the dust cup is configured to generate a cyclone. In some instances, the cyclone may be a horizontal cyclone.

A docking system may include a robotic vacuum cleaner and a docking station. The robotic vacuum cleaner may include a robotic vacuum cleaner dust cup. The docking station may be configured to fluidly couple to the robotic vacuum cleaner dust cup. The docking station may include a base, a docking station dust cup configured to pivot relative to the base, and a suction motor configured to cause air to be drawn into the docking station dust cup.

In some instances, the robotic vacuum cleaner dust cup may include an outlet port configured to be in fluid communication with the docking station dust cup. In some instances, the robotic vacuum cleaner dust cup may include an evacuation pivot door configured to selectively cover the outlet port. In some instances, the evacuation pivot door may be configured to transition to an open position in response to the robotic vacuum cleaner engaging the docking station. In some instances, the docking station may include a protrusion configured to cause the evacuation pivot door to transition from a closed position to an open position. In some instances, the docking station dust cup may be configured to be pivoted in a direction away from the base. In some instances, the base may define a pre-motor filter chamber having a pre-motor filter, a motor chamber having the suction motor, and a post-motor filter chamber having a post-motor filter. In some instances, the suction motor and the pre-motor filter may be aligned along an axis that passes through the suction motor and the pre-motor filter. In some instances, the docking station dust cup may be configured to generate a cyclone. In some instances, the cyclone may be a horizontal cyclone.

A docking station for a robotic vacuum cleaner may include a base, a dust cup defining an interior volume, a filter disposed within the interior volume such that a first debris collection chamber and a second debris collection chamber is defined within the dust cup, and a suction motor configured to cause air to be drawn into the dust cup.

In some instances, the dust cup may be configured to pivot relative to the base. In some instances, the docking station may be configured to be pivoted in a direction away from the base. In some instances, the base may define a pre-motor filter chamber having a pre-motor filter, a motor chamber having the suction motor, and a post-motor filter chamber having a post-motor filter. In some instances, the suction motor and the pre-motor filter may be aligned along an axis that passes through the suction motor and the pre-motor filter. In some instances, the dust cup may be configured to generate a cyclone. In some instances, the cyclone may be a horizontal cyclone.

A docking station for a robotic vacuum cleaner may include a base, a dust cup defining an interior volume, a filter disposed within the interior volume such that a first debris collection chamber and a second debris collection chamber is defined within the dust cup, an agitator configured to dislodge debris adhered to the filter, and a suction motor configured to cause air to be drawn into the dust cup.

In some instances, the dust cup may be configured to pivot relative to the base. In some instances, the docking station may be configured to be pivoted in a direction away from the base. In some instances, the base may define a pre-motor filter chamber having a pre-motor filter, a motor chamber having the suction motor, and a post-motor filter chamber having a post-motor filter. In some instances, the suction motor and the pre-motor filter may be aligned along an axis that passes through the suction motor and the pre-motor filter. In some instances, the dust cup may be configured to generate a cyclone. In some instances, the cyclone may be a horizontal cyclone.

A docking station for a robotic vacuum cleaner may include a base, a dust cup disposed within the base, a boot moveably coupled to the base, the boot being configured to move in response to the robotic vacuum cleaner engaging the boot, and a suction motor configured to cause air to be drawn through the boot and into the dust cup.

In some instances, the boot may be configured to move when the robotic vacuum cleaner engages the boot in a misaligned orientation.

A docking system may include a robotic vacuum cleaner and a docking station. The robotic vacuum cleaner may include a robotic vacuum cleaner dust cup. The docking station may be configured to fluidly couple to the robotic vacuum cleaner dust cup. The docking station may include a base, a dust cup disposed within the base, a boot moveably coupled to the base, the boot being configured to move in response to the robotic vacuum cleaner engaging the boot, and a suction motor configured to cause air to be drawn through the boot and into the dust cup.

In some instances, the boot may be configured to move when the robotic vacuum cleaner engages the boot in a misaligned orientation.

A docking station for a robotic vacuum cleaner may include a base, a dust cup, a suction motor configured to cause air to be drawn into the dust cup through an inlet configured to fluidly couple to the robotic vacuum cleaner, and an alignment protrusion configured to engage an alignment receptacle on the robotic vacuum cleaner such that the robotic vacuum cleaner is urged into alignment with the inlet.

A docking station for a robotic cleaner may include a base, a docking station suction inlet, and an alignment protrusion. The base may include a support and a suction housing. A suction inlet may be defined in the suction housing, the docking station suction inlet being configured to fluidly couple to the robotic cleaner. The alignment protrusion may be defined in the support and may be configured to urge the robotic cleaner towards an orientation in which the robotic cleaner fluidly couples to the docking station suction inlet.

In some instances, the docking station may include a boot configured to engage at least a portion of the robotic cleaner, the boot being configured to move in response to the robotic cleaner engaging the base in a misaligned orientation. In some instances, the alignment protrusion may include first and second protrusion sidewalls that converge, with increasing distance from the docking station suction inlet, towards a central axis of the docking station suction inlet. In some instances, the first and second protrusion sidewalls may include respective arcuate portions. In some instances, a floor facing surface of the support may include one or more grated regions. In some instances, at least a portion of at least one of the one or more grated regions may define a honeycomb structure.

A robotic cleaner configured to dock with a docking station may include a robotic cleaner dust cup and an alignment receptacle. The robotic cleaner dust cup may be configured to receive debris and may include a robotic cleaner dust cup inlet and an outlet port, the outlet port may be configured to fluidly couple to the docking station. The alignment receptacle may be configured to receive a corresponding alignment protrusion defined by the docking station such that inter-engagement between the alignment receptacle and the alignment protrusion urges the robotic cleaner towards an orientation in which the robotic cleaner fluidly couples to the docking station.

In some instances, the alignment receptacle may be defined in the robotic cleaner dust cup. In some instances, the alignment receptacle may include first and second receptacle sidewalls that diverge from a central axis of the outlet port as the first and second receptacle sidewalls approach the outlet port. In some instances, the first and second receptacle sidewalls may include respective arcuate portions.

A robotic vacuum cleaning system may include a docking station and a robotic vacuum cleaner. The docking station may include a base, the base including a support and a suction housing, a docking station suction inlet defined in the suction housing, and an alignment protrusion defined in the support. The robotic vacuum cleaner may include an alignment receptacle configured to receive at least a portion of the alignment protrusion, wherein inter-engagement between the alignment receptacle and the alignment protrusion is configured to urge the robotic vacuum cleaner towards an orientation in which the robotic vacuum cleaner fluidly couples to the docking station suction inlet.

In some instances, the robotic vacuum cleaner may include a robotic vacuum cleaner dust cup having an outlet port, the robotic vacuum cleaner dust cup defining the alignment receptacle. In some instances, the alignment receptacle may include first and second receptacle sidewalls that diverge from an outlet port central axis of the outlet port as the first and second receptacle sidewalls extend towards the outlet port. In some instances, the first and second receptacle sidewalls may include respective arcuate portions. In some instances, the docking station may include a boot configured to engage at least a portion of the robotic vacuum cleaner, the boot being configured to move in response to the robotic vacuum cleaner engaging the base in a misaligned orientation. In some instances, the alignment protrusion may include first and second protrusion sidewalls that converge, with increasing distance from the docking station suction inlet, towards a docking station suction inlet central axis of the docking station suction inlet. In some instances, the first and second protrusion sidewalls may include respective arcuate portions. In some instances, a floor facing surface of the support may include one or more grated regions. In some instances, at least a portion of at least one of the one or more grated regions may define a honeycomb structure. In some instances, the robotic vacuum cleaner may be configured to detect a proximity of the docking station based on detection of a magnetic field extending from the support.

A robotic cleaning system may include a robotic cleaner having a robotic cleaner dust cup and a docking station having a docking station dust cup configured to fluidly couple to the robotic cleaner dust cup. The docking station dust cup may include a first debris collection chamber, a second debris collection chamber fluidly coupled to the first debris collection chamber, and a filter fluidly coupled to the first debris collection chamber and the second debris collection chamber.

In some instances, the docking station dust cup may include a cyclonic separator having a debris outlet, the debris outlet being configured such that debris separated from air flowing through the cyclonic separator is deposited in the second debris collection chamber. In some instances, the docking station dust cup may include a plenum, the plenum being fluidly coupled to the first and second debris collection chambers. In some instances, at least a portion of the plenum may be defined by at least a portion of the filter. In some instances, the docking station dust cup may include an openable door and an up-duct, the up-duct extending between the openable door and the plenum. In some instances, the up-duct may include an up-duct air outlet that is spaced apart from the openable door and a flow directer that extends from the up-duct air outlet, the flow directer being configured to urge at least a portion of air flowing from the up-duct air outlet in a direction away from the plenum. In some instances, the docking station dust cup may include an agitator configured to dislodge at least a portion of debris adhered to the filter therefrom. In some instances, the filter may be a vertical cyclonic separator.

A docking station for a robotic cleaner having a robotic cleaner dust cup may include a base and a docking station dust cup removably coupled to the base and configured to be fluidly coupled to the robotic cleaner dust cup. The docking station dust cup may include a first debris collection chamber, a second debris collection chamber fluidly coupled to the first debris collection chamber, and a filter fluidly coupled to the first debris collection chamber and the second debris collection chamber.

In some instances, the docking station dust cup may include a cyclonic separator having a debris outlet, the debris outlet being configured such that debris separated from air flowing through the cyclonic separator is deposited in the second debris collection chamber. In some instances, the docking station dust cup may include a plenum, the plenum being fluidly coupled to the first and second debris collection chambers. In some instances, at least a portion of the plenum may be defined by at least a portion of the filter. In some instances, the docking station dust cup may include an openable door and an up-duct, the up-duct extending between the openable door and the plenum. In some instances, the up-duct may include an up-duct air outlet that is spaced apart from the openable door and a flow directer that extends from the up-duct air outlet, the flow directer being configured to urge at least a portion of air flowing from the up-duct air outlet in a direction away from the plenum. In some instances, the docking station dust cup may include an agitator configured to dislodge at least a portion of debris adhered to the filter therefrom. In some instances, the filter may be a vertical cyclonic separator.

A dust cup for a robotic cleaner docking station may include a first debris collection chamber, a second debris collection chamber fluidly coupled to the first debris collection chamber, and a filter fluidly coupled to the first debris collection chamber and the second debris collection chamber.

In some instances, the dust cup may include a cyclonic separator having a debris outlet, the debris outlet being configured such that debris separated from air flowing through the cyclonic separator is deposited in the second debris collection chamber. In some instances, the dust cup may include a plenum, the plenum being fluidly coupled to the first and second debris collection chambers. In some instances, at least a portion of the plenum may be defined by at least a portion of the filter. In some instances, the dust cup may include an openable door and an up-duct, the up-duct extending between the openable door and the plenum. In some instances, the up-duct may include an up-duct air outlet that is spaced apart from the openable door and a flow directer that extends from the up-duct air outlet, the flow directer being configured to urge at least a portion of air flowing from the up-duct air outlet in a direction away from the plenum.

A docking station for a robotic cleaner may include a base, a docking station dust cup, a latch, and a release system. The docking station dust cup may be removably coupled to the base, wherein the docking station dust cup is removable from the base in response to a pivotal movement of the docking station dust cup relative to the base about a pivot point. The latch may be actuatable between a retaining position and a release position, the latch being horizontally spaced apart from the pivot point, wherein, when the latch is in the retaining position, pivotal movement of the docking station dust cup is substantially prevented. The release system may be configured to actuate the latch between the retaining and release positions.

In some instances, the release system may include an actuator and a push bar, the actuator configured to urge the push bar between a first push bar position and a second push bar position in response to the actuator being actuated, the push bar being configured to urge the latch between the retaining and release positions. In some instances, the latch may be pivotally coupled to the docking station dust cup. In some instances, the base may include a plunger, the plunger being urged into engagement with the docking station dust cup such that, when the latch is in the release position, the plunger urges the docking station dust cup pivotally away from the base. In some instances, the docking station dust cup may include an openable door, the openable door defining a plunger receptacle for receiving at least a portion of the plunger. In some instances, the docking station dust cup may include a pivot catch configured to engage a corresponding pivot lever pivotally coupled to the base. In some instances, the pivot catch may define a catch cavity configured to engage at least a portion of the pivot lever, the pivot lever being urged towards the catch cavity. In some instances, the latch may be configured to be urged towards the retaining position. In some instances, the docking station dust cup may define a relief region configured to prevent the base from preventing pivotal movement of the docking station dust cup relative to the base. In some instances, at least a portion of the docking station dust cup may be configured to be urged away from the base in response to the latch being actuated to the release position.

A cleaning system may include a robotic cleaner and a docking station configured to fluidly couple to the robotic cleaner. The robotic cleaner may include a base and a docking station dust cup removably coupled to the base, wherein the docking station dust cup is removable from the base in response to a pivotal movement of the docking station dust cup relative to the base about a pivot point. The docking station dust cup may include a latch actuatable between a retaining position and a release position, the latch being horizontally spaced apart from the pivot point and a release system configured to actuate the latch between the retaining and release positions.

In some instances, the release system may include an actuator and a push bar, the actuator configured to urge the push bar between a first push bar position and a second push bar position in response to the actuator being actuated, the push bar being configured to urge the latch between the retaining and release positions. In some instances, the latch may be pivotally coupled to the docking station dust cup. In some instances, the base may include a plunger, the plunger being urged into engagement with the docking station dust cup such that, when the latch is in the release position, the plunger urges the docking station dust cup pivotally away from the base. In some instances, the docking dust cup may include an openable door, the openable door defining a plunger receptacle for receiving at least a portion of the plunger. In some instances, the docking station dust cup may include a pivot catch configured to engage a corresponding pivot lever pivotally coupled to the base. In some instances, the pivot catch may define a catch cavity configured to engage at least a portion of the pivot lever, the pivot lever being urged towards the catch cavity. In some instances, the latch may be configured to be urged towards the retaining position. In some instances, the docking station dust cup may define a relief region configured to prevent the base from preventing pivotal movement of the docking station dust cup relative to the base. In some instances, at least a portion of the docking station dust cup may be configured to be urged away from the base in response to the latch being actuated to the release position.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A docking station for a robotic cleaner comprising:

a base, the base including a support and a suction housing, at least a portion of the support being configured to extend under at least a portion of the robotic cleaner;

a docking station suction inlet defined in the suction housing, the docking station suction inlet being configured to fluidly couple to the robotic cleaner; and an alignment protrusion defined in the support such that at least a portion of the alignment protrusion extends under at least a portion of the robotic cleaner, the alignment protrusion being configured to urge the robotic cleaner towards an orientation in which the robotic cleaner fluidly couples to the docking station suction inlet.

2. The docking station of claim 1 further comprising a boot configured to engage at least a portion of the robotic cleaner, the boot being configured to move in response to the robotic cleaner engaging the base in a misaligned orientation.

3. The docking station of claim 1, wherein the alignment protrusion includes first and second protrusion sidewalls that converge, with increasing distance from the docking station suction inlet, towards a central axis of the docking station suction inlet.

4. The docking station of claim 3, wherein the first and second protrusion sidewalls include respective arcuate portions.

5. The docking station of claim 1, wherein a floor facing surface of the support includes one or more grated regions.

6. The docking station of claim 5, wherein at least a portion of at least one of the one or more grated regions defines a honeycomb structure.

7. A robotic cleaner configured to dock with a docking station comprising:

a robotic cleaner dust cup configured to receive debris, the robotic cleaner dust cup having a top surface, a bottom surface, at least one sidewall extending between the top surface and the bottom surface, a robotic cleaner dust cup inlet, and an outlet port configured to fluidly couple to the docking station, the outlet port being defined in the at least one sidewall; and an alignment receptacle defined in the bottom surface of the robotic cleaner dust cup and configured to receive at least a portion of a corresponding alignment protrusion defined by the docking station such that interengagement between the alignment receptacle and the alignment protrusion urges the robotic cleaner towards an orientation in which the robotic cleaner fluidly couples to the docking station.

8. The robotic cleaner of claim 7, wherein the alignment receptacle includes first and second receptacle sidewalls that diverge from a central axis of the outlet port as the first and second receptacle sidewalls approach the outlet port.

9. The robotic cleaner of claim 8, wherein the first and second receptacle sidewalls include respective arcuate portions.

10. A robotic vacuum cleaning system comprising:

a docking station, the docking station including:

a base, the base including a support and a suction housing;

a docking station suction inlet defined in the suction housing; and an alignment protrusion defined in the support; and a robotic vacuum cleaner, at least a portion of the support being configured to extend under at least a portion of the robotic vacuum cleaner, the robotic vacuum cleaner including:

an alignment receptacle configured to receive at least a portion of the alignment protrusion, wherein inter-engagement between the alignment receptacle and the alignment protrusion is configured to urge the robotic vacuum cleaner towards an orientation in which the robotic vacuum cleaner fluidly couples to the docking station suction inlet, and wherein at least a portion of the alignment protrusion extends under at least a portion of the robotic vacuum cleaner.

11. The robotic vacuum cleaning system of claim 10, wherein the robotic vacuum cleaner further comprises a robotic vacuum cleaner dust cup having an outlet port, the robotic vacuum cleaner dust cup defining the alignment receptacle.

12. The robotic vacuum cleaning system of claim 11, wherein the alignment receptacle includes first and second receptacle sidewalls that diverge from an outlet port central axis of the outlet port as the first and second receptacle sidewalls extend towards the outlet port.

13. The robotic vacuum cleaning system of claim 12, wherein the first and second receptacle sidewalls include respective arcuate portions.

14. The robotic vacuum cleaning system of claim 10, wherein the docking station includes a boot configured to engage at least a portion of the robotic vacuum cleaner, the boot being configured to move in response to the robotic vacuum cleaner engaging the base in a misaligned orientation.

15. The robotic vacuum cleaning system of claim 10, wherein the alignment protrusion includes first and second protrusion sidewalls that converge, with increasing distance from the docking station suction inlet, towards a docking station suction inlet central axis of the docking station suction inlet.

16. The robotic vacuum cleaning system of claim 15, wherein the first and second protrusion sidewalls include respective arcuate portions.

17. The robotic vacuum cleaning system of claim 10, wherein a floor facing surface of the support includes one or more grated regions.

18. The robotic vacuum cleaning system of claim 17, wherein at least a portion of at least one of the one or more grated regions defines a honeycomb structure.

19. The robotic vacuum cleaning system of claim 10, wherein the robotic vacuum cleaner is configured to detect a proximity of the docking station based on detection of a magnetic field extending from the support.

20. The docking station of claim 1, wherein the suction housing extends from the support.

* * * * *